US010779570B2

(12) United States Patent
Fernando et al.

(10) Patent No.: US 10,779,570 B2
(45) Date of Patent: Sep. 22, 2020

(54) AEROSOL FROM TOBACCO

(71) Applicant: PHILIP MORRIS PRODUCTS S.A., Neuchatel (CH)

(72) Inventors: Felix Fernando, Wokingham (GB); Olivier Greim, Villars-Burquin (CH); Christelle Haziza, Neuchatel (CH); Nicola Lama, Bottens (CH); Falk Radtke, Birk (CH)

(73) Assignee: Philip Morris Products S.A., Neuchatel (CH)

( * ) Notice: Subject to any disclaimer, the term of this patent is extended or adjusted under 35 U.S.C. 154(b) by 795 days.

(21) Appl. No.: 14/764,054

(22) PCT Filed: Jan. 30, 2014

(86) PCT No.: PCT/EP2014/051818
§ 371 (c)(1),
(2) Date: Jul. 28, 2015

(87) PCT Pub. No.: WO2014/118286
PCT Pub. Date: Aug. 7, 2014

(65) Prior Publication Data

US 2015/0359264 A1 Dec. 17, 2015

(30) Foreign Application Priority Data

Jan. 30, 2013 (EP) ..... 13153360
Mar. 15, 2013 (EP) ..... 13159614

(51) Int. Cl.
*A24F 47/00* (2020.01)
*H01J 49/00* (2006.01)

(52) U.S. Cl.
CPC ..... *A24F 47/008* (2013.01); *H01J 49/0036* (2013.01)

(58) Field of Classification Search
None
See application file for complete search history.

(56) References Cited

U.S. PATENT DOCUMENTS 2,827,903 A 3/1958 Niederman
3,506,018 A 4/1970 Petrino
(Continued)

FOREIGN PATENT DOCUMENTS

CN 2148471 Y 12/1993
CN 11196660 A 10/1998
(Continued)

OTHER PUBLICATIONS

PCT International Preliminary Examination Report for PCT/EP2014/051818 dated Aug. 4, 2015 (14 pages).
(Continued)

*Primary Examiner* — Eric Yaary
(74) *Attorney, Agent, or Firm* — Mueting Raasch Group

(57) ABSTRACT

In one aspect, there is provided a method of administering nicotine to a user via inhalation of the nicotine through an aerosol generating device comprising the steps of: (a) providing an aerosol-generating device in which tobacco contained in the aerosol-generating device is electrically heated to a temperature of less than about 400 degrees Celsius; and (b) allowing the user to inhale the aerosol derived from the electrically heated tobacco; wherein the aerosol contains levels of nicotine that are about the same as the levels in combusted tobacco; and wherein the level of one or more harmful or potentially harmful constituents (HPHCs) other than nicotine in the aerosol is lower than the level in combusted tobacco.

10 Claims, 11 Drawing Sheets

(56) References Cited

U.S. PATENT DOCUMENTS

| | | | | |
|---|---|---|---|---|
| 4,438,776 | A * | 3/1984 | Lamb | A24D 3/043 131/336 |
| 4,776,353 | A * | 10/1988 | Lilja | A24B 15/18 131/273 |
| 5,372,148 | A * | 12/1994 | McCafferty | A24F 47/008 131/194 |
| 5,403,551 | A | 4/1995 | Galloway | |
| 6,095,153 | A | 8/2000 | Kessler | |
| 6,615,840 | B1 | 9/2003 | Fournier | |
| 8,342,184 | B2 | 1/2013 | Inagaki | |
| 8,613,285 | B2 | 12/2013 | Fuisz | |
| 2003/0154991 | A1 | 8/2003 | Fournier | |
| 2006/0047368 | A1* | 3/2006 | Maharajh | F22B 1/28 700/283 |
| 2007/0074734 | A1* | 4/2007 | Braunshteyn | A24F 13/00 131/328 |
| 2007/0102013 | A1* | 5/2007 | Adams | A24F 47/008 131/273 |
| 2009/0095287 | A1 | 4/2009 | Emarlou | |
| 2011/0126848 | A1* | 6/2011 | Zuber | A24F 47/008 131/329 |
| 2011/0192408 | A1 | 8/2011 | Inagaki | |
| 2012/0234821 | A1 | 9/2012 | Shimizu | |
| 2013/0014755 | A1* | 1/2013 | Kumar | A24F 47/006 128/202.21 |
| 2013/0255702 | A1* | 10/2013 | Griffith, Jr. | A24F 47/008 131/328 |

FOREIGN PATENT DOCUMENTS

| | | |
|---|---|---|
| CN | 1633247 | 6/2005 |
| CN | 202476429 | 10/2012 |
| CN | 102885398 A | 1/2013 |
| EP | 0358002 | 3/1990 |
| EP | 0430559 | 6/1991 |
| EP | 0857431 | 8/1998 |
| EP | 0845220 | 9/2003 |
| EP | 1832745 | 9/2007 |
| EP | 2340730 | 7/2011 |
| JP | H08-503556 | 4/1996 |
| JP | 2005-517421 | 6/2005 |
| JP | 2011-500021 | 1/2011 |
| JP | 2011-115141 | 6/2011 |
| WO | WO 2010/047389 | 4/2010 |
| WO | WO 2012/079887 | 6/2012 |
| WO | WO 2012/164009 | 12/2012 |

OTHER PUBLICATIONS

Beiträge zur Tabakforschung International/*Contributions to Tobacco Research* vol. 25, No. 1, Feb. 2012, 3 pages.

Diekmann et al, "Gas Chromatographic-Mass Spectrometric Analysis of Acrylamide and Acetamide in Cigarette Mainstream Smoke after On-Column Injection," *J. Chromatogr. Sci*. 46 (2008) 659-663.

Diekmann et al., "Rapid and Sensitive Method for the Determination of Propylene Oxide in Cigarette Mainstream Smoke by Gas Chromatography—Mass Spectrometry", *J. Chromatogr. Sci*. 44 (2006) 32-34.

Mottier et al., "Evaluation of Two Derivatization Reagents for the Determination by LC-MS-/MS of Ammonia in Cigarette Mainstream Smoke", *J. Agric. Food Chem*. 59 (2011) 92-97.

Roemer et al., "Chemical Composition, Cytotoxicity and Mutagenicity of Smoke from US Commercial and Reference Cigarettes Smoked Under Two Sets of Machine Smoking Conditions", *Toxicology* 195 (2004) 31-52.

Stabbert et al., "Analysis of Aromatic Amines in Cigarette Smoke", *Rapid Commun. Mass. Spectrom*. 17 (2003) 2125-2132.

Wagner et al., "Development of a Quantitative Method for the Analysis of Tobacco-Specific Nitrosamines in Mainstream Cigarette Smoke Using Isotope Dilution Liquid Chromatography/Electrospray Ionization Tandem Mass Spectrometry, " *Anal. Chem*. 77 (2005) 1001-1006.

Office Action issued in China for Application No. 201480006295.1 dated Jan. 2, 2018 (13 pages). English translation included.

Office Action issued in Japan for Application No. 2015-555707 dated Nov. 6, 2017 (8 pages). English translation only.

Office Action issued in Europe for Application No. 14702022.6-1375 dated Sep. 18, 2017 (4 pages).

Office Action issued in China for Application No. 201480006295.1 dated Feb. 28, 2017 (12 pages). English translation included.

PCT Search Report and Written Opinion for PCT/EP2014/051818 dated Mar. 20, 2015 (21 pages).

Office Action issued in China for Application No. 201480006295.1 dated Sep. 13, 2018 (25 pages). English translation included.

Office Action issued in Japan for Application No. 2015-555707 dated Aug. 28, 2018 (7 pages).

Office Action issued in China for Application No. 201480006295.1 dated Oct. 21, 2019 (29 pages). English translation included.

Office Action issued in Japan for Application No. 2015-555707 dated Jun. 3, 2019 (15 pages). English translation included.

* cited by examiner

On switching to Platform 1 the change in CYP1A2 activity is comparable to smoking abstinence (30%)

AEROSOL FROM TOBACCO

This application is a U.S. National Stage Application of International Application No. PCT/EP2014/051818, filed Jan. 30, 2014, which was published in English on Aug. 7, 2014 as International Patent Publication WO 2014/118286 A2. International Application No. PCT/EP2014/051818 claims priority to European Application No. 13153360.6 filed Jan. 30, 2013 and European Application No. 13159614.0 filed Mar. 15, 2013.

FIELD OF THE INVENTION

The present disclosure relates, in general, to the use of an aerosol generating device that heats tobacco and generates an aerosol which comprises fewer harmful and potentially harmful constituents (HPHC) therein as compared to tobacco combusted in conventional cigarettes whilst retaining levels of nicotine. Inhalation of the aerosol also exposes the user to lower levels and/or fewer harmful and potentially harmful constituents (HPHC).

BACKGROUND OF THE INVENTION

Smoking articles in which tobacco is heated rather than combusted have been proposed in the art. One aim of such heated smoking articles is to try and reduce known harmful aerosol constituents of the type produced by the combustion and pyrolytic degradation of tobacco in conventional cigarettes. There have been numerous estimates of the number of chemicals in conventional cigarette aerosol. Some estimates suggest that there around 5,300 chemicals. Many of these chemicals are generated by the thermal decomposition, pyrolysis and/or incomplete combustion of tobacco at temperatures in excess of 300° C. For example, carbon monoxide (CO) is produced from the pyrolysis of tobacco plant components and from the incomplete combustion of tobacco at temperatures above 300° C.; nitrogen oxide (NO) forms over two main temperature regions, 300° C. and 450° C., respectively; hydrocarbons and aldehydes (such as formaldehyde and acrolein) are produced by the thermal decomposition of tobacco constituents and have main peak temperatures of formation above 300° C.; phenols are products of the pyrolysis of structural carbohydrate, lignin and aliphatic and aromatic acid components of tobacco with temperatures of formation ranging from 250° C. to 550° C.; polycyclic aromatic hydrocarbons (PAHs) have been associated with the decomposition of tobacco structural components at temperatures above 400° C.; 1,3-butadiene, benzene, and styrene form at temperatures above 400° C.; and tobacco-specific nitrosamines (TSNAs) are present in tobacco and can be either transferred by distillation or pyro-synthesised at temperatures between 200 and 400° C.

Typically in heated smoking articles, an aerosol is generated by the transfer of heat from a heat source to a physically separate aerosol-forming substrate or material, which may be located within, around or downstream of the heat source. During smoking, volatile compounds are released from the aerosol-forming substrate by heat transfer from the heat source and entrained in air drawn through the smoking article. As the released compounds cool, they condense to form an aerosol that is inhaled by the user.

Aerosol-generating articles and devices for consuming or smoking heated smoking articles are known in the art. They can include, for example, electrically heated aerosol-generating devices in which an aerosol is generated by the transfer of heat from one or more electrical heating elements of the aerosol-generating device to the aerosol-forming substrate of a heated smoking article.

It would be highly desirable to be able to generate an aerosol from tobacco in which the level of one or more known HPHCs normally produced by combustion of tobacco are decreased to low or negligible or non-detectable levels and whilst retaining levels of nicotine in the aerosol that are acceptable to the user. The present disclosure seeks to address this need.

SUMMARY OF THE INVENTION

The present inventors have found that when tobacco is heated to a controlled temperature (for example, in a manner which ensures that pyrolysis is reduced and combustion does not occur) rather than combusted, a significant reduction in the levels of one or more HPHCs (other than nicotine) can occur in the aerosol produced by the heated tobacco versus the combusted tobacco. Suitably, the tobacco is electrically heated. In particular, in the aerosol of the heated tobacco it has been found that the levels of many HPHCs (other than nicotine) that would otherwise be present in aerosol from combusted tobacco are detectable at negligible levels or even not detectable at all. Thus, lower amounts of HPHCs (other than nicotine) are released in the aerosol of the heated tobacco making the aerosol less complex. When the aerosol is inhaled by a (human) user it has also been found that lower amounts of the one or more HPHCs (other than nicotine) are consumed.

Another surprising aspect is that the aerosol that is generated by heating still contains levels of nicotine that are acceptable to the user. Thus, whilst the aerosol produced by the heating of tobacco becomes less complex in that lower amounts or fewer HPHCs are contained therein, the levels of nicotine are maintained at acceptable levels. Thus, acceptable levels of nicotine are delivered to the user (for example, absorbed into the bloodstream) upon inhalation of the aerosol.

Even more surprising is that the nicotine profile delivery to the bloodstream of the user is very similar to the profile observed from combusted tobacco. The nicotine profile delivery observed in combusted tobacco is generally the profile which is most acceptable to the user since it delivers high levels of nicotine in a short period of time (for example, more than 10 ng/ml in about 9 minutes).

The heating of tobacco in accordance with the present disclosure has therefore been found to provide a number of advantages. It provides an aerosol that may bring potential health benefits to the user since lower levels of one or more HPHCs are observed therein as compared to combusted tobacco. Moreover, an acceptable level of nicotine is delivered via an acceptable nicotine delivery profile.

In one aspect, there is provided a method of inhaling of an aerosol comprising nicotine through an aerosol generating device comprising the steps of: (a) providing an aerosol-generating device in which tobacco contained in the aerosol-generating device is electrically heated to a temperature of less than about 400 degrees Celsius to create an aerosol; and (b) allowing a user to inhale the aerosol derived from the electrically heated tobacco; optionally measuring the levels of at least nicotine and one or more HPHCs therein; and wherein the aerosol contains levels of nicotine that are about the same (for example, substantially identical or the same) as the levels in combusted tobacco; and wherein the aerosol contains levels of one or more harmful or potentially harmful constituents (HPHCs) other than nicotine that are lower than the levels in combusted tobacco.

In certain embodiments, the levels of chemical constituents in tobacco are determined using standard ISO methods as described herein—including ISO standard 3402 or ISO standard 3308 or a combination thereof. In certain embodiments, the aerosol from combusted tobacco is from a conventional/reference cigarette—such as the reference cigarette 3R4F or 2R4F. The levels of the chemical constituents in the reference cigarettes 3R4F or 2R4F are published in Beiträge zur Tabakforschung International/*Contributions to Tobacco Research* Volume 25, No. 1, February 2012.

In a further aspect there is provided a method of smoking via inhalation of an aerosol comprising nicotine comprising the steps of: (a) providing to a user an aerosol-generating device in which tobacco contained in the aerosol-generating device is electrically heated to a temperature of less than about 400 degrees Celsius to create an aerosol; and (b) allowing the user to inhale the aerosol derived from the electrically heated tobacco; wherein the aerosol contains levels of nicotine that are about the same as the levels in combusted tobacco; and wherein the aerosol contains levels of one or more harmful or potentially harmful constituents (HPHCs) other than nicotine that are lower than the levels in combusted tobacco.

In one embodiment, the HPHC other than nicotine in the aerosol generated by the electrically heated tobacco is selected from the group consisting of: nicotine-free dry particulate matter (NFDPM), carbon monoxide, formaldehyde, acetaldehyde, acetone, acrolein, propionaldehyde, crotonaldehyde, methyl-ethyl ketone, butyraldehyde, benzo [a]pyrene, phenol, m-cresol, o-cresol, p-cresol, catechol, resorcinol, hydroquinone, 1,3-butadiene, isoprene, acrylonitrile, benzene, toluene, pyridine, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia, arsenic, cadmium, chrome, lead, nickel, selenium and mercury or a combination of one or more thereof or a combination thereof.

In one embodiment, the one or more HPHCs other than nicotine are not detectable or are not appreciably detectable in the aerosol generated by the electrically heated tobacco, said HPHCs being selected from the group consisting of: m-cresol, p-cresol, 1,3 butadiene, isoprene, acrylonitrile, benzene, 1-aminonaphthalene, 2-aminonaphthalene, 3-aminobiphenyl, 4-aminobiphenyl, cyanhydric acid and cadmium or a combination of one or more thereof or a combination thereof.

In one embodiment, the levels of one or more HPHCs other than nicotine are reduced to levels in the user that are comparable with smoking abstinence.

In one embodiment, the levels of carbon monoxide, benzene, acrolein and 1,3-butadiene in the user are lower than the levels generated from combusted tobacco.

In one embodiment, the carboxyhemoglobin (carbon monoxide marker) level in the user is about 1.5% in blood after 1 day of consuming aerosol generated from electrically heated tobacco; and/or the S-PMA (benzene marker) level in the user is to about 0.5 micro·g/g creatinine in urine after 2 days of consuming aerosol generated from electrically heated tobacco; and/or the 3-HPMA (acrolein marker) level in the user is about 300 micro·g/g creatinine in urine after 2 days of consuming aerosol generated from electrically heated tobacco; and/or the MHBMA (1,3-butadiene marker) level in the user is about 0.5 micro·g/g creatinine in urine after 2 days of consuming aerosol generated from electrically heated tobacco.

In one embodiment, the carboxyhemoglobin (carbon monoxide marker) level in the user is about 1.5% in blood after 1 day of consuming aerosol generated from electrically heated tobacco; and the S-PMA (benzene marker) level in the user is to about 0.5 micro·g/g creatinine in urine after 2 days of consuming aerosol generated from electrically heated tobacco; and the 3-HPMA (acrolein marker) level in the user is about 300 micro·g/g creatinine in urine after 2 days of consuming aerosol generated from electrically heated tobacco; and the MHBMA (1,3-butadiene marker) level in the user is about 0.5 micro·g/g creatinine in urine after 2 days of consuming aerosol generated from electrically heated tobacco.

Suitably, the carboxyhemoglobin (carbon monoxide marker) level in the user is between about 1-2%, suitably about 1.5% in blood after 1 day of consuming aerosol generated from electrically heated tobacco; and/or the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco.

In one embodiment, the level of one or more metabolic enzymes is reduced in the user following inhalation of the aerosol generated from electrically heated tobacco as compared to the level in a user following inhalation of an aerosol generated from combusted tobacco, suitably, wherein the level is reduced to levels that are comparable with smoking abstinence.

In one embodiment, the profile of nicotine delivery via inhalation of the aerosol generated by electrically heated tobacco is substantially the same as that obtained via inhalation of an aerosol generated from combusted tobacco.

In one embodiment, the concentration of nicotine in the blood plasma increases to a maximum concentration within about 9 minutes of inhaling the aerosol from electrically heated tobacco.

In one embodiment, the maximum concentration of nicotine that is delivered to the blood plasma of the user from inhaling the aerosol from electrically heated tobacco is between about 6 and 8 ng/ml of nicotine in plasma.

In one embodiment, the $t_{max}$ is between about 6 and 10 minutes or between about 7 and 9 minutes—such as about 8 minutes.

In one embodiment, mean $AUC_{0-\infty}$ is between about 17 and 21 ng·h/mL, suitably between about 18 and 20 ng·h/mL, suitably, about 19 ng·h/mL, suitably, about 19.083 ng·h/mL.

In one embodiment, mean and $AUC_{0-\infty}$ is between about 0.4 and 0.7 ng·h/mL, suitably between about 0.5 ng·h/mL and about 0.6 ng·h/mL, suitably about 0.5262 ng·h/mL.

In one embodiment, the heating element that electrically heats the tobacco is inserted into the tobacco and wherein a continuous supply of energy is supplied to the heating element, said continuous supply of energy being monitored during use of the device.

In one embodiment, the concentration of nicotine that is delivered to the bloodstream of user is greater than about 60% of the concentration of nicotine delivered to the bloodstream of user via combustion of tobacco.

In one embodiment, the electrical heating of the tobacco is controlled electronically over a period of time.

In one embodiment, the aerosol generating device includes a temperature control sensor to avoid overheating the tobacco.

In one embodiment, the tobacco is homogenised tobacco material.

In one embodiment, the aerosol-forming substrate comprises a gathered sheet of homogenised tobacco material.

In one embodiment, the sheet is crimped.

In another aspect, there is provided a method of inhaling an aerosol comprising nicotine through an aerosol generating device comprising the steps of: (a) providing an aerosol-generating device in which tobacco contained in the aerosol-generating device is electrically heated to a temperature of less than about 400 degrees Celsius to create an aerosol; and (b) allowing the user to inhale the aerosol derived from the electrically heated tobacco; wherein (i) the nicotine concentration in the user is between about 6 and 8 ng/ml in plasma after about 9 minutes after inhalation; (ii) the carboxyhemoglobin (carbon monoxide marker) level in the user is between about 1%-2% in blood after about 2 days of consuming aerosol generated from the electrically heated tobacco; and/or (iii) the S-PMA (benzene marker) level in the user is to between about 0.1 to 1 micro·g/g creatinine in urine after about 2 days of consuming aerosol generated from electrically heated tobacco; and/or (iv) the 3-HPMA (acrolein marker) level in the user is between about 200 to 400 micro·g/g creatinine in urine after about 2 days of consuming aerosol generated from electrically heated tobacco; and/or (v) the MHBMA (1,3-butadiene marker) level in the user is between about 0.1 to 1 micro·g/g creatinine in urine after about 2 days of consuming aerosol generated from electrically heated tobacco.

In another aspect, there is provided a method of inhaling an aerosol comprising nicotine through an aerosol generating device comprising the steps of: (a) providing an aerosol-generating device in which tobacco contained in the aerosol-generating device is electrically heated to a temperature of less than about 400 degrees Celsius to create an aerosol; and (b) allowing the user to inhale the aerosol derived from the electrically heated tobacco; wherein (i) the nicotine concentration in the user is between about 6 and 8 ng/ml in plasma after about 9 minutes after inhalation; (ii) carboxyhemoglobin (carbon monoxide marker) level in the user is between about 1%-2% in blood after about 2 days of consuming aerosol generated from the electrically heated tobacco; and (iii) the S-PMA (benzene marker) level in the user is to between about 0.1 to 1 micro·g/g creatinine in urine after about 2 days of consuming aerosol generated from electrically heated tobacco; and (iv) the 3-HPMA (acrolein marker) level in the user is between about 200 to 400 micro·g/g creatinine in urine after about 2 days of consuming aerosol generated from electrically heated tobacco; and (v) the MHBMA (1,3-butadiene marker) level in the user is between about 0.1 to 1 micro·g/g creatinine in urine after about 2 days of consuming aerosol generated from electrically heated tobacco.

In another aspect, there is provided a method of reducing the absorption of one or more HPHCs other than nicotine in a user inhaling aerosol generated from tobacco comprising the steps of: (a) providing a tobacco product to a user; (b) electrically heating said tobacco product to a temperature of less than about 400 degrees Celsius; (c) allowing the aerosol derived from the electrically heated tobacco to be inhaled by the user and absorbed into the bloodstream of the user; and (d) optionally measuring the levels of nicotine and/or one or more other HPHCs in said user; wherein the aerosol contains levels of nicotine that are about the same as the levels in combusted tobacco; and wherein the level of one or more HPHCs other than nicotine in the aerosol is lower than the level in combusted tobacco.

In another aspect, there is provided a method of smoking via inhalation of an aerosol comprising nicotine through an aerosol generating device comprising the steps of: (a) providing an aerosol-generating device in which tobacco contained in the aerosol-generating device is electrically heated to a temperature of less than about 400 degrees Celsius to create an aerosol; and (b) allowing the user to inhale the aerosol derived from the electrically heated tobacco; wherein (i) the nicotine concentration in the user is between about 6 and 8 ng/ml in plasma after about 9 minutes after inhalation; (ii) the carboxyhemoglobin (carbon monoxide marker) level in the user is between about 1-2%, suitably about 1.5% in blood after 1 day of consuming aerosol generated from electrically heated tobacco; and/or (iii) the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or (iv) the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or (v) the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco.

In another aspect, there is provided a method of inhaling an aerosol comprising nicotine through an aerosol generating device comprising the steps of: (a) providing an aerosol-generating device in which tobacco contained in the aerosol-generating device is electrically heated to a temperature of less than about 400 degrees Celsius to create an aerosol; and (b) allowing the user to inhale the aerosol derived from the electrically heated tobacco; wherein (i) the nicotine concentration in the user is between about 6 and 8 ng/ml in plasma after about 9 minutes after inhalation; (ii) the carboxyhemoglobin (carbon monoxide marker) level in the user is between about 1-2%, suitably about 1.5% in blood after 1 day of consuming aerosol generated from electrically heated tobacco; and/or (iii) the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or (iv) the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or (v) the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco.

In another aspect, there is provided the use of an aerosol-generating device for delivering nicotine in an aerosol to a user, wherein the aerosol is generated by electrically heating tobacco to a temperature of less than about 400 degrees Celsius; wherein the aerosol contains levels of nicotine that are about the same as the levels in combusted tobacco; and wherein the level of one or more HPHCs other than nicotine in the aerosol is lower than the level in combusted tobacco.

In another aspect, there is provided the use of an aerosol-generating device for delivering nicotine in an aerosol to a user, wherein the aerosol is generated by electrically heating tobacco to a temperature of less than about 400 degrees Celsius; wherein (i) the nicotine concentration in the user is between about 6 and 8 ng/ml in plasma about 9 minutes after inhalation; and (ii) carboxyhemoglobin (carbon monoxide marker) level in the user is between about 1%-2% in blood after about 2 days of consuming aerosol generated from the electrically heated tobacco; and/or (iii) the S-PMA (benzene marker) level in the user is to between about 0.1 to 1 micro·g/g creatinine in urine after about 2 days of consuming aerosol generated from electrically heated tobacco; and/or (iv) the 3-HPMA (acrolein marker) level in the user is between about 200 to 400 micro·g/g creatinine in urine after about 2 days of consuming aerosol generated from electrically heated tobacco; and/or (v) the MHBMA (1,3-butadiene marker) level in the user is between about 0.1 to 1 micro·g/g creatinine in urine after about 2 days of consuming aerosol generated from electrically heated tobacco.

In another aspect, there is provided the use of an aerosol-generating device for delivering nicotine in an aerosol to a user, wherein the aerosol is generated by electrically heating tobacco to a temperature of less than about 400 degrees Celsius; wherein (i) the nicotine concentration in the user is between about 6 and 8 ng/ml in plasma about 9 minutes after inhalation; and (ii) carboxyhemoglobin (carbon monoxide marker) level in the user is between about 1%-2% in blood after about 2 days of consuming aerosol generated from the electrically heated tobacco; and (iii) the S-PMA (benzene marker) level in the user is to between about 0.1 to 1 micro·g/g creatinine in urine after about 2 days of consuming aerosol generated from electrically heated tobacco; and (iv) the 3-HPMA (acrolein marker) level in the user is between about 200 to 400 micro·g/g creatinine in urine after about 2 days of consuming aerosol generated from electrically heated tobacco; and (v) the MHBMA (1,3-butadiene marker) level in the user is between about 0.1 to 1 micro·g/g creatinine in urine after about 2 days of consuming aerosol generated from electrically heated tobacco.

In another aspect, there is provided a method of delivering nicotine to a user, wherein the nicotine delivery profile is substantially the same as combusted tobacco and wherein the levels of one or more HPHCs other than nicotine in the bloodstream of the user are lower than the levels from combusted tobacco comprising the use of an aerosol-generating device in which tobacco contained in the aerosol-generating device is electrically heated to a temperature of less than about 400 degrees Celsius by a heating element of the aerosol-generating device.

In another aspect, there is provided an aerosol generated by electrically heating tobacco to a temperature of less than about 400 degrees Celsius, wherein said aerosol comprises: (i) levels of nicotine are about the same as the levels in combusted tobacco; and (ii) levels of one or more HPHCs other than nicotine that are lower than the level in combusted tobacco.

In one embodiment, the HPHC other than nicotine is selected from the group consisting of: nicotine-free dry particulate matter (NFDPM), carbon monoxide, formaldehyde, acetaldehyde, acetone, acrolein, propionaldehyde, crotonaldehyde, methyl-ethyl ketone, butyraldehyde, benzo [a]pyrene, phenol, m-cresol, o-cresol, p-cresol, catechol, resorcinol, hydroquinone, 1,3-butadiene, isoprene, acrylonitrile, benzene, toluene, pyridine, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia, arsenic, cadmium, chrome, lead, nickel, selenium and mercury or a combination of one or more thereof or a combination thereof.

In one embodiment, one or more HPHCs other than nicotine are not detectable or are not appreciably detectable in the aerosol generated by the electrically heated tobacco, said HPHCs being selected from the group consisting of: m-cresol, p-cresol, 1,3 butadiene, isoprene, acrylonitrile, benzene, 1-aminonaphthalene, 2-aminonaphthalene, 3-aminobiphenyl, 4-aminobiphenyl, cyanhydric acid and cadmium or a combination of one or more thereof or a combination thereof.

In another aspect, there is provided a method of producing an aerosol as described herein, comprising the steps of: (i) electrically heating tobacco to a temperature of less than about 400 degrees Celsius; (ii) allowing the electrically heated tobacco to produce an aerosol; and (iii) optionally, isolating or collecting the aerosol.

In another aspect, there is provided an aerosol generated by electrically heating tobacco to a temperature of less than about 400 degrees Celsius, wherein said aerosol comprises: (i) levels of nicotine are about the same as the levels in combusted tobacco; and (ii) wherein 4 aminobiphenyl, 2-aminonaphthalene and 1-aminonaphthalene are present in the aerosol at up to or less than about 0.1 ng/mg nicotine; wherein carbon monooxide, 1,3-butadiene, benzene, benzo [a]prene and acrylonitrile are present in the aerosol at between about 0.4 and 0.11 ng/mg nicotine; wherein isoprene, toluene, formaldehyde and crotonaldehyde are present in the aerosol at between about 1.5 and 3 ng/mg nicotine; wherein N-nitrosonornicotine and NNK are present in the aerosol at between about 3.1 and 5 ng/mg nicotine; wherein acrolein is present in the aerosol at between about 4 and 7 ng/mg nicotine; wherein ammonia is present in the aerosol at between about 9 and 11 ng/mg nicotine; and wherein acetaldehyde is present in the aerosol at between about 100 and 160 ng/mg nicotine.

In another aspect, there is provided an aerosol generated by electrically heating tobacco to a temperature of less than about 400 degrees Celsius, wherein 4 aminobiphenyl, 2-aminonaphthalene and 1-aminonaphthalene are present in the aerosol at up to or less than about 0.1 ng/mg nicotine; wherein carbon monooxide, 1,3-butadiene, benzene, benzo [a]prene and acrylonitrile are present in the aerosol at between about 0.4 and 0.11 ng/mg nicotine; wherein isoprene, toluene, formaldehyde and crotonaldehyde are present in the aerosol at between about 1.5 and 3 ng/mg nicotine; wherein N-nitrosonornicotine and NNK are present in the aerosol at between about 3.1 and 5 ng/mg nicotine; wherein acrolein is present in the aerosol at between about 4 and 7 ng/mg nicotine; wherein ammonia is present in the aerosol at between about 9 and 11 ng/mg nicotine; and wherein acetaldehyde is present in the aerosol at between about 100 and 160 ng/mg nicotine.

In another aspect, there is provided an aerosol-generating device comprising: (i) a heating element that heats tobacco to create an aerosol; and (ii) tobacco that is heated by the heating element the improvement comprising that the heating element electrically heats the tobacco to a temperature of less than about 400 degrees Celsius and the aerosol generated by the aerosol-generating device contains levels of nicotine that are about the same as the levels in combusted tobacco and the level of one or more HPHCs other than nicotine in the aerosol is lower than the level in combusted tobacco.

In another aspect, there is provided an aerosol-generating device comprising a heating element that heats, for example, electrically heats, tobacco to a temperature of between about 300 and 374 degrees Celsius.

In one embodiment, the aerosol-generating device is for use with an electric heating element, the aerosol-generating device comprising: (i) tobacco; (ii) a support element located immediately downstream of the aerosol-forming substrate; (iii) an aerosol-cooling element located downstream of the support element; and (iv) an outer wrapper circumscribing the aerosol-forming substrate, the support element and the aerosol-cooling element, wherein the support element abuts the aerosol-forming substrate.

In another aspect, there is provided a method of determining if a user uses an aerosol-generating device in which tobacco contained therein is electrically heated to a temperature of less than about 400 degrees Celsius to create an aerosol, said method comprising the steps of: (a) providing a sample from the user; and (b) determining the levels of one or more of at least carbon monoxide, benzene, acrolein and 1,3-butadiene therein, either directly or via biomarker(s); wherein (i) if the carboxyhemoglobin (carbon monoxide marker) level in the sample is between about 1%-2% in blood after about 2 days of consuming aerosol generated from electrically heated tobacco; and/or (ii) the S-PMA (benzene marker) level in the user is to between about 0.1 to 1 micro·g/g creatinine in urine after about 2 days of consuming aerosol generated from electrically heated tobacco; and/or (iii) the 3-HPMA (acrolein marker) level in the user is about 200 to 400 micro·g/g creatinine in urine after about 2 days of consuming aerosol generated from electrically heated tobacco; and/or (iv) the MHBMA (1,3-butadiene marker) level in the user is between about 0.1 to 1 micro·g/g creatinine in urine after about 2 days of consuming aerosol generated from electrically heated tobacco is indicative that said user uses the aerosol-generating device.

In another aspect, there is provided a sample isolated from a user 2 days after using an aerosol-generating device in which tobacco contained therein is electrically heated to a temperature of less than about 400 degrees Celsius to create an aerosol, wherein (i) the carboxyhemoglobin (carbon monoxide marker) level in the sample is between about 1%-2%; and/or (ii) the S-PMA (benzene marker) level in the user is to between about 0.1 to 1 micro·g/g creatinine; and/or (iii) the 3-HPMA (acrolein marker) level in the user is about 200 to 400 micro·g/g creatinine; and/or (iv) the MHBMA (1,3-butadiene marker) level in the user is between about 0.1 to 1 micro·g/g creatinine.

In another aspect, there is provided a sample isolated from a user 2 days after using an aerosol-generating device in which tobacco contained therein is electrically heated to a temperature of less than about 400 degrees Celsius to create an aerosol, wherein (i) the carboxyhemoglobin (carbon monoxide marker) level in the sample is between about 1%-2%; and (ii) the S-PMA (benzene marker) level in the user is to between about 0.1 to 1 micro·g/g creatinine; and (iii) the 3-HPMA (acrolein marker) level in the user is about 200 to 400 micro·g/g creatinine; and (iv) the MHBMA (1,3-butadiene marker) level in the user is between about 0.1 to 1 micro·g/g creatinine.

In one embodiment, the levels of carbon monoxide, benzene, acrolein and 1,3-butadiene are determined.

In another aspect, there is provided a method of monitoring a user consuming nicotine via inhalation of an aerosol comprising nicotine through an aerosol generating device that electrically heats tobacco to a temperature of less than about 400 degrees Celsius, comprising the steps of: (a) providing the user with the aerosol generating device that electrically heats tobacco to a temperature of less than about 400 degrees Celsius; (b) allowing the user to inhale the aerosol comprising nicotine through the aerosol generating device; (c) providing or obtaining one or more samples from the user, which may be the same or different types of sample and which may optionally be a plurality of samples taken at time intervals during consumption by the user; (d) measuring the levels of two or more of at least nicotine, carbon monoxide, acrolein or benzene therein, either directly or in a biomarker thereof; and (e) comparing the levels measured in step (b) with the following levels or equivalent levels if different types of samples are used: (i) a carboxyhemoglobin (carbon monoxide marker) level in the sample of between about 1%-2% in blood; and/or (ii) a S-PMA (benzene marker) level in the user of between about 0.1 to 1 micro·g/g creatinine; and/or (iii) a 3-HPMA (acrolein marker) level in the user of about 200 to 400 micro·g/g creatinine; and/or (iv) a MHBMA (1,3-butadiene marker) level in the user is between about 0.1 to 1 micro·g/g creatinine after; wherein correlation between the samples and the levels in step (e) is indicative that the user is exposed to levels of one or more harmful or potentially harmful constituents (HPHCs) other than nicotine that are lower than the levels in combusted tobacco.

In another aspect, there is provided a method of monitoring a user consuming nicotine via inhalation of an aerosol comprising nicotine through an aerosol generating device that electrically heats tobacco to a temperature of less than about 400 degrees Celsius, comprising the steps of: (a) providing the user with the aerosol generating device that electrically heats tobacco to a temperature of less than about 400 degrees Celsius; (b) allowing the user to inhale the aerosol comprising nicotine through the aerosol generating device; (c) providing or obtaining one or more samples from the user, which may be the same or different types of sample and which may optionally be a plurality of samples taken at time intervals during consumption by the user; (d) measuring the levels of two or more of at least nicotine, carbon monoxide, acrolein or benzene therein, either directly or in a biomarker thereof; and (e) comparing the levels measured in step (b) with the following levels or equivalent levels if different types of samples are used: (i) carboxyhemoglobin (carbon monoxide marker) level in the sample of between about 1%-2% in blood; and (ii) a S-PMA (benzene marker) level in the user of between about 0.1 to 1 micro·g/g creatinine; and (iii) a 3-HPMA (acrolein marker) level in the user of about 200 to 400 micro·g/g creatinine; and (iv) a MHBMA (1,3-butadiene marker) level in the user is between about 0.1 to 1 micro·g/g creatinine after; wherein correlation between the samples and the levels in step (c) is indicative that the user is responding favourably to the consumption of nicotine through the device.

In another aspect, there is provided a method of measuring a user's response to the inhalation of nicotine comprising the steps of: (a) providing the user with an aerosol generating device that electrically heats tobacco to a temperature of less than about 400 degrees Celsius; (b) allowing the user to inhale the aerosol comprising nicotine created by the aerosol generating device; (c) providing or obtaining one or more samples from the user, which may be the same or different types of sample and which may optionally be a plurality of samples taken at time intervals during inhalation by the user; (d) measuring the levels of two or more of at least nicotine, carbon monoxide, acrolein or benzene therein, either directly or in a biomarker thereof; and (e) comparing the levels measured in step (b) with the following levels or equivalent levels if different types of samples are used: (i) a carboxyhemoglobin (carbon monoxide marker) level in the sample of between about 1%-2% in blood; and/or (ii) a S-PMA (benzene marker) level in the user of between about 0.1 to 1 micro·g/g creatinine; and/or (iii) a 3-HPMA (acrolein marker) level in the user of about 200 to 400 micro·g/g creatinine; and/or (iv) a MHBMA (1,3-butadiene marker) level in the user is between about 0.1 to 1 micro·g/g creatinine.

In another aspect, there is provided a method of measuring a user's response to the inhalation of nicotine comprising the steps of: (a) providing the user with an aerosol generating device that electrically heats tobacco to a temperature of less than about 400 degrees Celsius; (b) allowing the user to inhale the aerosol comprising nicotine created by the aerosol generating device; (c) providing or obtaining one or more samples from the user, which may be the same or different types of sample and which may optionally be a plurality of samples taken at time intervals during inhalation by the user; (d) measuring the levels of two or more of at least nicotine, carbon monoxide, acrolein or benzene therein, either directly or in a biomarker thereof; and (e) comparing the levels measured in step (b) with the following levels or equivalent levels if different types of samples are used: (i) a carboxyhemoglobin (carbon monoxide marker) level in the sample of between about 1%-2% in blood; and (ii) a S-PMA (benzene marker) level in the user of between about 0.1 to 1 micro·g/g creatinine; and (iii) a 3-HPMA (acrolein marker) level in the user of about 200 to 400 micro·g/g creatinine; and (iv) a MHBMA (1,3-butadiene marker) level in the user is between about 0.1 to 1 micro·g/g creatinine.

In one embodiment, the levels of at least carbon monoxide, benzene, acrolein and 1,3-butadiene are measured.

In another aspect, there is provided a method, a use, an aerosol, or an aerosol-generating device substantially as described herein with reference to the accompanying drawings.

The following embodiments may be embodiments of any of the aspects of mentioned above, either alone or in combination.

In another embodiment, the level of one or more HPHCs (other than nicotine) is reduced to levels that are comparable with smoking abstinence.

In another embodiment, the HPHC other than nicotine in the aerosol generated by the electrically heated tobacco is selected from the group consisting of: nicotine-free dry particulate matter (NFDPM), carbon monoxide, formaldehyde, acetaldehyde, acetone, acrolein, propionaldehyde, crotonaldehyde, methyl-ethyl ketone, butyraldehyde, benzo[a]pyrene, phenol, m-cresol, o-cresol, p-cresol, catechol, resorcinol, hydroquinone, 1,3-butadiene, isoprene, acrylonitrile, benzene, toluene, pyridine, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia, arsenic, cadmium, chrome, lead, nickel, selenium and mercury or a combination of one or more thereof or a combination thereof.

In another embodiment, one or more HPHCs other than nicotine are not detectable or are not appreciably detectable in the aerosol generated by the electrically heated tobacco, said HPHCs being selected from the group consisting of: m-cresol, p-cresol, 1,3 butadiene, isoprene, acrylonitrile, benzene, 1-aminonaphthalene, 2-aminonaphthalene, 3-aminobiphenyl, 4-aminobiphenyl, cyanhydric acid and cadmium or a combination of one or more thereof or a combination thereof.

In another embodiment, the levels of one or more HPHCs other than nicotine are reduced to levels in the user that are comparable with smoking abstinence.

In another embodiment, the levels of carbon monoxide, benzene, acrolein and 1,3-butadiene in the user are lower than the levels generated from combusted tobacco.

In another embodiment, the carboxyhemoglobin (carbon monoxide marker) level in the user is about 1.5% in blood after 1 day of consuming aerosol generated from electrically heated tobacco; and/or the S-PMA (benzene marker) level in the user is to about 0.5 micro·g/g creatinine in urine after 2 days of consuming aerosol generated from electrically heated tobacco; and/or the 3-HPMA (acrolein marker) level in the user is about 300 micro·g/g creatinine in urine after 2 days of consuming aerosol generated from electrically heated tobacco; and/or the MHBMA (1,3-butadiene marker) level in the user is about 0.5 micro·g/g creatinine in urine after 2 days of consuming aerosol generated from electrically heated tobacco.

In another embodiment, the carboxyhemoglobin (carbon monoxide marker) level in the user is about 1.5% in blood after 1 day of consuming aerosol generated from electrically heated tobacco; and the S-PMA (benzene marker) level in the user is to about 0.5 micro·g/g creatinine in urine after 2 days of consuming aerosol generated from electrically heated tobacco; and the 3-HPMA (acrolein marker) level in the user is about 300 micro·g/g creatinine in urine after 2 days of consuming aerosol generated from electrically heated tobacco; and the MHBMA (1,3-butadiene marker) level in the user is about 0.5 micro·g/g creatinine in urine after 2 days of consuming aerosol generated from electrically heated tobacco.

In another embodiment, the level of one or more metabolic enzymes is reduced in the user following inhalation of the aerosol generated from electrically heated tobacco as compared to the level in a user following inhalation of an aerosol generated from combusted tobacco, suitably, wherein the level is reduced to levels that are comparable with smoking abstinence.

In another embodiment, the profile of nicotine delivery via inhalation of the aerosol generated by electrically heated tobacco is substantially the same as that obtained via inhalation of an aerosol generated from combusted tobacco.

In another embodiment, the concentration of nicotine in the blood plasma increases to a maximum concentration within about 9 minutes of inhaling the aerosol from electrically heated tobacco.

In another embodiment, the maximum concentration of nicotine that is delivered to the blood plasma of the user from inhaling the aerosol from electrically heated tobacco is between about 6 and 8 ng/ml of nicotine in plasma.

In another embodiment, the concentration of nicotine that is delivered to the bloodstream of user is greater than about 60% of the concentration of nicotine delivered to the bloodstream of user via combustion of tobacco.

In another embodiment, the electrical heating of the tobacco is controlled electronically over a period of time.

In another embodiment, the aerosol generating device includes a temperature control sensor to avoid overheating the tobacco.

In another embodiment, the tobacco is homogenised tobacco material.

In another embodiment, the aerosol-forming substrate comprises a gathered sheet of homogenised tobacco material.

In another embodiment, the sheet is crimped.

In another embodiment, the HPHC other than nicotine is selected from the group consisting of: nicotine-free dry particulate matter (NFDPM), carbon monoxide, formaldehyde, acetaldehyde, acetone, acrolein, propionaldehyde, crotonaldehyde, methyl-ethyl ketone, butyraldehyde, benzo [a]pyrene, phenol, m-cresol, o-cresol, p-cresol, catechol, resorcinol, hydroquinone, 1,3-butadiene, isoprene, acrylonitrile, benzene, toluene, pyridine, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia, arsenic, cadmium, chrome, lead, nickel, selenium and mercury or a combination of one or more thereof or a combination thereof.

In another embodiment, one or more HPHCs other than nicotine are not detectable or are not appreciably detectable in the aerosol generated by the electrically heated tobacco, said HPHCs being selected from the group consisting of: m-cresol, p-cresol, 1,3 butadiene, isoprene, acrylonitrile, benzene, 1-aminonaphthalene, 2-aminonaphthalene, 3-aminobiphenyl, 4-aminobiphenyl, cyanhydric acid and cadmium or a combination of one or more thereof or a combination thereof.

In another embodiment, the aerosol-generating device is for use with an electric heating element, the aerosol-generating device comprising: (i) tobacco; (ii) a support element located immediately downstream of the aerosol-forming substrate; (iii) an aerosol-cooling element located downstream of the support element; and (iv) an outer wrapper circumscribing the aerosol-forming substrate, the support element and the aerosol-cooling element, wherein the support element abuts the aerosol-forming substrate.

In another embodiment, the levels of carbon monoxide, benzene, acrolein and 1,3-butadiene are determined.

DEFINITIONS

Figure 1:
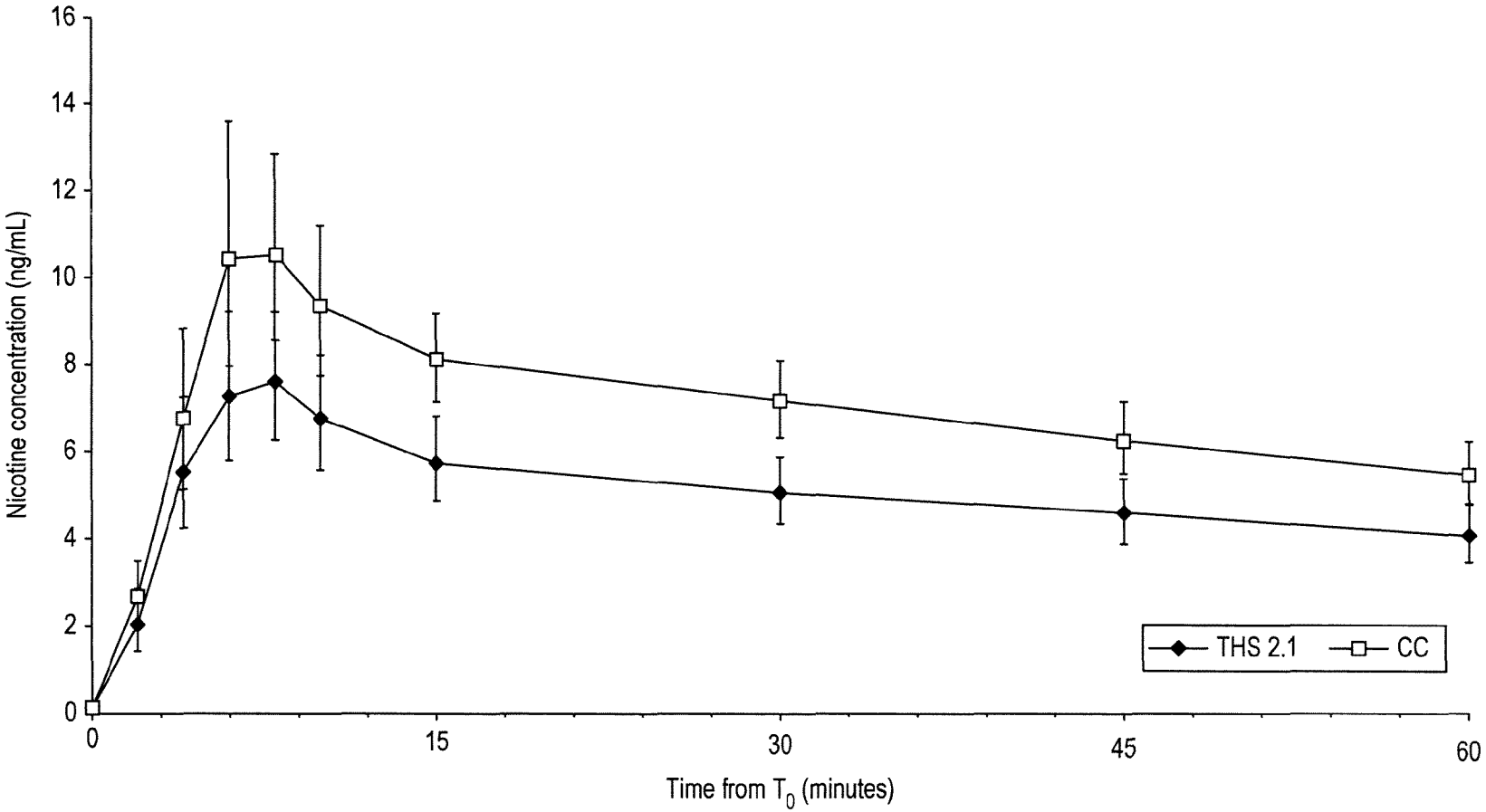
FIG. 1 is a delivery profile of nicotine in the bloodstream of a human test user using a conventional cigarette in which tobacco is combusted (square symbols) versus heated tobacco (triangular symbols) according to the present disclosure. The time course for nicotine absorption is similar in both systems. Maximum blood concentration of nicotine delivered using the heated system of the present disclosure is 70.25% of the maximum blood concentration of nicotine achieved when using a conventional cigarette in which tobacco is combusted. Total nicotine absorption is 77.41% of the total nicotine absorption in the conventional cigarette in which tobacco is combusted.

As used herein, reference to 'conventional cigarettes' means cigarettes in which tobacco is burnt or combusted. Typically temperatures of greater than 750 degrees Celsius will be reached during the burn in which the processes involved include combustion and/or pyrolysis. Tobacco is combusted in conventional cigarette smoking. In one embodiment, the conventional cigarette can be reference cigarette—such as reference cigarette 3R4F and 2R4F (see, for example, Beiträge zur Tabakforschung International/ *Contributions to Tobacco Research* Volume 25, No. 1, February 2012).

As used herein, 'a smoker' can be a female or a male, otherwise healthy human who has a smoking history, for example of at least three years of consecutive smoking and a minimum of 10 non-mentholated conventional cigarettes per day with a maximum yield of 1 mg nicotine. Smoking status can be verified with a urinary cotinine test (cotinine ≥200 ng/ml). Randomisation quotas can be used to ensure that each gender and smoking stratum represent at least 40% of the study population.

The term 'aerosol-forming substrate' is used to describe a substrate capable of releasing upon heating volatile compounds, which can form an aerosol. The aerosol generated from aerosol-forming substrates of aerosol-generating articles described herein may be visible or invisible and may include vapours (for example, fine particles of substances, which are in a gaseous state, that are ordinarily liquid or solid at room temperature) as well as gases and liquid droplets of condensed vapours.

The terms 'upstream' and 'downstream' are used to describe the relative positions of elements, or portions of elements, of the aerosol-generating article in relation to the direction in which a user draws on the aerosol-generating article during use thereof.

The term 'aerosol-cooling element' is used to describe an element having a large surface area and a low resistance to draw. In use, an aerosol formed by volatile compounds released from the aerosol-forming substrate passes over and is cooled by the aerosol-cooling element before being inhaled by a user. In contrast to high resistance to draw filters and other mouthpieces, aerosol-cooling elements have a low resistance to draw. Chambers and cavities within an aerosol-generating article are also not considered to be aerosol cooling elements.

The term 'aerosol-generating device' is used to describe a device that interacts with an aerosol-forming substrate of an aerosol-generating article to generate an aerosol. Suitably, the aerosol generated by an aerosol-generating article to generate an aerosol that is directly inhalable into a user's lungs thorough the user's nose or mouth. The aerosol-generating device may be a holder for a smoking article.

As used herein to describe an aerosol-generating article, the term 'longitudinal' refers to describe the direction between the downstream end and the upstream end of the aerosol-generating article and the term 'transverse' is used to describe the direction perpendicular to the longitudinal direction.

As used herein to describe an aerosol-generating article, the term 'diameter' refers to describe the maximum dimension in the transverse direction of the aerosol-generating article. As used herein, the term 'length' is used to describe the maximum dimension in the longitudinal direction of the aerosol-generating article.

The term 'homogenised tobacco material' denotes a material formed by agglomerating particulate tobacco.

The term 'sheet' denotes a laminar element having a width and length substantially greater than the thickness thereof.

The term 'gathered' is used to describe a sheet that is convoluted, folded, or otherwise compressed or constricted substantially transversely to the longitudinal axis of the aerosol-generating article.

The term 'textured sheet' denotes a sheet that has been crimped, embossed, debossed, perforated or otherwise deformed. The aerosol-forming substrate may comprise a gathered textured sheet of homogenised tobacco material comprising a plurality of spaced-apart indentations, protrusions, perforations or a combination thereof.

The term 'crimped sheet' denotes a sheet having a plurality of substantially parallel ridges or corrugations. Suitably, when the aerosol-generating article has been assembled, the substantially parallel ridges or corrugations extend along or parallel to the longitudinal axis of the aerosol-generating article. This advantageously facilitates gathering of the crimped sheet of homogenised tobacco material to form the aerosol-forming substrate. However, it will be appreciated that crimped sheets of homogenised tobacco material for inclusion in the aerosol-generating article may alternatively or in addition have a plurality of substantially parallel ridges or corrugations that are disposed at an acute or obtuse angle to the longitudinal axis of the aerosol-generating article when the aerosol-generating article has been assembled.

The term "substantially cylindrical" is to be understood to include the shape of a cylinder or a tapered cylinder of circular or substantially circular cross-section, or which have the shape of a cylinder or a tapered cylinder of elliptical or substantially elliptical cross-section. In a preferred embodiment, a substantially cylindrical object has the shape of a cylinder having a circular cross-section.

The term 'aerosol former' is used to describe any suitable known compound or mixture of compounds that, in use, facilitates formation of an aerosol and that is substantially resistant to thermal degradation at the operating temperature of the aerosol-generating article.

The term 'penetration force' is used to describe the maximum insertion force during insertion of the heating element into the aerosol-forming substrate of the aerosol-generating article and prior to the aerosol-generating article reaching a position of maximum insertion.

The term 'crush force' is used to describe the maximum insertion force after the aerosol-generating article reaches a point of maximum insertion.

The term 'volatile flavour component' is used to describe any volatile component that is added to an aerosol-generating article in order to provide a flavour.

The term 'menthol' is used to describe the compound 2-isopropyl-5-methylcyclohexanol in any of its isomeric forms.

As used herein, resistance to draw is expressed with the units of pressure 'mm WG' or 'mm of water gauge' and is measured in accordance with ISO 6565:2002.

DETAILED DESCRIPTION

The present inventors have found that smokers who switch from conventional cigarette smoking in which tobacco is combusted to aerosol-generating devices in which tobacco is heated (for example, electrically heated) to a temperature of less than about 400 degrees Celsius can (significantly) reduce their exposure to one or more HPHCs. Whilst reducing their exposure to one or more HPHCs, acceptable levels, amounts or concentrations of nicotine are delivered to the user (for example, absorbed into the bloodstream) via an acceptable nicotine delivery profile. One or more HPHCs may even be reduced to levels that are comparable with smoking abstinence.

Figure 5:
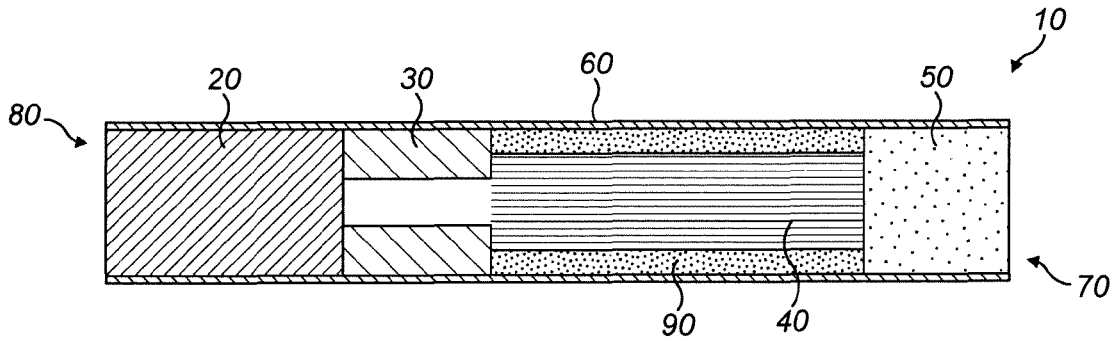
FIG. 5 is a schematic cross-sectional diagram of an aerosol-generating article for use with an aerosol generating-device comprising a heating element.
Figure 6:
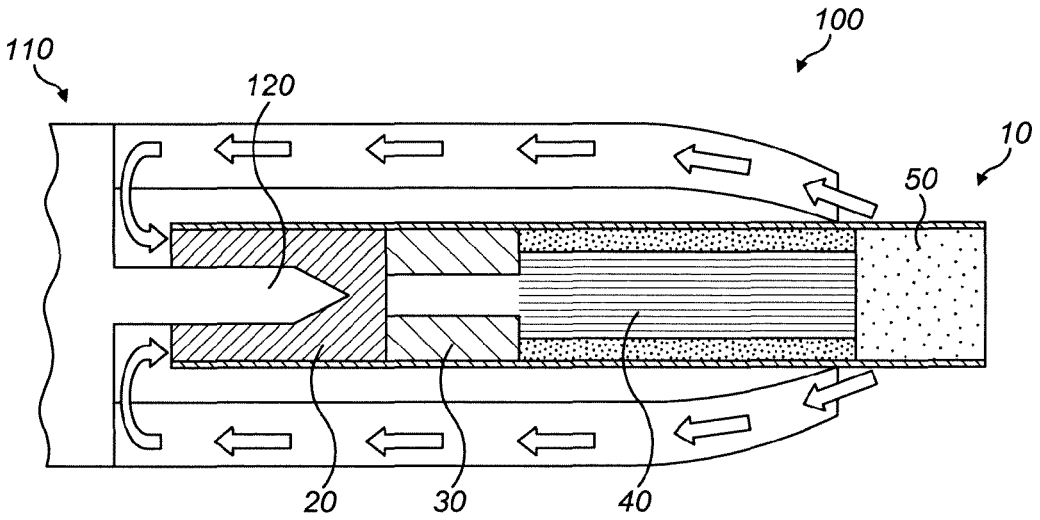
FIG. 6 is a schematic cross-sectional diagram of an aerosol-generating system comprising an electrically heated aerosol-generating device comprising a heating element and an aerosol-generating article according to the embodiment illustrated in FIG. 5.
Figure 7:
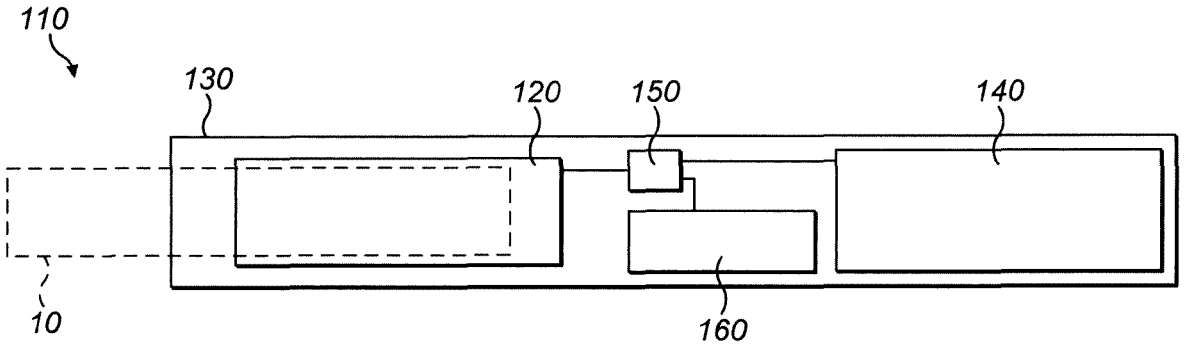
FIG. 7 is a schematic cross-sectional diagram of the electrically heated aerosol generating device illustrated in FIG. 6.

An example of an aerosol-generating article which can be used to heat tobacco in accordance with the present disclosure is shown in FIGS. 5 to 7.

FIG. 5 illustrates an aerosol-generating article 10. The aerosol-generating article 10 comprises four elements arranged in coaxial alignment: an aerosol-forming substrate 20, a support element 30, an aerosol-cooling element 40, and a mouthpiece 50. These four elements are arranged sequentially and are circumscribed by an outer wrapper 60 to form the aerosol-generating article 10. The aerosol-generating 10 has a proximal or mouth end 70, which a user inserts into his or her mouth during use, and a distal end 80 located at the opposite end of the aerosol-generating article 10 to the mouth end 70.

In use air is drawn through the aerosol-generating article by a user from the distal end 80 to the mouth end 70. The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or, alternatively, downstream of the distal end 80.

The aerosol-forming substrate 20 is located at the extreme distal or upstream end of the aerosol-generating article 10. In the embodiment illustrated in FIG. 5, aerosol-forming substrate 20 comprises a gathered sheet of crimped homogenised tobacco material circumscribed by a wrapper. The crimped sheet of homogenised tobacco material may comprise an aerosol-former—such as glycerine.

The support element 30 is located immediately downstream of the aerosol-forming substrate 20 and abuts the aerosol-forming substrate 20. In the embodiment shown in FIG. 5, the support element is a hollow cellulose acetate tube. The support element 30 locates the aerosol-forming substrate 20 at the extreme distal end 80 of the aerosol-generating article 10 so that it can be penetrated by a heating element of an aerosol-generating device. As described further below, the support element 30 acts to prevent the aerosol-forming substrate 20 from being forced downstream within the aerosol-generating article 10 towards the aerosol-cooling element 40 when a heating element of an aerosol-generating device is inserted into the aerosol-forming substrate 20. The support element 30 also acts as a spacer to space the aerosol-cooling element 40 of the aerosol-generating article 10 from the aerosol-forming substrate 20.

The aerosol-cooling element 40 is located immediately downstream of the support element 30 and abuts the support element 30. In use, volatile substances released from the aerosol-forming substrate 20 pass along the aerosol-cooling element 40 towards the mouth end 70 of the aerosol-generating article 10. The volatile substances may cool within the aerosol-cooling element 40 to form an aerosol that is inhaled by the user. In the embodiment illustrated in FIG. 5, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. As shown in FIG. 5, the mouthpiece 50 comprises a conventional cellulose acetate tow filter of low filtration efficiency.

To assemble the aerosol-generating article 10, the four elements described above are aligned and tightly wrapped within the outer wrapper 60. In the embodiment illustrated in FIG. 5, the outer wrapper is a conventional cigarette paper. As shown in FIG. 5, an optional row of perforations is provided in a region of the outer wrapper 60 circumscribing the support element 30 of the aerosol-generating article 10.

As shown in FIG. 5, a distal end portion of the outer wrapper 60 of the aerosol-generating article 10 is circumscribed by a band of tipping paper (not shown).

The aerosol-generating article 10 illustrated in FIG. 5 is designed to engage with an aerosol-generating device comprising a heating element in order to be consumed by a user. In use, the heating element of the aerosol-generating device heats the aerosol-forming substrate 20 of the aerosol-generating article 10 to a sufficient temperature to volatilize compounds that are capable of forming an aerosol, which is drawn downstream through the aerosol-generating article 10 and inhaled by the user.

FIG. 6 illustrates a portion of an aerosol-generating system 100 comprising an aerosol-generating device 110 and an aerosol-generating article 10 according to the embodiment described above and illustrated in FIG. 5.

The aerosol-generating device comprises a heating element 120. As shown in FIG. 6, the heating element 120 is mounted within an aerosol-generating article receiving chamber of the aerosol-generating device 110. In use, the user inserts the aerosol-generating article 10 into the aerosol-generating article receiving chamber of the aerosol-generating device 110 such that the heating element 120 is directly inserted into the aerosol-forming substrate 20 of the aerosol-generating article 10 as shown in FIG. 6. In the embodiment shown in FIG. 6, the heating element 120 of the aerosol-generating device 110 is a heater blade.

The aerosol-generating device 110 comprises a power supply and electronics (shown in FIG. 7) that allow the heating element 120 to be actuated. Such actuation may be manually operated or may occur automatically in response to a user drawing on an aerosol-generating article 10 inserted into the aerosol-generating article receiving chamber of the aerosol-generating device 110. A plurality of openings is provided in the aerosol-generating device to allow air to flow to the aerosol-generating article 10; the direction of air flow is illustrated by arrows in FIG. 6.

The support element 40 of the aerosol-generating article 10 resists the penetration force experienced by the aerosol-generating article 10 during insertion of the heating element 120 of the aerosol-generating device 110 into the aerosol-forming substrate 20. The support element 40 of the aerosol-generating article 10 thereby resists downstream movement of the aerosol-forming substrate within the aerosol-generating article 10 during insertion of the heating element of the aerosol-generating device into the aerosol-forming substrate.

Once the internal heating element 120 is inserted into the aerosol-forming substrate 10 of the aerosol-generating article 10 and actuated, the aerosol-forming substrate 20 of the aerosol-generating article 10 is heated to a temperature of less than about 400 degrees Celsius (or other temperature as discussed herein) by the heating element 120 of the aerosol-generating device 110. At this temperature, volatile compounds are evolved from the aerosol-forming substrate 20 of the aerosol-generating article 10. As a user draws on the mouth end 70 of the aerosol-generating article 10, the volatile compounds evolved from the aerosol-forming substrate 20 are drawn downstream through the aerosol-generating article 10 and condense to form an aerosol that is drawn through the mouthpiece 50 of the aerosol-generating article 10 into the user's mouth.

As the aerosol passes downstream thorough the aerosol-cooling element 40, the temperature of the aerosol can be reduced due to transfer of thermal energy from the aerosol to the aerosol-cooling element 40. When the aerosol enters the aerosol-cooling element 40, its temperature is approximately 60 degrees Celsius. Due to cooling within the aerosol-cooling element 40, the temperature of the aerosol as it exits the aerosol-cooling element is approximately 40 degrees Celsius.

In FIG. 7, the components of the aerosol-generating device 110 are shown in a simplified manner. Particularly, the components of the aerosol-generating device 110 are not drawn to scale in FIG. 5. Components that are not relevant for the understanding of the embodiment have been omitted to simplify FIG. 7.

As shown in FIG. 7, the aerosol-generating device 110 comprises a housing 130. The heating element 120 is mounted within an aerosol-generating article receiving chamber within the housing 130. The aerosol-generating article 10 (shown by dashed lines in FIG. 7) is inserted into the aerosol-generating article receiving chamber within the housing 130 of the aerosol-generating device 110 such that the heating element 120 is directly inserted into the aerosol-forming substrate 20 of the aerosol-generating article 10.

Within the housing 130 there is an electrical energy supply 140, for example a rechargeable lithium ion battery. A controller 150 is connected to the heating element 120, the electrical energy supply 140, and a user interface 160, for example a button or display. The controller 150 controls the power supplied to the heating element 120 in order to regulate its temperature. Additional components (for example, one or more sensors or controllers) may be included that are able to monitor and/or regulate the temperature of the heating element 120 and/or the temperature of the tobacco such that the temperature thereof is controlled within a defined temperature range. Suitably, the additional components (for example, the one or more sensors or controllers) may be included that are able to monitor and/or regulate the temperature of the heating element 120 and/or the temperature of the tobacco. Although the support element of the aerosol-generating article according to the embodiment described above and illustrated in FIG. 5 is formed from cellulose acetate, it will be appreciated that this is not essential and that aerosol-generating articles according to other embodiments may comprise support elements formed from other suitable materials or combination of materials.

Similarly, although the aerosol-generating article illustrated in FIG. 5 comprises an aerosol-cooling element comprising a crimped and gathered sheet of polylactic acid, it will be appreciated that this is not essential and that aerosol-generating articles may comprise other aerosol-cooling elements.

Furthermore, although the aerosol-generating article illustrated in FIG. 5 has four elements circumscribed by an outer wrapper, it will be appreciated than this is not essential and that aerosol-generating articles may comprise additional elements or fewer elements.

It will also be appreciated that while the four elements of the aerosol-generating article illustrated in FIG. 5 are circumscribed by an outer wrapper of conventional cigarette paper, this is not essential and that the elements of aerosol-generating articles may be circumscribed by other outer wrappers.

It will further be appreciated that dimensions provided for elements of the aerosol-generating article illustrated in FIG. 5 and parts of the aerosol-generating device illustrated in FIG. 6 are merely exemplary, and that suitable alternative dimensions may be chosen.

The aerosol-generating article for use with an aerosol-generating device can comprise a heating element, the aerosol-generating article comprising: an aerosol-forming substrate; a support element located immediately downstream of the aerosol-forming substrate; an aerosol-cooling element located downstream of the support element; and an outer wrapper circumscribing the aerosol-forming substrate, the support element and the aerosol-cooling element, wherein the support element abuts the aerosol-forming substrate. Suitably, the heating element is an electrical heat element. The heating element can be adapted to heat tobacco a temperature described herein.

The aerosol-forming substrate can be located at an extreme upstream end of the aerosol-generating article. The aerosol-generating article can further comprise: a front plug upstream of the aerosol-forming substrate, wherein the outer wrapper circumscribes the front plug and the front plug is penetrable by a heating element of an aerosol-generating device. The aerosol-forming substrate can comprise a gathered sheet of homogenised tobacco material. The sheet of homogenised tobacco material can be crimped. The support element can comprise a hollow tubular element. The support element can comprise a hollow cellulose acetate tube. The aerosol-cooling element can be located immediately downstream of the support element and abuts the support element. The aerosol-cooling element can comprise a gathered sheet of biodegradable polymeric material. The aerosol-cooling element can comprise a gathered sheet of polylactic acid. The aerosol-generating article can further comprise: a mouthpiece located at an extreme downstream end of the aerosol-generating article, wherein the outer wrapper circumscribes the mouthpiece. The mouthpiece can comprise a plug of cellulose acetate tow. A method of using an aerosol-generating article as described herein with an aerosol-generating device is provided comprising a heating element, suitably an electrical heating element that heats to the temperature described herein, the method comprising the steps of: inserting the heating element of the aerosol-generating device into the aerosol-forming substrate of the aerosol-generating article; raising the temperature of the heating element of the aerosol-generating device to heat the aerosol-forming substrate of the aerosol-generating article to a temperature as described herein to generate an aerosol; and withdrawing the heating element of the aerosol-generating device from the aerosol-forming substrate of the aerosol-generating article. An aerosol-generating system is also described comprising: an aerosol-generating device comprising a heating element; and an aerosol-generating article for use with the aerosol-generating device, the aerosol-generating article comprising: an aerosol-forming substrate; a support element located immediately downstream of the aerosol-forming substrate; an aerosol-cooling element located downstream of the support element; and an outer wrapper circumscribing the aerosol-forming substrate, the support element and the aerosol-cooling element, wherein the support element abuts the aerosol-forming substrate and the aerosol-forming substrate is penetrable by the heating element of the aerosol-generating device. The method can comprise the steps of: inserting the heating element of the aerosol-generating device into the aerosol-forming substrate of the aerosol-generating article; raising the temperature of the heating element of the aerosol-generating device to heat the aerosol-forming substrate of the aerosol-generating article to generate an aerosol; and withdrawing the heating element of the aerosol-generating device from the aerosol-forming substrate of the aerosol-generating article. Suitably, the heating element is an electrical heating element. Suitably, the heating element heats and suitably maintains the tobacco to a temperature of between about 374 and 325 degrees Celsius, between about 374 and 330 degrees Celsius, between about 374 and 335 degrees Celsius, between about 374 and 340 degrees Celsius, between about 374 and 345 degrees Celsius, between about 374 and 350 degrees Celsius, between about 374 and 355 degrees Celsius, between about 374 and 360 degrees Celsius, between about 374 and 365 degrees Celsius, or between about 374 and 370 degrees Celsius. In certain embodiments, the tobacco may be heated to and suitably maintained at a temperature of between about 373 and 325 degrees Celsius, between about 373 and 330 degrees Celsius, between about 373 and 335 degrees Celsius, between about 373 and 340 degrees Celsius, between about 373 and 345 degrees Celsius, between about 373 and 350 degrees Celsius, between about 373 and 355 degrees Celsius, between about 373 and 360 degrees Celsius, between about 373 and 365 degrees Celsius, or between about 373 and 370 degrees Celsius. In certain embodiments, the tobacco may be heated to and suitably maintained at a temperature of between about 372 and 325 degrees Celsius, between about 372 and 330 degrees Celsius, between about 372 and 335 degrees Celsius, between about 372 and 340 degrees Celsius, between about 372 and 345 degrees Celsius, between about 372 and 350 degrees Celsius, between about 372 and 355 degrees Celsius, between about 372 and 360 degrees Celsius, between about 372 and 365 degrees Celsius, or between about 372 and 370 degrees Celsius. In certain embodiments, the tobacco may be heated to and suitably maintained at a temperature of between about 371 and 325 degrees Celsius, between about 371 and 330 degrees Celsius, between about 371 and 335 degrees Celsius, between about 371 and 340 degrees Celsius, between about 371 and 345 degrees Celsius, between about 371 and 350 degrees Celsius, between about 371 and 355 degrees Celsius, between about 371 and 360 degrees Celsius, between about 371 and 365 degrees Celsius, or between about 371 and 370 degrees Celsius.

In one embodiment, the actual operation temperature is retrieved from a lookup table which stores resistivity and temperature relationships for the at least one heating element. In another embodiment, the resistivity is determined by evaluating a polynomial of the form $\rho(T)=\rho_o*(1+\alpha 1T+\alpha 2T^2)$ where $\rho(T)$ is the measured resistivity of the at least one heating element or the plurality of heating elements, $\rho_o$ is a reference resistivity and $\alpha 1+\alpha 2$ are polynomial coefficients. The evaluation may be performed by a controller. Accordingly, the derivation of the measure of the heating element temperature can comprise evaluating the polynomial. Alternatively, polynomial functions of higher degrees or other mathematical functions may be used to describe the variation of the resistivity of the at least one heating element as a function of temperature. Alternatively, a piece-wise linear approximation may be used. This alternative simplifies and speeds up the calculation. In use, a controller can measure the resistivity $\rho$ of the heating element. The controller then converts the resistivity of the heating element into a value for the actual operation temperature of the heating element, by comparing the measured resistivity $\rho$ with the look-up table. In the next step, the controller compares the derived actual operation temperature with the predetermined maximum operation temperature. If the actual operation temperature is below the lower range of the predetermined maximum operation temperature, the controller supplies the heating element with additional electrical energy in order to raise the actual operation temperature of the heating element. If the actual operation temperature is above the upper range of the predetermined maximum operation temperature, the controller reduces the electrical energy supplied to the heating element in order to lower the actual operation temperature back into the acceptable range of the predetermined maximum operation temperature. A continuous supply of energy can be provided to the heating element and this supply of energy can be increased or decreased but not switched off. The supply of energy can be continuously monitored and feedback to the controller. The resistance of the heating element can be expressed as R=V/I; where V is the voltage across the heating element and I is the current passing through the heating element. The resistance R depends on the configuration of the heating element as well as the temperature and is expressed by the following relationship:

$$R=\rho(T)*L/S \qquad \text{equation 1}$$

where $\rho(T)$ is the temperature dependent resistivity, L is length and S the cross sectional area of the heating element. L and S are fixed for a given heating element configuration and can be measured. Thus, for a given heating element design R is proportional to $\rho(T)$. The resistivity $\rho(T)$ of the heating element can be expressed in the polynomial described above. Thus, knowing the length and cross-section of the heating element, it is possible to determine the resistance R, and therefore the resistivity $\rho$ at a given temperature by measuring the heating element voltage V and current I. Suitably, the calculation may be simplified by representing the resistivity $\rho$ versus temperature curve in one or more, suitably two, linear approximations in the temperature range applicable to tobacco. This simplifies evaluation of temperature which is desirable in a controller having limited computational resources.

In a preparation of the controlling of the maximum operation temperature, a value for the maximum operation temperature of the device can be selected. The controller heats the heating element by continuously supplying electrical energy to the heating element via feedback and monitoring of the electrical energy that is delivered. In use, the controller measures the resistivity $\rho$ of the heating element. The controller then converts the resistivity of the heating element into a value for the actual operation temperature of the heating element, by comparing the measured resistivity $\rho$ with the look-up table. In the next step, the controller compares the derived actual operation temperature with the predetermined maximum operation temperature. If the actual operation temperature is below the lower range of the predetermined maximum operation temperature, the controller can supply the heating element with additional electrical energy in order to raise the actual operation temperature of the heating element. If the actual operation temperature is above the upper range of the predetermined maximum operation temperature, the controller reduces the electrical energy supplied to the heating element in order to lower the actual operation temperature back into the acceptable range of the predetermined maximum operation temperature.

The heating element is generally not puff actuated. Instead the energy delivered to the heating element is continuously supplied, monitored and managed so that the amount of energy delivered to the heating element is increased to decreased but not switched off. Thus, in one embodiment, a continuous supply of energy is supplied to the heating element of the aerosol-generating device, said continuous supply of energy being (electronically) monitored during use of the device.

Considering now the impact of heating tobacco on the level, amount or concentration of HPHC(s), the skilled person will be aware that numerous different types of HPHCs are known to exist in aerosol generated from combusted tobacco. These HPHCs will normally be delivered to the user (for example, absorbed into the bloodstream) upon inhalation of the aerosol. Non-limiting examples of HPHCs include, but are not limited to, nicotine, nicotine-free dry particulate matter (NFDPM eg. tar), carbon monoxide, formaldehyde, acetaldehyde, acetone, acrolein, propionaldehyde, crotonaldehyde, methyl-ethyl ketone, butyraldehyde, benzo[a]pyrene, phenol, m-cresol, o-cresol, p-cresol, catechol, resorcinol, hydroquinone, 1,3-butadiene, isoprene, acrylonitrile, benzene, toluene, pyridine, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia, arsenic, cadmium, chrome, lead, nickel, selenium and mercury or a combination of one or more thereof. Analytical methods for measuring HPHCs are known in the art and include liquid chromatography-tandem mass spectrometry (LC-MS/MS) and spectrophotometry. Various sample sources will be used for measuring the one or more HPHCs in a user—including blood (or a component thereof—such as plasma), urine, exhaled breath and the like. Thus, by way of example, nicotine is typically measured in plasma by LC-MS/MS. Sometimes, the HPHC(s) will not be measured directly, especially in a sample derived or derivable from a user (for example, a smoker) to be tested. Instead, one or more biomarkers for the HPHC(s) may be tested instead. An exemplary list of HPHCs, biomarkers for HPHCs, methods of measuring HPHCs/biomarkers and the source of sample are described in Tables 1 and 3. In certain embodiments, the HPHCs are selected from the constituents in either Table 1 or Table 3.

As described herein, one or more HPHCs (other than nicotine) are reduced in the aerosol produced by the heated tobacco as compared to combusted tobacco. One or more HPHCs can even be reduced to levels that are equivalent or comparable to smoking abstinence. The reduction in the levels of the one or more HPHC(s) (other than nicotine) may be greater than about 25%, 30%, 40%, 50%, 60%, 70%, 80%, 90% or 100% or more as compared to combusted tobacco. In reducing the levels of one or more of these HPHCs in aerosol produced upon heating of tobacco, it has been observed that the levels of the one or more of HPHCs that are inhaled by and delivered to the user (for example, absorbed into the bloodstream) can also be reduced. Thus it is possible to reduce the exposure of a user to one or more HPHCs (other than nicotine). The reduction in the levels of the one or more HPHC(s) (other than nicotine) in the user (for example, in the urine and/or the plasma and/or bloodstream and/or the exhaled breath of the user) may be greater than about 25%, 30%, 40%, 50%, 60%, 70%, 80%, 90% or 100% or more as compared to combusted tobacco. The level of reduction is significant and the levels of the one or more HPHCs (other than nicotine) may be reduced to levels that are observed in abstaining users.

In certain embodiments of the disclosure the levels of one or more metabolic enzymes are also reduced in the user as compared to a user using combusted tobacco. One such example is a reduction in CYP1A2 enzyme activity. Smoking is a potent inducer of CYP1A2, which significantly lowers clozapine serum concentrations in users compared with non-users.

Figure 4A:
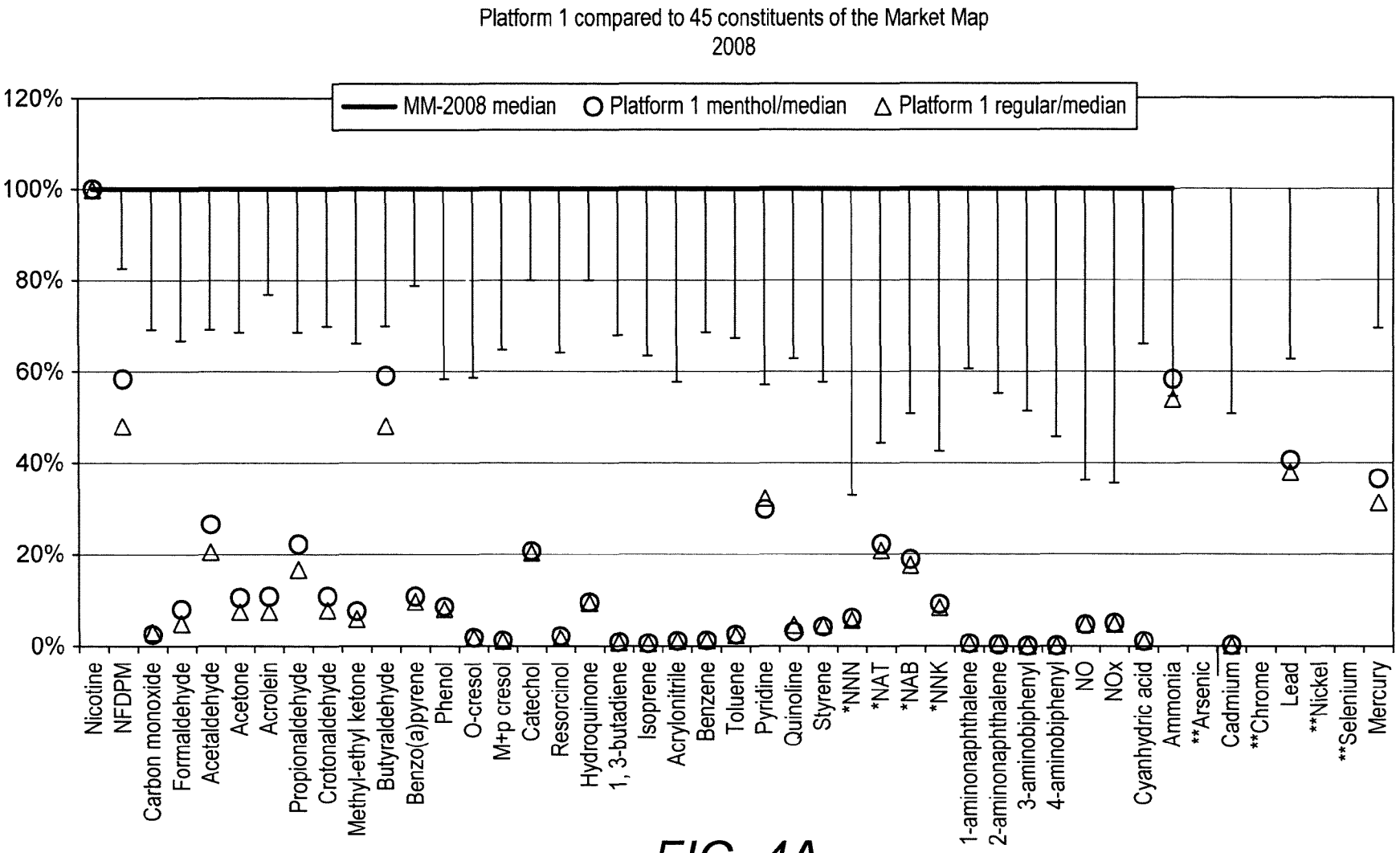
FIG. 4A illustrates the chemical analysis of aerosol produced via combustion of tobacco (MM-2008 median) versus heating of tobacco using menthol flavoured tobacco (platform 1 menthol) and regular tobacco (platform 1 regular). The metals shown with an asterisk were below LOQ/LOD.
Figure 8:
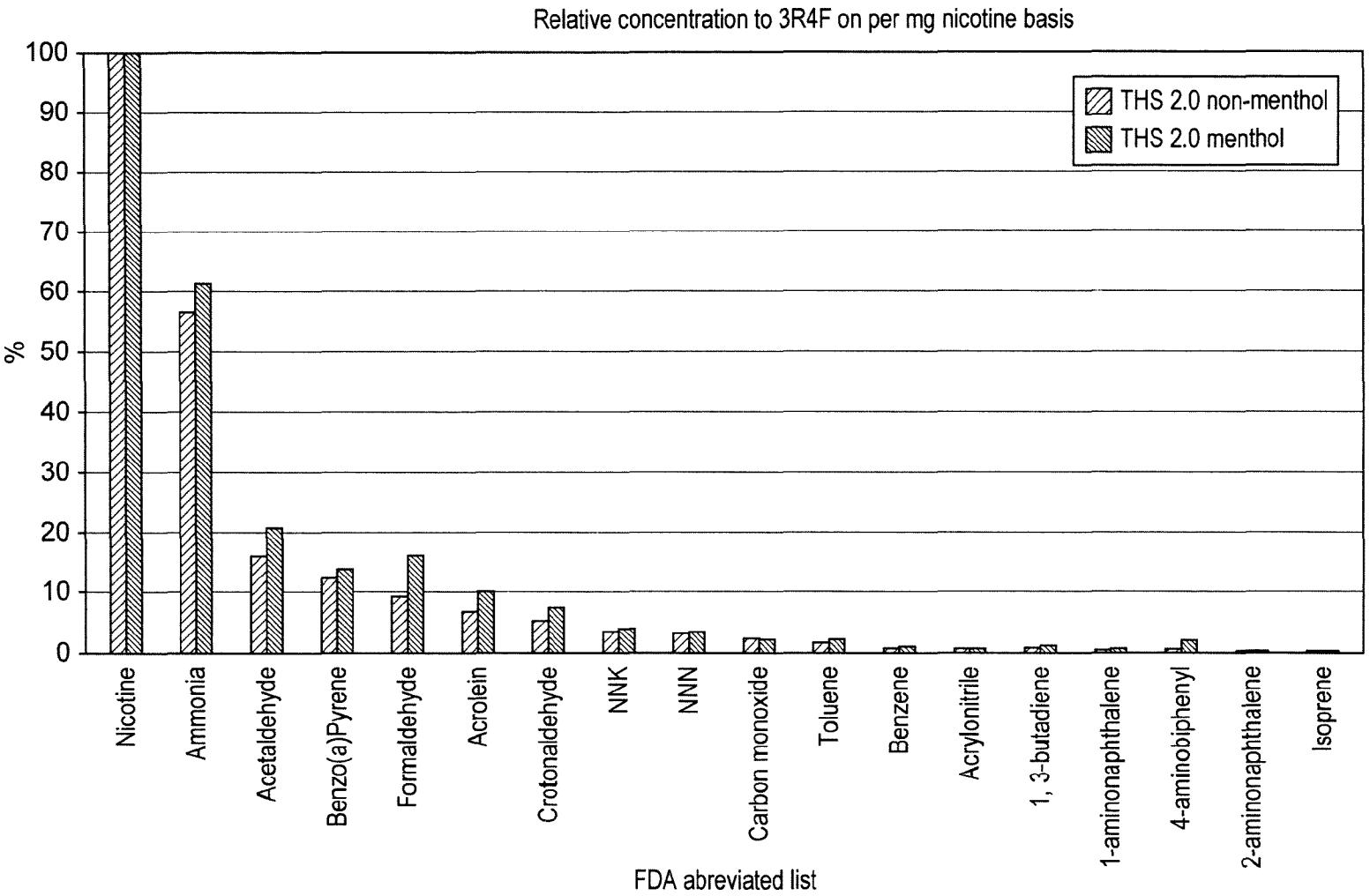
FIG. 8 shows the relative deliveries of 18 HPHCs for THS compared to the 3R4F reference cigarette (see Beiträge zur Tabakforschung International/*Contributions to Tobacco Research* Volume 25, No. 1, February 2012) (on a per mg nicotine basis). Abbreviations: NNK, 4-(methylnitrosamino)-1-(3-pyridyl)-1-butanone; NNN, N-nitrosonornicotine. This clearly demonstrates that for both the regular and menthol versions of the tobacco there are reductions of more than 80% in HPHCs, with the exception of $NH_3$ which is reduced by about 40%. The actual figures for these graphs are shown in Table 4. Table 4 compares HPHC deliveries according to the present disclosure with 3R4F on a per mg nicotine basis. HPHC values are corrected on a mass per mg nicotine basis. All mean and standard deviation (SD) values are based on the number of replicates (n). *Data in shaded squares (with n+0) are indicative of values below the limit of quantitation (LOQ). In this case the LOQ value has been used as the worst case. The two columns on the right of the table provide the deliveries as a percentage of the 3R4F delivery. Abbreviations: HPHC, harmful and potentially harmful constituents; NNK, 4-(methylnitrosamino)-1-(3-pyridyl)-1-butanone.
Figure 9:
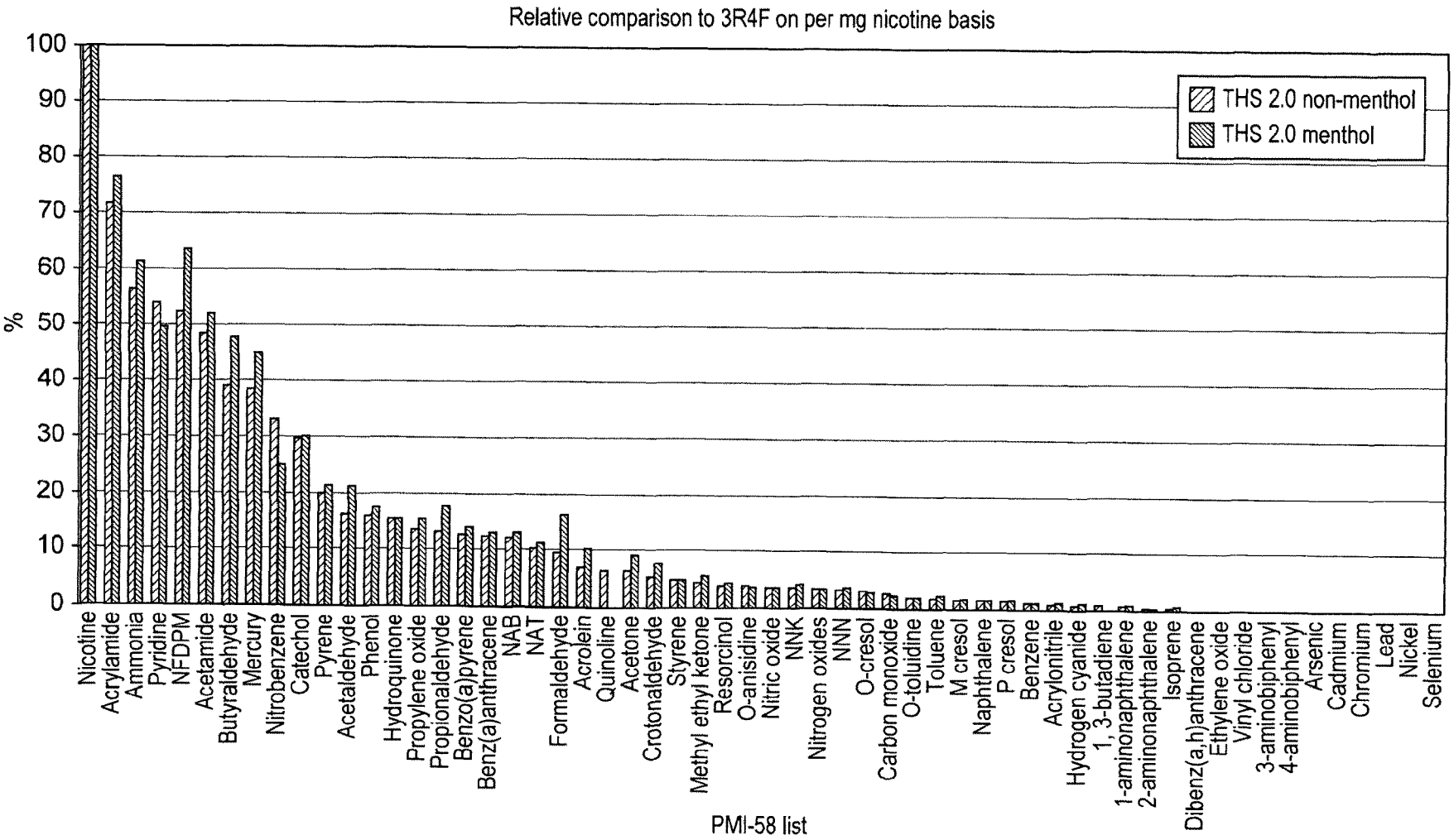
FIG. 9 shows the relative deliveries of 58 HPHCs obtained according to the present disclosure compared with the 3R4F cigarette (on a per mg nicotine basis). Abbreviations: NAB, N-nitrosoanabasine; NAT, N-nitrosoanatabine; NNK, 4-(methylnitrosamino)-1-(3-pyridyl)-1-butanone; NNN, N-nitroso-nornicotine.

A chemical analysis of the aerosol generated by heating tobacco has revealed significant differences in the aerosol obtained in heated tobacco versus combusted tobacco as generated in conventional cigarettes. An example of the aerosol chemistry observed from heated tobacco as compared to combusted tobacco is shown in FIGS. 4A, 8 and 9. The actual figures for the graph of FIG. 8 are shown in Table 4. Table 4 compares HPHC deliveries obtained according to the present disclosure with 3R4F on a per mg nicotine basis. HPHC values are corrected on a mass per mg nicotine basis.

The level of nicotine is substantially the same in both systems. In one embodiment, the level of nicotine is at least about 70% of the maximum concentration of a conventional/reference cigarette—such as 3R4F. The levels of a number of HPHCs (other than nicotine) are significantly lower in the heated tobacco with levels of HPHCs being about 50%, about 60%, about 70%, about 80%, about 90%, about 95%, about 96%, about 97%, about 98%, about 99% or about 100% or more lower than those levels observed in combusted tobacco. Thus, in one exemplary chemistry profile of aerosol the nicotine levels are substantially the same at those generated by combusted tobacco in conventional/reference cigarette whereas the level of one or more HPHCs (other than nicotine) is (significantly) reduced. The mainstream smoke chemistry of the reference cigarettes 3R4F and 2R4F is known in the art and has been published in Beiträge zur Tabakforschung International/*Contributions to Tobacco Research* Volume 25, No. 1, February 2012. In one embodiment, the nicotine levels in aerosol obtained or obtainable according to the present disclosure are substantially the same at those generated by combusted tobacco whereas the levels of one or more HPHCs (other than nicotine) is reduced as compared to combusted tobacco. Suitably, these comparisons with combusted tobacco are made by reference to the values from a reference cigarette such as 3R4F (see Beiträge zur Tabakforschung International/*Contributions to Tobacco Research* Volume 25, No. 1, February 2012). Methods for measuring nicotine and other HPHCs are described therein.

Standard methods for measuring the chemical constituents of aerosol are also described in this *Contributions to Tobacco Research* article. Standard ISO methods can be used. Cigarettes can optionally be conditioned using ISO standard 3402 (ISO 3402: Tobacco and tobacco products—Atmosphere for conditioning and testing. International Organization for Standardization, Geneva, Switzerland, 1999) ie. at least 48 hours at target conditions of 22° C.±1° C. and a relative humidity of 60%±3%. Smoke can be generated using ISO machine smoking conditions following ISO Standard 3308 (ISO 3308: Routine analytical cigarette smoking machine—Definitions and standard conditions. International Organization for Standardization, Geneva, Switzerland, 2000).

Cigarettes can be artificially smoked using methods that are known in the art. For example, cigarettes can be smoked on a 20-port Borgwaldt smoking machine (for example, RM20H, Hamburg, Germany) or on 30-port rotary smoking machine with an active sidestream smoke exhaust (for example, type Philip Morris Research Laboratories (PMRL), SM2000, equipped with a programmable dual-syringe pump (see EP1832745). Puff volume, puff duration, and puff frequency for ISO smoking conditions can be 35 mL, 2 s, and 1/min.

Analytes in smoke can be quantified and optionally compared according to established methodology, for example using ISO 4387 (ISO 4387: Determination of total and nicotine-free dry particulate matter using routine analytical smoking machine. International Organization for Standardization, Geneva, Switzerland, 1991) as previously described (*Toxicology* 195 (2004) 31-52). Total particulate matter (TPM) can be determined gravimetrically from the smoke trapped on Cambridge glass fiber filters according to ISO 4387 (ISO 4387: Determination of total and nicotine-free dry particulate matter using routine analytical smoking machine. International Organization for Standardization, Geneva, Switzerland, 1991). Nicotine can be determined by gas chromatography (GC) with flame ionization detection from a 2-propanol extract of the TPM filter. Water can be determined from the same 2-propanol extract by Karl Fischer titration (ISO 10315: Cigarettes—Determination of nicotine in smoke condensate—Gas chromatographic method ($2^{nd}$ ed.). International Organization for Standardization, Geneva, Switzerland, 2000). Carbon monoxide can be determined by non-dispersive infra-red photometry (ISO 8454: Cigarettes—Determination of carbon monoxide in the vapour phase of cigarette smoke—NDIR method (3rd ed.). International Organization for Standardization, Geneva, Switzerland, 2007). 'Tar' yield can be calculated as the TPM yield minus the nicotine and water yields (ISO 4387: Determination of total and nicotine-free dry particulate matter using routine analytical smoking machine. International Organization for Standardization, Geneva, Switzerland, 1991). Aldehydes, derivatised with 2,4-dinitrophenylhydrazine and stabilized with pyridine, can be determined by high-performance liquid chromatography with ultraviolet (HPLC/UV) detection using water/acetonitrile (9:1) and methanol as solvents (CORESTA: Recommended Method No. 74—Determination of selected carbonyls in mainstream cigarette smoke by high performance liquid chromatography (HPLC). Cooperation Centre for Scientific Research Relative to Tobacco, 2011). Vinyl chloride, 1,3-butadiene, isoprene, benzene, toluene, acrylonitrile, and styrene in the gas phase can be trapped in three impingers containing methanol at approximately −78° C. cooled with 2-propanole and dry ice and analysed after addition of internal standards by GC using a CP PoraBond Q column (25 m×0.25 mm, 3 μm) coupled to a mass spectrometer (GC-MS) with electron impact ionization in single ion monitoring mode (CORESTA: Recommended Method No. 70—Determination of selected volatile organic compounds in the mainstream smoke of cigarettes—gas chromatography-mass spectrometry method. Co-operation Centre for Scientific Research Relative to Tobacco, 2010). Styrene and acetamide in TPM can be extracted from a glass fiber filter using acetone and analyzed after addition of internal standards by GC using a DB-WAX column (30 m×0.25 mm, 0.25 μm) coupled to a mass spectrometer (GC/MS) with electron impact ionization in single ion monitoring mode. The analysis of acrylamide after extraction from a glass fiber filter can be performed as described in *J. Chromatogr. Sci.* 46 (2008) 659-663. Ethylene oxide in the gas phase can be trapped in an impinger containing toluene at approximately −78° C. (cooled with 2-propanole and dry ice) which is connected in series with a glass fiber filter as first trap. After addition of the internal standard propylene oxide-d6, the toluene solution can be analysed by GC using a CP PoraPlot U column (25 m×0.25 mm, 8 μm) and hydrogen as carrier gas coupled to a mass spectrometer (GC-MS) with electron impact ionization in single ion monitoring mode (*J. Chromatogr. Sci.* 44 (2006) 32-34). 2-nitro-propane can be determined from mainstream smoke trapped on a silica cartridge by adding 2-methyl-2-nitropropane as internal standard, washing the cartridge with pentane and eluting the target analyte using 15% diethyl ether in n-pentane. 2-nitropropane can be analysed by GC-MS/MS in chemical ionization mode using iso-butane as ionization gas, helium as carrier gas and argon as collision gas. Aromatic amines can be determined by extracting TPM-filters with dilute hydrochloric acid, followed by back extraction, derivatisation, clean-up by solid phase extraction, and analysis by GC with a triple quadrupole mass spectrometer (*Rapid Commun. Mass. Spectrom.* 17 (2003) 2125-2132). Nitrogen oxides can be determined by online gas phase chemiluminescence according to the CORESTA recommended method (CORESTA: Recommended Method (3rd Draft): The determination of nitric oxide in mainstream smoke of cigarettes by chemiluminescent analysis; Available at http://legacy.library.ucsf.edu/tid/vsm05c00). Hydrogen cyanide can be trapped in two impingers with sodium hydroxide solution connected in series. An aliquot can be analysed by headspace GC with nitrogen sensitive detection after acidification of the samples with phosphoric acid. Ammonia can be trapped on a glass fiber filter and a wash bottle connected in series. The glass fiber filter is extracted with the content of the wash bottle, derivatised with dansyl chloride, and analysed by HPLC with a tandem mass spectrometer (HPLC/MS-MS) (*J. Agric. Food Chem.* 59 (2011) 92-97). Volatile N-nitrosamines can be collected on a glass fiber filter and in two wash bottles containing a citrate/phosphate buffer solution with ascorbic acid to inhibit artificial generation of N-nitrosamines. The glass fiber filter is extracted with citrate/phosphate buffer solution with ascorbic acid and combined with the buffer solution of the wash bottles. The combined buffer solution is three times extracted with dichloromethane and the concentrated chloromethane phase is eluted through an alumina column. After elution with dichloromethane and another concentration step, the extract is analysed by GC with a thermal energy analyzer. Tobacco-specific N-nitrosamines (TSNAs) can be analysed as published in *Anal. Chem.* 77 (2005) 1001-1006. TSNAs can be extracted with ammonium acetate solution from TPM trapped on a glass fiber filter pad, and analysed by HPLC/MS-MS. Phenols can be extracted from a TPM filter with trichloromethane/acetone after addition of the internal standards phenol-d6, catechol-d6 and hydroquinone-d6. An aliquot of the extract can be derivatised with N,O-bis-(trimethylsilyl)-trifluoracetamide/1% trimethyl-chlorosilane and the trimethylsilyl ethers of the phenols are analysed by GC-MS using electron impact ionization in single ion monitoring mode. Polycyclic aromatic hydrocarbons can be extracted from TPM filters with pentane/isooctane (9:1) after addition of the labeled internal standards. The sample clean-up is performed by a 2-step solid phase extraction using aminopropyl cartridges eluted with n-hexane, and octadecyl cartridges eluted with methanol. After concentration of the eluate by solvent evaporation and dissolving in isooctane, the 13 target analytes can be determined by GC-MS using electron impact ionization in single ion monitoring mode. Arsenic, cadmium, chromium, nickel, lead, and selenium can be trapped in quartz glass tubes using electrostatic precipitation. The condensate can be dissolved with dichloromethane/methanol mixture, and after addition of nitric acid, hydrogen peroxide, and water, the samples can be subjected to microwave digestion and analysed with atomic absorption spectroscopy. In the case of matrix interferences, selenium can be re-analysed with the flow injection analysis system furnace technique. Mercury, after electrostatic precipitation of the particle phase, can be trapped in 2 impingers containing potassium permanganate in sulphuric acid. For microwave digestion hydrogen peroxide can be added. The digest can be made up with water and an aliquot was analyzed with a mercury analyser.

The smoke constituent yields for the 3R4F and 2R4F reference cigarettes as determined using the ISO standard are shown in Table A of Beiträge zur Tabakforschung International/*Contributions to Tobacco Research* Volume 25, No. 1, February 2012. Briefly, 3R4F has (per cigarette) 0.707 mg nicotine, 38.5 μg 1,3-butadiene, 395 μg isoprene, 26.4 μg acetonitrile, 1.01 ng 4-aminobiphenyl, 45.7 μg benzene and 38.3 ng cadmium. Briefly, 2R4F has (per cigarette) 0.678 mg nicotine, 38.9 μg 1,3-butadiene, 411 μg isoprene, 26.5 μg acetonitrile, 1.04 ng 4-aminobiphenyl, 46.6 μg benzene and 38.5 ng cadmium. Said HPHCs are selected from the group consisting of: nicotine-free dry particulate matter (NFDPM), carbon monoxide, formaldehyde, acetaldehyde, acetone, acrolein, propionaldehyde, crotonaldehyde, methyl-ethyl ketone, butyraldehyde, benzo[a]pyrene, phenol, m-cresol, o-cresol, p-cresol, catechol, resorcinol, hydroquinone, 1,3-butadiene, isoprene, acrylonitrile, benzene, toluene, pyridine, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia, arsenic, cadmium, chrome, lead, nickel, selenium and mercury or a combination of one or more thereof or a combination thereof.

In another embodiment, the nicotine levels in aerosol obtained or obtainable according to the present disclosure are substantially the same at those generated by combusted tobacco whereas the levels of one or more of HPHCs (other than nicotine) are reduced to negligible or undetectable levels, said HPHCs being selected from the group consisting of: m-cresol, p-cresol, 1,3 butadiene, isoprene, acrylonitrile, benzene, 1-aminonaphthalene, 2-aminonaphthalene, 3-aminobiphenyl, 4-aminobiphenyl, cyanhydric acid and cadmium or a combination of one or more thereof or a combination thereof.

In another embodiment, the nicotine levels in aerosol obtained or obtainable according to the present disclosure are substantially the same at those generated by combusted tobacco whereas the levels of one or more of HPHCs (other than nicotine) are present at levels of less than 1% of the composition of the aerosol generated from heated tobacco, said HPHCs being selected from the group consisting of: m-cresol, p-cresol, 1,3 butadiene, isoprene, acrylonitrile, benzene, 1-aminonaphthalene, 2-aminonaphthalene, 3-aminobiphenyl, 4-aminobiphenyl, cyanhydric acid and cadmium or a combination of one or more thereof or a combination thereof. In another embodiment, the nicotine levels are substantially the same at those generated by combusted tobacco whereas the levels of one or more of HPHCs (other than nicotine) are decreased to levels of between about 0 to about 10% of the levels generated by combusted tobacco, said HPHCs being selected from the group consisting of: carbon monoxide, acrolein, 1,3 butadiene and benzene or a combination of one or more thereof or a combination thereof.

In another embodiment, the nicotine levels are substantially the same at those generated by combusted tobacco whereas the levels of one or more of HPHCs (other than nicotine) are decreased to levels of between about 0 to about 20% of the levels generated by combusted tobacco, said HPHCs being selected from the group consisting of: carbon monoxide, acrolein, 1,3 butadiene and benzene or a combination of one or more thereof or a combination thereof.

In another embodiment, the nicotine levels are substantially the same at those generated by combusted tobacco whereas the levels of one or more of HPHCs (other than nicotine) are decreased to levels of between about 0 to about 20% of the levels generated by combusted tobacco, said HPHCs being selected from the group consisting of: carbon monoxide, formaldehyde, acetaldehyde, acetone, acrolein, propionaldehyde, crotonaldehyde, methyl-ethyl ketone, benzo[a]pyrene, phenol, m-cresol, o-cresol, p-cresol, catechol, resorcinol, hydroquinone, 1,3 butadiene, isoprene, acrylonitrile, benzene, toluene, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia cadmium and mercury or a combination of one or more thereof or a combination thereof.

In another embodiment, the nicotine levels are substantially the same at those generated by combusted tobacco whereas the levels of one or more of HPHCs (other than nicotine) are decreased to levels of between about 0 to about 20% of the levels generated by combusted tobacco, said HPHCs being selected from the group consisting of: carbon monoxide, formaldehyde, acetone, acrolein, crotonaldehyde, methyl-ethyl ketone, benzo[a]pyrene, phenol, m-cresol, o-cresol, p-cresol, catechol, resorcinol, hydroquinone, 1,3 butadiene, isoprene, acrylonitrile, benzene, toluene, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia cadmium and mercury or a combination of one or more thereof or a combination thereof.

In another embodiment, the nicotine levels are substantially the same at those generated by combusted tobacco whereas the levels of one or more of HPHCs (other than nicotine) are decreased to levels of between about 20 to about 40% of the levels generated by combusted tobacco, said HPHCs being selected from the group consisting of: pyridine, mercury and lead or a combination of one or more thereof.

In another embodiment, the nicotine levels are substantially the same at those generated by combusted tobacco whereas the levels of one or more of HPHCs (other than nicotine) are decreased to levels of between about 40 to about 60% of the levels generated by combusted tobacco, said HPHCs being selected from the group consisting of: nicotine-free dry particulate matter (NFDPM), butyraldehyde and ammonia or a combination of one or more thereof.

In another embodiment, the nicotine levels are substantially the same at those generated by combusted tobacco whereas: (i) the levels of one or more of HPHCs (other than nicotine) are decreased to levels of between about 0 to about 20% of the levels generated by combusted tobacco, said HPHCs being selected from the group consisting of: carbon monoxide, formaldehyde, acetaldehyde, acetone, acrolein, propionaldehyde, crotonaldehyde, methyl-ethyl ketone, benzo[a]pyrene, phenol, m-cresol, o-cresol, p-cresol, catechol, resorcinol, hydroquinone, 1,3 butadiene, isoprene, acrylonitrile, benzene, toluene, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia cadmium and mercury or a combination of one or more thereof; (ii) the levels of one or more of HPHCs (other than nicotine) are decreased to levels of between about 20 to about 40% of the levels generated by combusted tobacco, said HPHCs being selected from the group consisting of: pyridine, mercury and lead or a combination of one or more thereof; and (iii) the levels of one or more of HPHCs (other than nicotine) are decreased to levels of between about 40 to about 60% of the levels generated by combusted tobacco, said HPHCs being selected from the group consisting of: nicotine-free dry particulate matter (NFDPM), butyraldehyde and ammonia or a combination of one or more thereof.

In another embodiment, the nicotine levels are substantially the same at those generated by combusted tobacco whereas: (i) the levels of carbon monoxide, formaldehyde, acetaldehyde, acetone, acrolein, propionaldehyde, crotonaldehyde, methyl-ethyl ketone, benzo[a]pyrene, phenol, m-cresol, o-cresol, p-cresol, catechol, resorcinol, hydroquinone, 1,3 butadiene, isoprene, acrylonitrile, benzene, toluene, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia cadmium and mercury are decreased to levels of between about 0 to about 20% of the levels generated by combusted tobacco; (ii) the levels of pyridine, mercury and lead are decreased to levels of between about 20 to about 40% of the levels generated by combusted tobacco; and (iii) the levels nicotine-free dry particulate matter (NFDPM), butyraldehyde and ammonia are decreased to levels of between about 40 to about 60% of the levels generated by combusted tobacco.

Referring to Table 4, in certain embodiments, 4-aminobiphenyl, 2-aminonaphthalene, 1-aminonaphthalene are present in the aerosol at up to or less than about 0.1 ng/mg nicotine. In certain embodiments, carbon monooxide, 1,3-butadiene, benzene, benzo[a]prene and acrylonitrile are present in the aerosol at between about 0.4 and 0.11 ng/mg nicotine. In certain embodiments, isoprene, toluene, formaldehyde and crotonaldehyde are present in the aerosol at between about 1.5 and 3 ng/mg nicotine. In certain embodiments, N-nitrosonornicotine and NNK are present in the aerosol at between about 3.1 and 5 ng/mg nicotine. In certain embodiments, acrolein is present in the aerosol at between about 4 and 7 ng/mg nicotine. In certain embodiments, ammonia is present in the aerosol at between about 9 and 11 ng/mg nicotine. In certain embodiments, acetaldehyde is present in the aerosol at between about 100 and 160 ng/mg nicotine. Referring to Table 4, in certain embodiments, 4-aminobiphenyl, 2-aminonaphthalene, 1-aminonaphthalene are present in the aerosol at up to or less than about 0.1 ng/mg nicotine; carbon monooxide, 1,3-butadiene, benzene, benzo[a]prene and acrylonitrile are present in the aerosol at between about 0.4 and 0.11 ng/mg nicotine; isoprene, toluene, formaldehyde and crotonaldehyde are present in the aerosol at between about 1.5 and 3 ng/mg nicotine; N-nitrosonornicotine and NNK are present in the aerosol at between about 3.1 and 5 ng/mg nicotine; acrolein is present in the aerosol at between about 4 and 7 ng/mg nicotine; ammonia is present in the aerosol at between about 9 and 11 ng/mg nicotine; and acetaldehyde is present in the aerosol at between about 100 and 160 ng/mg nicotine.

Although the present disclosure can result in a reduction in the levels of one or more HPHCs (other than nicotine) it is highly advantageous that the aerosol that is inhaled still creates acceptable levels of nicotine in the user. This will make the consumption experience much more acceptable to the user. As can be seen in FIG. 1, heated tobacco can be used to deliver between about 7-8 ng/ml to the blood plasma of a user whereas combusted tobacco delivers between about 10-11 ng/ml to the blood plasma of a user. Accordingly, the amount of nicotine that is delivered to the user (for example, absorbed into the bloodstream) via the heating of tobacco is greater than about 60%, 65%, 70%, 75%, 80%, 85%, 90%, 95% or 100% of the level of nicotine delivered via the combustion of tobacco. The extent of exposure to nicotine in the bloodstream of the user via the heated tobacco route can be about 10%, 15%, 20%, 21%, 22%, 23%, 24%, 25%, 26%, 27%, 28%, 29% or 30% lower than via the combusted cigarette route.

In another embodiment, the overall pharmocokinetic profile of nicotine delivery is similar in the heated and combusted tobacco systems but with a lower exposure to nicotine following single use of the heated tobacco system (see FIG. 1). The pharmacokinetic profile of nicotine delivery using combusted tobacco is compared with heated tobacco in FIG. 1. As can be seen, the overall pharmacokinetic profiles of nicotine delivery from heated tobacco systems are similar to combusted tobacco systems in that the levels of nicotine attained in the bloodstream by both systems rapidly increase within the first 6 minutes of smoking and reach their maximum levels at between 6 and 9 minutes. The levels of nicotine then tail off after about 9 minutes decreasing steadily thereafter.

Heating the tobacco in a manner which reduces pyrolysis and avoids combustion decreases the formation of HPHCs in the aerosol produced by the tobacco. It can result in a simplification in the composition of the aerosol and/or a reduction in the levels of many HPHCs.

Suitably, the tobacco is heated up to or below 400° C. Thus, tobacco is heated and not burnt. More suitably, the tobacco is electrically heated up to or below 400° C. In certain embodiments, the tobacco may be heated to a desired temperature of less than about 390 degrees Celsius, less than about 380 degrees Celsius, less than about 370 degrees Celsius, less than about 360 degrees Celsius, less than about 350 degrees Celsius, less than about 340 degrees Celsius, less than about 330 degrees Celsius, less than about 325 degrees Celsius.

In certain embodiments, the tobacco may be heated to a temperature of between about 390 and 325 degrees Celsius, between about 390 and 330 degrees Celsius, between about 390 and 335 degrees Celsius, between about 390 and 340 degrees Celsius, between about 390 and 345 degrees Celsius, between about 390 and 350 degrees Celsius, between about 390 and 355 degrees Celsius, between about 390 and 360 degrees Celsius, between about 390 and 365 degrees Celsius, between about 390 and 370 degrees Celsius, between about 390 and 375 degrees Celsius, between about 390 and 380 degrees Celsius, or between about 390 and 385 degrees Celsius.

In certain embodiments, the tobacco may be heated to a temperature of between about 380 and 325 degrees Celsius, between about 380 and 330 degrees Celsius, between about 380 and 335 degrees Celsius, between about 380 and 340 degrees Celsius, between about 380 and 345 degrees Celsius, between about 380 and 350 degrees Celsius, between about 380 and 355 degrees Celsius, between about 380 and 360 degrees Celsius, between about 380 and 365 degrees Celsius, between about 380 and 370 degrees Celsius or between about 380 and 375 degrees Celsius.

In certain embodiments, the tobacco may be heated to a temperature of between about 375 and 325 degrees Celsius, between about 375 and 330 degrees Celsius, between about 375 and 335 degrees Celsius, between about 375 and 340 degrees Celsius, between about 375 and 345 degrees Celsius, between about 375 and 350 degrees Celsius, between about 375 and 355 degrees Celsius, between about 375 and 360 degrees Celsius, between about 375 and 365 degrees Celsius, or between about 375 and 370 degrees Celsius.

In certain embodiments, the tobacco may be heated to a temperature of between about 374 and 325 degrees Celsius, between about 374 and 330 degrees Celsius, between about 374 and 335 degrees Celsius, between about 374 and 340 degrees Celsius, between about 374 and 345 degrees Celsius, between about 374 and 350 degrees Celsius, between about 374 and 355 degrees Celsius, between about 374 and 360 degrees Celsius, between about 374 and 365 degrees Celsius, or between about 374 and 370 degrees Celsius.

In certain embodiments, the tobacco may be heated to a temperature of between about 373 and 325 degrees Celsius, between about 373 and 330 degrees Celsius, between about 373 and 335 degrees Celsius, between about 373 and 340 degrees Celsius, between about 373 and 345 degrees Celsius, between about 373 and 350 degrees Celsius, between about 373 and 355 degrees Celsius, between about 373 and 360 degrees Celsius, between about 373 and 365 degrees Celsius, or between about 373 and 370 degrees Celsius.

In certain embodiments, the tobacco may be heated a temperature of between about 372 and 325 degrees Celsius, between about 372 and 330 degrees Celsius, between about 372 and 335 degrees Celsius, between about 372 and 340 degrees Celsius, between about 372 and 345 degrees Celsius, between about 372 and 350 degrees Celsius, between about 372 and 355 degrees Celsius, between about 372 and 360 degrees Celsius, between about 372 and 365 degrees Celsius, or between about 372 and 370 degrees Celsius.

In certain embodiments, the tobacco may be heated to a temperature of between about 371 and 325 degrees Celsius, between about 371 and 330 degrees Celsius, between about 371 and 335 degrees Celsius, between about 371 and 340 degrees Celsius, between about 371 and 345 degrees Celsius, between about 371 and 350 degrees Celsius, between about 371 and 355 degrees Celsius, between about 371 and 360 degrees Celsius, between about 371 and 365 degrees Celsius, or between about 371 and 370 degrees Celsius.

The heating (for example, the electrical heating) of the tobacco will typically be achieved by electronically controlled means. The electronically controlled means may not only control the temperature used to heat the tobacco but it may also control the rate of heating of the tobacco.

Thus, in certain embodiments of this disclosure, the desired temperature is reached over a period of about 10 seconds, about 20 seconds, about 30 seconds, about 40 seconds, about 50 seconds, about 1 minute, about 2 minutes, about 3 minutes, about 4 minutes, about 5 minutes, about 6 minutes, about 7 minutes, about 8 minutes, about 9 minutes or about 10 minutes or more. Typically, the desired temperature will be reached before the user consumes the tobacco in the aerosol-generating device. The aerosol-generating device may include an electronic indicator—such as an LED—to indicate that the desired temperature has been reached.

As can be seen in at least FIG. 2, users who use an aerosol-generating device in which tobacco contained in the aerosol-generating device is heated to a temperature of less than about 400 degrees Celsius to create an aerosol can have a characteristic biomarker profile. Whilst the level of nicotine in the smoker remains elevated (for example, as shown in FIG. 1 a smoker can have a nicotine concentration of about 7 ng/ml) the levels of one or more biomarkers are reduced after a period of using the aerosol-generating device due to the lower levels of the one or more HPHCs that are present in aerosol inhaled by the smoker. By way of example, after 2 days of using the aerosol-generating device the smoker can have a biomarker profile in which: (i) the carbon monoxide level in the sample is between about 1%-2% (for example, about 1.5%); and/or (ii) the S-PMA (benzene marker) level in the user is between about 0.1 to 1 micro·g/g creatinine (for example, about 0.8, about 0.7 about 0.6 or about 0.5 micro·g/g creatinine); and/or (iii) the 3-HPMA (acrolein marker) level in the user is between about 200 to 400 micro·g/g creatinine (for example, about 300 micro·g/g creatinine); and/or (iv) the MHBMA (1,3-butadiene marker) level in the user is between about 0.1 to 1 micro·g/g creatinine (for example, about 0.5 micro·g/g creatinine). By way of further example, after 2 days of using the aerosol-generating device the smoker can have a biomarker profile in which: (i) the carboxyhemoglobin (carbon monoxide marker) level in the sample is between about 1%-2% (for example, about 1.5%); (ii) the S-PMA (benzene marker) level in the user is between about 0.1 to 1 micro·g/g creatinine (for example, about 0.8 micro·g/g creatinine); (iii) the 3-HPMA (acrolein marker) level in the user is between about 200 to 400 micro·g/g creatinine (for example, about 300 micro·g/g creatinine); and (iv) the MHBMA (1,3-butadiene marker) level in the user is between about 0.1 to 1 micro·g/g creatinine (for example, about 0.5 micro·g/g creatinine). This biomarker profile can be useful to identify smokers who use the device and also to assess the potential health benefits to the smoker that is using the device. Thus, in a further aspect there is provided a method of determining if a smoker uses an aerosol-generating device in which tobacco contained therein is heated to a temperature of less than about 400 degrees Celsius to create an aerosol, said method comprising the steps of: (a) providing a sample from the smoker; and (b) determining the levels of one or more of carbon monoxide, benzene, acrolein and 1,3-butadiene therein; wherein (i) if the carboxyhemoglobin (carbon monoxide marker) level in the sample is between about 1%-2% after about 2 days of consuming aerosol generated from heated tobacco; and/or (ii) the S-PMA (benzene marker) level in the user is to between about 0.1 to 1 micro·g/g creatinine after about 2 days of consuming aerosol generated from heated tobacco; and/or (iii) the 3-HPMA (acrolein marker) level in the user is about 200 to 400 micro·g/g creatinine after about 2 days of consuming aerosol generated from heated tobacco; and/or (iv) the MHBMA (1,3-butadiene marker) level in the user is between about 0.1 to 1 micro·g/g creatinine after about 2 days of consuming aerosol generated from heated tobacco is indicative that said user uses the aerosol-generating device.

In a further aspect, there is also provided a method of identifying a user using an aerosol-generating device in which tobacco contained in the aerosol-generating device is electrically heated to a temperature of less than about 400 degrees Celsius to create an aerosol, said method comprising the steps of: (a) providing a sample from the user; and (b) determining the levels of one or more of at least carbon monoxide, benzene, acrolein and 1,3-butadiene therein; wherein (i) the carboxyhemoglobin (carbon monoxide marker) level in the user is between about 1-2%, suitably about 1.5% in blood after 1 day of consuming aerosol generated from electrically heated tobacco; and/or (ii) the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or (iii) the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or (iv) the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco is indicative that said user uses the aerosol-generating device.

The user can be identified from a pool of two or more users. The method may be used to evaluate a batch of test results (for example, a batch of blind test results in which it is not known which form of combusted or electrically heated tobacco the user has been using) in order to identify one or more users that have been using electrically heated tobacco.

In a further aspect, there is provided a sample isolated, obtained or collected from a smoker at least 2 days (for example, 2 days, 3 days, 4, days, 5 days, 6 days or 7 days) after using an aerosol-generating device in which tobacco contained therein is heated to a temperature of less than about 400 degrees Celsius to create an aerosol, wherein (i) the carboxyhemoglobin (carbon monoxide marker) level in the sample is between about 1%-2%; and/or (ii) the S-PMA (benzene marker) level in the user is to between about 0.1 to 1 micro·g/g creatinine; and/or (iii) the 3-HPMA (acrolein marker) level in the user is about 200 to 400 micro·g/g creatinine; and/or (iv) the MHBMA (1,3-butadiene marker) level in the user is between about 0.1 to 1 micro·g/g creatinine.

Suitably, the levels of carbon monoxide, benzene, acrolein and 1,3-butadiene are determined. If a conventional cigarette is heated at up to or less than 400° C. this can result in an aerosol which is unacceptable to the user. In addition to controlling the temperature at which the tobacco is heated, modification of the tobacco blend may be desirable in order to create tobacco—such as tobacco stick—which produces an acceptable taste and flavour for the user, while also reducing the level of one or more HPHCs inhaled as described herein.

The user can be a smoker as defined herein. The user can be a current smoker, a smoker who has elected to stop smoking, a smoker who is trying to stop smoking or a smoker who is receiving therapy—such as nictotine replacement therapy—to stop smoking or to try to stop smoking. The user can be a single user or a pool of two or more users. For a pool of users, the smoking status of the pool of users can be the same but generally it will be different. When comparisons are being made between users using combustible tobacco (for example, conventional cigarettes) and electrically heated tobacco then it is generally preferred that the average lung capacity or lung volume of the users will be about the same.

In one embodiment, an aerosol-forming agent can be included in the tobacco blend to facilitate producing an aerosol that is more acceptable to the user. Suitable aerosol-formers are known in the art and include, but are not limited to: polyhydric alcohols, such as propylene glycol, triethylene glycol, 1,3-butanediol and glycerine; esters of polyhydric alcohols, such as glycerol mono-, di- or triacetate; and aliphatic esters of mono-, di- or polycarboxylic acids, such as dimethyl dodecanedioate and dimethyl tetradecanedioate. Particularly suitable aerosol formers are polyhydric alcohols or mixtures thereof, such as propylene glycol, triethylene glycol, 1,3-butanediol and, most suitably, glycerine. The aerosol-forming substrate may comprise a single aerosol former. Alternatively, the aerosol-forming substrate may comprise a combination of two or more aerosol formers. Suitably, the aerosol-forming substrate has an aerosol former content of greater than about 5% on a dry weight basis. The aerosol aerosol-forming substrate may have an aerosol former content of between approximately 5% and approximately 30% on a dry weight basis. In one embodiment, the aerosol-forming substrate has an aerosol former content of approximately 20% on a dry weight basis.

In other embodiments, the aerosol-forming substrate comprises a gathered textured sheet of homogenised tobacco material. In other embodiments, the aerosol-forming substrate comprises a gathered crimpled sheet of homogenised tobacco material. In one embodiment, a combination of an aerosol-forming substrate comprising gathered sheets of homogenised tobacco are used. They may be made by methods known in the art, for example the methods disclosed in WO 2012/164009 A2.

Use of a textured sheet of homogenised tobacco material may advantageously facilitate gathering of the sheet of homogenised tobacco material to form the aerosol-forming substrate.

In certain embodiments, the aerosol-forming substrate may comprise a gathered sheet of homogenised tobacco material that is substantially evenly textured over substantially its entire surface. For example, the aerosol-forming substrate may comprise a gathered crimped sheet of homogenised tobacco material comprising a plurality of substantially parallel ridges or corrugations that are substantially evenly spaced-apart across the width of the sheet.

The aerosol-forming substrate may be in the form of a plug comprising an aerosol-forming material circumscribed by a paper or other wrapper. Where an aerosol-forming substrate is in the form of a plug, the entire plug including any wrapper is considered to be the aerosol-forming substrate.

In one embodiment, the aerosol-generating substrate comprises a plug comprising a gathered textured sheet of homogenised tobacco material circumscribed by a wrapper. In a particularly preferred embodiment, the aerosol-generating substrate comprises a plug comprising a gathered crimped sheet of homogenised tobacco material circumscribed by a wrapper.

In certain embodiments, sheets of homogenised tobacco material for use in the aerosol-generating substrate may have a tobacco content of approximately 70% or more by weight on a dry weight basis.

Sheets of homogenised tobacco material for use in the aerosol-generating substrate may comprise one or more intrinsic binders, that is tobacco endogenous binders, one or more extrinsic binders, that is tobacco exogenous binders, or a combination thereof to help agglomerate the particulate tobacco. Alternatively, or in addition, sheets of homogenised tobacco material for use in the aerosol-generating substrate may comprise other additives including, but not limited to, tobacco and non-tobacco fibres, aerosol-formers, humectants, plasticisers, flavourants, fillers, aqueous and non-aqueous solvents and combinations thereof.

Suitable extrinsic binders for inclusion in sheets of homogenised tobacco material for use in the aerosol-generating substrate are known in the art and include, but are not limited to: gums such as, for example, guar gum, xanthan gum, arabic gum and locust bean gum; cellulosic binders such as, for example, hydroxypropyl cellulose, carboxymethyl cellulose, hydroxyethyl cellulose, methyl cellulose and ethyl cellulose; polysaccharides such as, for example, starches, organic acids, such as alginic acid, conjugate base salts of organic acids, such as sodium-alginate, agar and pectins; and combinations thereof.

Suitable non-tobacco fibres for inclusion in sheets of homogenised tobacco material for use in the aerosol-generating substrate are known in the art and include, but are not limited to: cellulose fibers; soft-wood fibres; hard-wood fibres; jute fibres and combinations thereof. Prior to inclusion in sheets of homogenised tobacco material for use in the aerosol-generating substrate, non-tobacco fibres may be treated by suitable processes known in the art including, but not limited to: mechanical pulping; refining; chemical pulping; bleaching; sulfate pulping; and combinations thereof.

Sheets of homogenised tobacco material for use in the aerosol-generating substrate should have sufficiently high tensile strength to survive being gathered to form the aerosol-generating substrate. In certain embodiments non-tobacco fibres may be included in sheets of homogenised tobacco material for use in the aerosol-generating substrate in order to achieve an appropriate tensile strength.

For example, homogenised sheets of tobacco material for use in the aerosol-generating substrate may comprise between approximately 1% and approximately 5% non-tobacco fibres by weight on a dry weight basis.

Returning now to the aerosol-generating device that can be used in accordance with the present disclosure, the aerosol-generating device generally comprises two ends: a proximal end through which aerosol exits the aerosol-generating device and is delivered to a user and a distal end. In use, a user may draw on the proximal end in order to inhale aerosol generated by the aerosol-generating device. The proximal end may also be referred to as the mouth end or the downstream end and is downstream of the distal end. The distal end may also be referred to as the upstream end and is upstream of the proximal end.

Generally, the aerosol-generating device is a smoking device that generates an aerosol that is directly inhalable into a user's lungs through the user's mouth. The aerosol-generating device is a smoking article that is capable, upon heating, of generating a nicotine-containing aerosol that is directly inhalable into a user's lungs through the user's mouth.

For the avoidance of doubt, in the following description the term 'heating element' is used to mean one or more heating elements.

The aerosol-forming substrate can be located at the upstream end of the aerosol-generating article.

In alternative embodiments, the aerosol-generating article may comprise a front-plug upstream of the aerosol-forming substrate, wherein the front plug is penetrable by a heating element of an aerosol-generating device. In such alternative embodiments, the front-plug may be located at the upstream end of the aerosol-generating article.

In such embodiments, the front-plug may prevent egress of the aerosol-forming substrate from the upstream end of the aerosol-forming substrate during handling and shipping. The front-plug may also assist in positioning the aerosol-forming substrate at a predetermined distance from the upstream end of the aerosol-forming substrate for optimum engagement with a heating element of an aerosol-generating device.

The front-plug may be configured to prevent egress of the aerosol-forming substrate from the aerosol-generating article during use, for example as a heating element of the aerosol-generating device is withdrawn from the aerosol-generating article. The aerosol-forming substrate of the aerosol-generating article may shrink into contact with a heating element of the aerosol-generating device during heating of the aerosol-forming substrate to generate an aerosol. The aerosol-forming substrate may also shrink such that its contact with the outer wrapper circumscribing the components of the aerosol-generating article is reduced. This may loosen the aerosol-forming substrate within the aerosol-generating article. Inclusion of a front-plug may facilitate removal of a heating element from the aerosol-generating article by resisting upstream movement of the aerosol-forming substrate during withdrawal of a heating element of an aerosol-generating device from the aerosol-forming substrate of aerosol-generating article.

Alternatively or in addition, the front-plug may be configured to wipe a surface of the heating element of the aerosol-generating device as the heating element of the aerosol-generating device is withdrawn from the aerosol-generating article.

The front-plug may define a hole or slit through which a heating element of an aerosol-generating device can pass. The hole or slit defined in the front-plug may be dimensioned to engage with a heating element of an aerosol-generating device passed therethrough. For example, the dimensions of the hole or slit defined in the front-plug may almost exactly match the dimensions of a cross-section of the heating element of the aerosol-generating device. Alternatively, the hole or slit may have smaller dimensions than a cross-section of the heating element of the aerosol-generating device. In such embodiments, the heating element may need to deform the front-plug in order to pass through the hole or slit.

One or more holes or slits may be defined in the front-pug. For example, an aerosol-generating article intended to be used with an aerosol-generating device having three heating elements may comprise a front-plug with three holes or slits defined therein, each arranged to accept one of the three heating elements of the aerosol-generating device.

Alternatively, the front-plug may be formed of a pierceable material.

The front-plug may be made from an air permeable material that allows air to be drawn through the front plug. In such embodiments, a user may draw air downstream through the aerosol-generating article through the front-plug.

The front-plug may be formed from an air permeable filter material. The front-plug may conveniently be formed from an air permeable material used to form mouthpiece filters for a conventional lit-end cigarette. For example, the front-plug may be formed from cellulose acetate tow. The permeability of the front-plug may be varied to help control resistance to draw of the aerosol-generating article.

Alternatively, the front-plug may be formed from an air impermeable material. In such embodiments, the aerosol-generating article may further comprise one or more air inlets downstream of the front plug through which air may be drawn into the aerosol-generating article.

The front-plug may be formed from a low strength material in order to reduce the force required to penetrate the front plug with a heating element of an aerosol-generating device.

The front plug may be formed from a fibrous material or a foam material. Where the front-plug is formed from a fibrous material, the fibres of the fibrous material may be substantially aligned along the longitudinal direction of the aerosol-generating article in order to reduce the force required to penetrate the front plug with a heating element of an aerosol-generating device.

In some embodiments, the front-plug may be at least partially formed from an aerosol-forming substrate. For example, the front-plug may be at least partially formed from an aerosol-forming substrate comprising tobacco.

The front-plug may be formed from a pierceable material that may be deformed by a heating element of an aerosol-generating device upon insertion of the heating element into the aerosol-generating article and that regains its shape when the heating element is withdrawn from the aerosol-generating article.

For example, the front-plug may be formed from a pierceable resilient material that deforms to allow a heating element of an aerosol-generating device to pass the front plug when the front plug is pierced by the heating element. When the heating element is withdrawn from the aerosol-generating article, the hole or slit pierced through the front-plug by the heating element may fully or partially close. In such embodiments, the front-plug may advantageously provide a cleaning function by wiping the heating element of the aerosol-generating device as the heating element is withdrawn from the aerosol-generating article.

However, it will be appreciated that the front-plug does not need to be formed from a resilient material in order to provide a cleaning function. For example, a cleaning function may also be provided on withdrawal of a heating element of an aerosol-generating device from the aerosol-generating article where the front plug defines a hole or slit having dimensions that almost exactly match or are smaller than the dimensions of a cross-section of the heating element.

The front-plug may have an external diameter that is approximately equal to the external diameter of the aerosol-generating article.

The front-plug may have an external diameter of at least 5 millimetres. The front-plug substrate may have an external diameter of between approximately 5 millimetres and approximately 12 millimetres, for example of between approximately 5 millimetres and approximately 10 millimetres or of between approximately 6 millimetres and approximately 8 millimetres. In one embodiment, the front-plug has an external diameter of 7.2 millimetres+/−10%.

The front plug may have a length of at least 2 millimetres, at least 3 millimetres or at least 4 millimetres. The front-plug may have a length of between approximately 2 millimetres and approximately 10 mm, for example of between approximately 4 millimetres and approximately 8 mm.

The front-plug may be substantially cylindrical.

The aerosol-forming substrate may be a solid aerosol-forming substrate. The aerosol-forming substrate may comprise both solid and liquid components.

The aerosol-forming substrate comprises tobacco. In addition, the aerosol-forming substrate may comprise a non-tobacco containing aerosol-forming material.

Optionally, the solid aerosol-forming substrate may contain tobacco or non-tobacco volatile flavour compounds, which are released upon heating of the solid aerosol-forming substrate. The solid aerosol-forming substrate may also contain one or more capsules that, for example, include additional tobacco volatile flavour compounds or non-tobacco volatile flavour compounds and such capsules may melt during heating of the solid aerosol-forming substrate.

Optionally, the solid aerosol-forming substrate may be provided on or embedded in a thermally stable carrier. The carrier may take the form of powder, granules, pellets, shreds, strands, strips or sheets. The solid aerosol-forming substrate may be deposited on the surface of the carrier in the form of, for example, a sheet, foam, gel or slurry. The solid aerosol-forming substrate may be deposited on the entire surface of the carrier, or alternatively, may be deposited in a pattern in order to provide a non-uniform flavour delivery during use.

In one embodiment, the aerosol-forming substrate comprises an aerosol former.

In one embodiment sheets of homogenised tobacco material for use in the aerosol-generating article are formed from a slurry comprising particulate tobacco, guar gum, cellulose fibres and glycerine by a casting process.

The aerosol-forming element may have an external diameter that is approximately equal to the external diameter of the aerosol-generating article.

The aerosol-forming substrate may have an external diameter of at least 5 millimetres. The aerosol-forming substrate may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the aerosol-forming substrate has an external diameter of 7.2 millimetres+1-10%.

The aerosol-forming substrate may have a length of between approximately 7 millimetres and approximately 15 mm. In one embodiment, the aerosol-forming substrate may have a length of approximately 10 millimetres. In a preferred embodiment, the aerosol-forming substrate has a length of approximately 12 millimetres.

The aerosol-forming substrate may be substantially cylindrical.

The support element is located immediately downstream of the aerosol-forming substrate and abuts the aerosol-forming substrate.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate.

The support element may comprise a hollow tubular element. In a preferred embodiment, the support element comprises a hollow cellulose acetate tube.

The support element may have an external diameter that is approximately equal to the external diameter of the aerosol-generating article.

The support element may have an external diameter of between approximately 5 millimetres and approximately 12 millimetres, for example of between approximately 5 millimetres and approximately 10 millimetres or of between approximately 6 millimetres and approximately 8 millimetres. In a preferred embodiment, the support element has an external diameter of 7.2 millimetres+1-10%.

The support element may have a length of between approximately 5 millimetres and approximately 15 mm. In a preferred embodiment, the support element has a length of approximately 8 millimetres.

During insertion of a heating element of an aerosol-generating device into an aerosol-forming substrate of an aerosol-generating article, a user may be required to apply some force in order to overcome the resistance of the aerosol-forming substrate of the aerosol-generating article to insertion of the heating element of the aerosol-generating device. This may damage one or both of the aerosol-generating article and the heating element of the aerosol-generating device.

In addition, the application of force during insertion of the heating element of the aerosol-generating device into the aerosol-forming substrate of the aerosol-generating article may displace the aerosol-forming substrate within the aerosol-generating article. This may result in the heating element of the aerosol-generating device not being fully inserted into the aerosol-forming substrate, which may lead to uneven and inefficient heating of the aerosol-forming substrate of the aerosol-generating article.

In preferred embodiments, the support element is configured to resist downstream movement of the aerosol-forming substrate during insertion of the heating element of the aerosol-generating device into the aerosol-forming substrate of aerosol-generating article.

The insertion force experienced by the aerosol-generating article as it is inserted into the aerosol-generating device by a user may be divided into three parts: friction force, penetration force and crush force.

As the aerosol-generating article is initially inserted into the aerosol-generating device and prior to the heating element of the aerosol-generating device being inserted into the aerosol-forming substrate of the aerosol-generating article, the insertion force is dominated by the force required to overcome friction due to interference between the exterior surface of the aerosol-generating article and the interior surface of the aerosol-generating device. As used herein, the term 'friction force' is used to describe the maximum insertion force prior to insertion of the heating element of the aerosol-generating device into the aerosol-forming substrate of the aerosol-generating article.

As the aerosol-generating article is inserted further into the aerosol-generating device and prior to the aerosol-generating article reaching a position of maximum insertion, the insertion force is dominated by the force required to overcome resistance of the aerosol-forming substrate of the aerosol-generating article to insertion of the heating element of the aerosol-generating device.

Once the aerosol-generating article reaches a point of maximum insertion, the insertion force is dominated by the force required to deform the aerosol-generating article. At the position of maximum insertion, the extreme upstream end of the aerosol-generating article may come into contact with a surface, for example a bottom or rear surface, of the aerosol-generating device, which prevents the aerosol-generating article from being inserted further into the aerosol-generating device.

The support element of the aerosol-generating article resists the penetration force experienced by the aerosol-generating article during insertion of a heating element of an aerosol-generating device into the aerosol-forming substrate.

In one embodiment, the support element is configured to resist a penetration force of at least 2.5 N during insertion of a heating element of an aerosol-generating device into the aerosol-forming substrate.

In another embodiment, the support element is configured to resist a penetration force of at least 4 N during insertion of a heating element of an aerosol-generating device into the aerosol-forming substrate.

The support element of the aerosol-generating article resists downstream movement of the aerosol-forming substrate within the aerosol-generating article during insertion of a heating element of an aerosol-generating device into the aerosol-forming substrate.

This may help to ensure that the heating element of the aerosol-generating device is fully inserted into the aerosol-forming substrate and so avoid uneven and inefficient heating of the aerosol-forming substrate of the aerosol-generating article.

The support element may have a fracture force of at least 40 N, for example at least 45 N or at least 50 N as measured using a standard compression test.

The aerosol-cooling element may be located immediately downstream of the support element and abut the support element.

The aerosol-cooling element may be located between the support element and a mouthpiece located at the extreme downstream end of the aerosol-generating article.

The aerosol-cooling element may have a total surface area of between approximately 300 square millimetres per millimetre length and approximately 1000 square millimetres per millimetre length. In a preferred embodiment, the aerosol-cooling element has a total surface area of approximately 500 square millimetres per millimetre length.

The aerosol-cooling element may be alternatively termed a heat exchanger.

The aerosol-cooling element may have a low resistance to draw. That is, the aerosol-cooling element offers a low resistance to the passage of air through the aerosol-generating article.

The aerosol-cooling element does not substantially affect the resistance to draw of the aerosol-generating article.

The aerosol-cooling element may have a porosity of between 50% and 90% in the longitudinal direction. The porosity of the aerosol-cooling element in the longitudinal direction is defined by the ratio of the cross-sectional area of material forming the aerosol-cooling element and the internal cross-sectional area of the aerosol-generating article at the position of the aerosol-cooling element.

The aerosol-cooling element may alternatively be referred to as a heat exchanger.

The aerosol-cooling element may comprise a plurality of longitudinally extending channels. The plurality of longitudinally extending channels may be defined by a sheet material that has been one or more of crimped, pleated, gathered and folded to form the channels. The plurality of longitudinally extending channels may be defined by a single sheet that has been one or more of crimped, pleated, gathered and folded to form multiple channels. Alternatively, the plurality of longitudinally extending channels may be defined by multiple sheets that have been one or more of crimped, pleated, gathered and folded to form multiple channels.

It is preferred that airflow through the aerosol-cooling element does not deviate to a substantive extent between adjacent channels. In other words, it is preferred that the airflow through the aerosol-cooling element is in a longitudinal direction along a longitudinal channel, without substantive radial deviation. In some embodiments, the aerosol-cooling element is formed from a material that has a low porosity, or substantially no-porosity other than the longitudinally extending channels. For example, the aerosol-cooling element may be formed from a sheet material having low porosity or substantially no porosity that has been one or more of crimped, pleated, gathered and folded to form the channels.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In a preferred embodiment, the aerosol-cooling element comprises a gathered sheet of biodegradable material. For example, a gathered sheet of non-porous paper or a gathered sheet of biodegradable polymeric material, such as polylactic acid or a grade of Mater-Bi® (a commercially available family of starch based copolyesters).

In a particularly preferred embodiment, the aerosol-cooling element comprises a gathered sheet of polylactic acid.

The aerosol-cooling element may be formed from a gathered sheet of material having a specific surface area of between approximately 10 square millimetres per milligram and approximately 100 square millimetres per milligram weight. In some embodiments, the aerosol-cooling element may be formed from a gathered sheet of material having a specific surface area of approximately 35 $mm^2$/mg.

When an aerosol that contains a proportion of water vapour is drawn through the aerosol-cooling element, some of the water vapour may condense on a surface of the aerosol-cooling element. In such cases, it is preferred that the condensed water remains in droplet form on the surface of the aerosol-cooling element rather than being absorbed into the aerosol-cooling element. Thus, it is preferred that the aerosol-cooling element is formed from material that is substantially non-porous or substantially non-absorbent to water.

The aerosol-cooling element may act to cool the temperature of a stream of aerosol drawn through the aerosol-cooling element by means of thermal transfer. Components of the aerosol will interact with the aerosol-cooling element and loose thermal energy.

The aerosol-cooling element may act to cool the temperature of a stream of aerosol drawn through the aerosol-cooling element by undergoing a phase transformation that consumes heat energy from the aerosol stream. For example, the aerosol-cooling element may be formed from a material that undergoes an endothermic phase transformation such as melting or a glass transition.

The aerosol-cooling element may act to lower the temperature of a stream of aerosol drawn through the aerosol-cooling element by causing condensation of components such as water vapour from the aerosol stream. Due to condensation, the aerosol stream may be drier after passing through the aerosol-cooling element. In some embodiments, the water vapour content of an aerosol stream drawn through the aerosol-cooling element may be lowered by between approximately 20% and approximately 90%. The user may perceive the temperature of a drier aerosol to be lower than the temperature of a moister aerosol of the same actual temperature.

In some embodiments, the temperature of an aerosol stream may be lowered by more than 10 degrees Celsius as it is drawn through the aerosol-cooling element. In some embodiments, the temperature of an aerosol stream may be lowered by more than 15 degrees Celsius or more than 20 degrees Celsius as it is drawn through the aerosol-cooling element.

In some embodiments, the aerosol-cooling element removes a proportion of the water vapour content of an aerosol drawn through the aerosol-cooling element. In some embodiments, a proportion of other volatile substances may be removed from the aerosol stream as the aerosol is drawn through the aerosol-cooling element. For example, in some embodiments a proportion of phenolic compounds may be removed from the aerosol stream as the aerosol is drawn through the aerosol-cooling element.

Phenolic compounds may be removed by interaction with the material forming the aerosol-cooling element. For example, the aerosol-cooling element may be formed from a material that adsorbs the phenolic compounds (for example phenols and cresols).

Phenolic compounds may be removed by interaction with water droplets condensed on the surface of the aerosol-cooling element.

As noted above, the aerosol-cooling element may be formed from a sheet of suitable material that has been one or more of crimped, pleated, gathered or folded to define a plurality of longitudinally extending channels. A cross-sectional profile of such an aerosol-cooling element may show the channels as being randomly oriented. The aerosol-cooling element may be formed by other means. For example, the aerosol-cooling element may be formed from a bundle of longitudinally extending tubes. The aerosol-cooling element may be formed by extrusion, molding, lamination, injection, or shredding of a suitable material.

The aerosol-cooling element may comprise an outer tube or wrapper that contains or locates the longitudinally extending channels. For example, a pleated, gathered, or folded sheet material may be wrapped in a wrapper material, for example a plug wrapper, to form the aerosol-cooling element. In some embodiments, the aerosol-cooling element comprises a sheet of crimped material that is gathered into a rod-shape and bound by a wrapper, for example a wrapper of filter paper.

The aerosol-cooling element may have an external diameter that is approximately equal to the external diameter of the aerosol-generating article.

The aerosol-cooling element may have an external diameter of a diameter of between approximately 5 millimetres and approximately 10 millimetres, for example of between approximately 6 millimetres and approximately 8 millimetres. In a preferred embodiment, the aerosol-cooling element has an external diameter of 7.2 millimetres+1-10%.

The aerosol-cooling element may have a length of between approximately 5 millimetres and approximately 25 mm. In a preferred embodiment, the aerosol-cooling element has a length of approximately 18 millimetres.

In some embodiments, the aerosol-cooling element may comprise a gathered sheet of material selected from the group consisting of metallic foil, polymeric material, and substantially non-porous paper or cardboard. In some embodiments, the aerosol-cooling element may comprise a gathered sheet of material selected from the group consisting of polyethylene (PE), polypropylene (PP), polyvinylchloride (PVC), polyethylene terephthalate (PET), polylactic acid (PLA), cellulose acetate (CA), and aluminium foil.

In a preferred embodiment, the aerosol-cooling element comprises a gathered sheet of biodegradable polymeric material, such as polylactic acid or a grade of Mater-Bi® (a commercially available family of starch based copolyesters).

In a particularly preferred embodiment, the aerosol-cooling element comprises a gathered sheet of polylactic acid.

The aerosol-generating article may comprise a volatile flavour-generating component located in the aerosol-cooling element. For example, the aerosol-generating article may comprise a volatile flavour-generating component located in a longitudinally extending channel of the aerosol-cooling element.

The volatile flavour-generating component may be in the form of a liquid or a solid. The volatile flavour-generating compound may be coupled to, or otherwise associated with, a support element. The volatile flavour-generating component may comprise menthol.

Menthol may be used in solid or liquid form. In solid form, menthol may be provided as particles or granules. The term 'solid menthol particles' may be used to describe any granular or particulate solid material comprising at least approximately 80% menthol by weight.

Suitably, 1.5 mg or more of the volatile flavour generating component is included in the aerosol-generating article.

The volatile flavour-generating component may be coupled to a fibrous support element. The fibrous support element may be any suitable substrate or support for locating, holding, or retaining the flavour-generating component. The fibrous support element may be, for example, a paper support. Such a paper support may be saturated with a liquid component such as liquid menthol. The fibrous support may be, for example, a thread or twine. Such a thread or twine may be saturated in a liquid component such as liquid menthol. Alternatively, such a thread or twine may be threaded to or otherwise coupled to a solid flavour generating component. For example, solid particles of menthol may be coupled to a thread.

Suitably, the volatile flavour-generating component is supported by an elongate fibrous support element, such as a thread or twine. Suitably, the volatile flavour-generating component is disposed radially inward from an inner surface of the outer wrapper within the aerosol-generating article with the longitudinal axis of the elongate fibrous support element disposed substantially parallel to the longitudinal axis of the aerosol-generating article.

The aerosol-generating article may comprise a mouthpiece located at the downstream end of the aerosol-generating article.

The mouthpiece may be located immediately downstream of the aerosol-cooling element and abut the aerosol-cooling element.

The mouthpiece may comprise a filter. The filter may be formed from one or more suitable filtration materials. Many such filtration materials are known in the art. In one embodiment, the mouthpiece may comprise a filter formed from cellulose acetate tow.

The mouthpiece suitably has an external diameter that is approximately equal to the external diameter of the aerosol-generating article.

The mouthpiece may have an external diameter of a diameter of between approximately 5 millimetres and approximately 10 millimetres, for example of between approximately 6 millimetres and approximately 8 millimetres. In a preferred embodiment, the mouthpiece has an external diameter of 7.2 millimetres+1-10%.

The mouthpiece may have a length of between approximately 5 millimetres and approximately 20 millimetres. In a preferred embodiment, the mouthpiece has a length of approximately 14 millimetres.

The mouthpiece may have a length of between approximately 5 millimetres and approximately 14 millimetres. In a preferred embodiment, the mouthpiece has a length of approximately 7 millimetres.

The aerosol-forming substrate, the support element and the aerosol-cooling element and any other elements of the aerosol-generating article, such as the front-plug and mouthpiece where present, are circumscribed by an outer wrapper. The outer wrapper may be formed from any suitable material or combination of materials.

The outer wrapper can be a cigarette paper.

A downstream end portion of the outer wrapper may be circumscribed by a band of tipping paper.

The appearance of the aerosol-generating article may simulate the appearance of a conventional lit-end cigarette.

The aerosol-generating article may have an external diameter of between approximately 5 millimetres and approximately 12 millimetres, for example of between approximately 6 millimetres and approximately 8 millimetres. In a preferred embodiment, the aerosol-generating article has an external diameter of 7.2 millimetres+1-10%.

The aerosol-generating article may have a total length of between approximately 30 millimetres and approximately 100 millimetres. In a preferred embodiment, the aerosol-generating article has a total length of approximately 45 millimetres.

The aerosol-generating device may comprise: a housing; a heating element; an electrical power supply connected to the heating element; and a control element configured to control the supply of power from the power supply to the heating element.

The housing may define a cavity surrounding the heating element, the cavity configured to receive the aerosol-generating article.

The aerosol-generating device may be a portable or handheld aerosol-generating device that is comfortable for a user to hold between the fingers of a single hand.

The aerosol-generating device may be substantially cylindrical in shape.

The aerosol-generating device may have a length of between approximately 70 millimetres and approximately 120 millimetres.

The device may include other heaters in addition to the internal heating element that is inserted into the aerosol-forming substrate of the aerosol-generating article.

The power supply may be any suitable power supply, for example a DC voltage source such as a battery. In one embodiment, the power supply is a Lithium-ion battery. Alternatively, the power supply may be a Nickel-metal hydride battery, a Nickel cadmium battery, or a Lithium based battery, for example a Lithium-Cobalt, a Lithium-Iron-Phosphate, Lithium Titanate or a Lithium-Polymer battery.

The control element may be a simple switch. Alternatively the control element may be electric circuitry and may comprise one or more microprocessors or microcontrollers.

The aerosol-generating system may comprise an aerosol-generating device and one or more aerosol-generating articles configured to be received in the cavity of the aerosol-generating device.

The heating element of the aerosol-generating device may be any suitable heating element capable of being inserted into the aerosol-forming substrate of the aerosol-generating article.

For example, the heating element may be in the form of a pin or blade.

The heating element may have a tapered, pointed or sharpened end to facilitate insertion of the heating element into the aerosol-forming substrate of the aerosol-generating article.

The resistance to draw (RTD) of the aerosol-generating article after insertion of the heating element may be between approximately 80 mm WG and approximately 140 mm WG.

Features described in relation to one aspect or embodiment may also be applicable to other aspects and embodiments. For example, features described in relation to aerosol-generating articles and aerosol-generating systems described above may also be used in conjunction with methods of using aerosol-generating articles and aerosol-generating systems described above. Mechanical and/or electrical parts or elements of the aerosol-generating articles and/or aerosol-generating systems can be modified or adapted by routine experimentation in order to optimise the HPHC levels and/or the nicotine delivery profile. Thus, a method of testing, adapting or improving a device is also described in which the aerosol-generating article and/or the aerosol-generating system is modified and the modification is then tested to determine if the modification is beneficial. This process may be repeated two or more times. Thus, in one aspect, there is provided a method of modifying or adapting an aerosol-generating article in which tobacco contained in the aerosol-generating article is electrically heated to a temperature of less than about 400 degrees Celsius to create an aerosol, said method comprising the steps of: (a) providing the aerosol-generating article; (b) making one or more modifications to one or more component parts or elements thereof; and (c) testing the aerosol-generating article to determine if the modification(s) has a beneficial effect on the aerosol-generating article, said testing comprising the steps of: (i) determining the levels one or more HPHCs other than nicotine in the aerosol, wherein a reduction in the levels of one or more HPHCs in the aerosol is indicative that the one or more modifications has a beneficial effect on the aerosol-generating article; and/or (ii) determining the levels of one or more of at least carbon monoxide, benzene, acrolein and 1,3-butadiene therein in the user after inhaling the aerosol; wherein a reduction in one or more, suitably, all of these levels, is indicative that the one or more modifications have a beneficial effect on the aerosol-generating article. For example, different heating elements or the operation of the heating element can be adjusted and the impact thereof can be determined.

In certain embodiments, the modified aerosol-generating article can be tested within the parameters of determining if the aerosol contains levels of nicotine that are about the same as the levels in combusted tobacco; and wherein the aerosol contains levels of one or more harmful or potentially harmful constituents (HPHCs) other than nicotine that are lower than the levels in combusted tobacco. In certain embodiments, the modified aerosol-generating article can be tested within the parameters of at least a reduction in carbon monoxide and/or benzene and/or acrolein and/or 1,3-butadiene. In certain embodiments, the modified aerosol-generating article can be tested within the parameters of a carboxyhemoglobin (carbon monoxide marker) level in the sample of between about 1%-2% in blood; and/or a S-PMA (benzene marker) level in the user of between about 0.1 to 1 micro·g/g creatinine; and/or a 3-HPMA (acrolein marker) level in the user of about 200 to 400 micro·g/g creatinine; and/or a MHBMA (1,3-butadiene marker) level in the user is between about 0.1 to 1 micro·g/g creatinine.

Tobacco for use here may be derived or derivable from naturally occurring plants, mutant plants, non-naturally occurring plants or transgenic plants. Suitably, the tobacco is derived or is derivable from any species of the genus *Nicotiana*, including *N. rustica* and *N. tabacum* (for example, LA B21, LN KY171, TI 1406, Basma, Galpao, Perique, Beinhart 1000-1, K326, Hicks Broadleaf and Petico). Other species include *N. acaulis, N. acuminata, N. acuminata* var. *multiflora, N. africana, N. alata, N. amplexicaulis, N. arentsii, N. attenuata, N. benavidesii, N. benthamiana, N. bigelovii, N. bonariensis, N. cavicola, N. clevelandii, N. cordifolia, N. corymbosa, N. debneyi, N. excelsior, N. forgetiana, N. fragrans, N. glauca, N. glutinosa, N. goodspeedii, N. gossei, N. hybrid, N. ingulba, N. kawakamii, N. knightiana, N. langsdorffii, N. linearis, N. longiflora, N. maritima, N. megalosiphon, N. miersii, N. noctiflora, N. nudicaulis, N. obtusifolia, N. occidentalis, N. occidentalis* subsp. *hesperis, N. otophora, N. paniculata, N. pauciflora, N. petunioides, N. plumbaginifolia, N. quadrivalvis, N. raimondii, N. repanda, N. rosulata, N. rosulata* subsp. *ingulba, N. rotundifolia, N. setchellii, N. simulans, N. solanifolia, N. spegazzinii, N. stocktonii, N. suaveolens, N. sylvestris, N. thyrsiflora, N. tomentosa, N. tomentosiformis, N. trigonophylla, N. umbratica, N. undulata, N. velutina, N. wigandioides*, and *N. x sanderae*. In a highly preferred embodiment, the tobacco is derived or derivable from a plant of the genus *Nicotiana* or the species *Nicotiana tabacum*. The use of tobacco cultivars and elite tobacco cultivars is also contemplated. Particularly useful *Nicotiana tabacum* varieties include Burley type, dark type, flue-cured type, and Oriental type tobaccos. Non-limiting examples of varieties or cultivars are: BD 64, CC 101, CC 200, CC 27, CC 301, CC 400, CC 500, CC 600, CC 700, CC 800, CC 900, Coker 176, Coker 319, Coker 371 Gold, Coker 48, CD 263, DF911, DT 538 LC Galpao tobacco, GL 26H, GL 350, GL 600, GL 737, GL 939, GL 973, HB 04P, HB 04P LC, HB3307PLC, Hybrid 403LC, Hybrid 404LC, Hybrid 501 LC, K 149, K 326, K 346, K 358, K394, K 399, K 730, KDH 959, KT 200, KT204LC, KY10, KY14, KY 160, KY 17, KY 171, KY 907, KY907LC, KTY14×L8 LC, Little Crittenden, McNair 373, McNair 944, msKY 14×L8, Narrow Leaf Madole, Narrow Leaf Madole LC, NBH 98, N-126, N-777LC, N-7371LC, NC 100, NC 102, NC 2000, NC 291, NC 297, NC 299, NC 3, NC 4, NC 5, NC 6, NC7, NC 606, NC 71, NC 72, NC 810, NC BH 129, NC 2002, Neal Smith Madole, OXFORD 207, PD 7302 LC, PD 7309 LC, PD 7312 LC, 'Perique' tobacco, PVH03, PVH09, PVH19, PVH50, PVH51, R 610, R 630, R 7-11, R 7-12, RG 17, RG 81, RG H51, RGH 4, RGH 51, RS 1410, Speight 168, Speight 172, Speight 179, Speight 210, Speight 220, Speight 225, Speight 227, Speight 234, Speight G-28, Speight G-70, Speight H-6, Speight H20, Speight NF3, TI 1406, TI 1269, TN 86, TN86LC, TN 90, TN 97, TN97LC, TN D94, TN D950, TR (Tom Rosson) Madole, VA 309, VA359, AA 37-1, B 13P, Xanthi (Mitchell-Mor), Bel-W3, 79-615, Samsun Holmes NN, KTRDC number 2 Hybrid 49, Burley 21, KY 8959, KY 9, MD 609, PG 01, PG 04, PO1, PO2, PO3, RG 11, RG 8, VA 509, AS44, Banket A1, Basma Drama B84/31, Basma I Zichna ZP4/B, Basma Xanthi BX 2A, Batek, Besuki Jember, C104, Coker 347, Criollo Misionero, Delcrest, Djebel 81, DVH 405, Galpão Comum, HB04P, Hicks Broadleaf, Kabakulak Elassona, Kutsage E1, LA BU 21, NC 2326, NC 297, PVH 2110, Red Russian, Samsun, Saplak, Simmaba, Talgar 28, Wislica, Yayaldag, Prilep HC-72, Prilep P23, Prilep PB 156/1, Prilep P12-2/1, Yaka JK-48, Yaka JB 125/3, TI-1068, KDH-960, TI-1070, TW136, Basma, TKF 4028, L8, TKF 2002, GR141, Basma xanthi, GR149, GR153, Petit Havana.

Further aspects and embodiments of the present disclosure are presented in the following numbered paragraphs.

1. A method of administering or delivering nicotine to a user via inhalation of an aerosol comprising nicotine through an aerosol generating article comprising the steps of: (a) providing an aerosol-generating article in which tobacco contained in the aerosol-generating article is electrically heated to a temperature of less than about 400 degrees Celsius to create an aerosol; and (b) allowing the user to inhale the aerosol derived from the electrically heated tobacco; wherein the aerosol contains levels of nicotine that are about the same as the levels in combusted tobacco; and wherein the aerosol contains levels of one or more harmful or potentially harmful constituents (HPHCs) other than nicotine that are lower than the levels in combusted tobacco.

2. The method according to paragraph 1, wherein the HPHC other than nicotine in the aerosol generated by the electrically heated tobacco is selected from the group consisting of: nicotine-free dry particulate matter (NFDPM), carbon monoxide, formaldehyde, acetaldehyde, acetone, acrolein, propionaldehyde, crotonaldehyde, methyl-ethyl ketone, butyraldehyde, benzo[a]pyrene, phenol, m-cresol, o-cresol, p-cresol, catechol, resorcinol, hydroquinone, 1,3-butadiene, isoprene, acrylonitrile, benzene, toluene, pyridine, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia, arsenic, cadmium, chrome, lead, nickel, selenium and mercury or a combination of one or more thereof or a combination thereof.

3. The method according to paragraph 1 or paragraph 2, wherein one or more HPHCs other than nicotine are not detectable or are not appreciably detectable in the aerosol generated by the electrically heated tobacco, said HPHCs being selected from the group consisting of: m-cresol, p-cresol, 1,3 butadiene, isoprene, acrylonitrile, benzene, 1-aminonaphthalene, 2-aminonaphthalene, 3-aminobiphenyl, 4-aminobiphenyl, cyanhydric acid and cadmium or a combination of one or more thereof or a combination thereof.

4. The method according to any of the preceding paragraphs, wherein the levels of any one of carbon monoxide, benzene, acrolein and 1,3-butadiene in the user are lower than the levels in the user when generated from combusted tobacco.

5. The method according to paragraph 4, wherein the carboxyhemoglobin (carbon monoxide marker) level in the user is between about 1-2%, suitably about 1.5% in blood after 1 day of consuming aerosol generated from electrically heated tobacco; and/or the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco.

6. The method according to any of the preceding paragraphs, wherein the level of one or more metabolic enzymes is reduced in the user following inhalation of the aerosol generated from electrically heated tobacco as compared to the level in a user following inhalation of an aerosol generated from combusted tobacco, suitably, wherein the level is reduced to levels that are comparable with smoking abstinence.

7. The method according to any one of the preceding paragraphs, wherein the profile of nicotine delivery via inhalation of the aerosol generated by electrically heated tobacco is substantially the same as that obtained via inhalation of an aerosol generated from combusted tobacco.

8. The method according to paragraph 7, wherein the concentration of nicotine in the blood plasma increases to a maximum concentration within about 9 minutes of inhaling the aerosol from electrically heated tobacco; and/or wherein the $t_{max}$ is about 8 minutes; and/or wherein mean $AUC_{0-\infty}$ and $AUC_{0-t'}$, is about 19 ng·h/mL and about 0.5 ng·h/mL, respectively.

9. The method according to any of the preceding paragraphs, wherein the maximum concentration of nicotine that is delivered to the blood plasma of the user from inhaling the aerosol from electrically heated tobacco is between about 6 and 8 ng/ml of nicotine in plasma; and/or wherein the $t_{max}$ is about 8 minutes; and/or wherein mean $AUC_{0-\infty}$ and $AUC_{0-t'}$, is about 19 ng·h/mL and about 0.5 ng·h/mL, respectively.

10. The method according to any of the preceding paragraphs, wherein the concentration of nicotine that is delivered to the bloodstream of user is greater than about 60% of the concentration of nicotine delivered to the bloodstream of user via combustion of tobacco.

11. The method according to any one of the preceding paragraphs, wherein the electrical heating of the tobacco is controlled electronically over a period of time.

12. The method according to paragraph 11, wherein the aerosol generating article includes a temperature control sensor to avoid overheating the tobacco.

13. The method according to any of the preceding paragraphs, wherein the tobacco is homogenised tobacco material.

14. The method according to paragraph 13, wherein the aerosol-forming substrate comprises a gathered sheet of homogenised tobacco material.

15. The method according to paragraph 14, wherein the sheet is crimped.

16. A method of administering or delivering nicotine to a user via inhalation of an aerosol comprising nicotine through an aerosol generating article comprising the steps of: (a) providing an aerosol-generating article in which tobacco contained in the aerosol-generating article is electrically heated to a temperature of less than about 400 degrees Celsius to create an aerosol; and (b) allowing the user to inhale the aerosol derived from the electrically heated tobacco; wherein (i) the nicotine concentration in the user is between about 6 and 8 ng/ml in plasma after about 9 minutes after inhalation; (ii) the carboxyhemoglobin (carbon monoxide marker) level in the user is between about 1-2%, suitably about 1.5% in blood after 1 day of consuming aerosol generated from electrically heated tobacco; and/or (iii) the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or (iv) the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or (v) the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco.

17. A method of reducing the absorption of one or more HPHCs other than nicotine in a user inhaling aerosol generated from tobacco comprising the steps of: (a) providing a tobacco product to a user; (b) electrically heating said tobacco product to a temperature of less than about 400 degrees Celsius; (c) allowing the aerosol derived from the electrically heated tobacco to be inhaled by the user and absorbed into the bloodstream of the user; and (d)

optionally measuring the levels of nicotine and/or one or more other HPHCs in said user; wherein the aerosol contains levels of nicotine that are about the same as the levels in combusted tobacco; and wherein the level of one or more HPHCs other than nicotine in the aerosol is lower than the level in combusted tobacco.

18. Use of an electronic aerosol-generating device for delivering nicotine in an aerosol to a user, wherein the aerosol is generated by electrically heating tobacco to a temperature of less than about 400 degrees Celsius; wherein the aerosol contains levels of nicotine that are about the same as the levels in combusted tobacco; and wherein the level of one or more HPHCs other than nicotine in the aerosol is lower than the level in combusted tobacco.

19. Use of an electronic aerosol-generating device for delivering nicotine in an aerosol to a user, wherein the aerosol is generated by electrically heating tobacco to a temperature of less than about 400 degrees Celsius; wherein (i) the nicotine concentration in the user is between about 6 and 8 ng/ml in plasma about 9 minutes after inhalation; and (ii) the carboxyhemoglobin (carbon monoxide marker) level in the user is between about 1-2%, suitably about 1.5% in blood after 1 day of consuming aerosol generated from electrically heated tobacco; and/or (iii) the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or (iv) the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or (v) the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco.

20. A method of delivering nicotine to a user, wherein the nicotine delivery profile is substantially the same as combusted tobacco and wherein the levels of one or more HPHCs other than nicotine in the bloodstream of the user are lower than the levels from combusted tobacco comprising the use of an aerosol-generating article in which tobacco contained in the aerosol-generating article is electrically heated to a temperature of less than about 400 degrees Celsius by a heating element of the aerosol-generating article.

21. An aerosol generated by electrically heating tobacco to a temperature of less than about 400 degrees Celsius, wherein said aerosol comprises: (i) levels of nicotine are about the same as the levels in combusted tobacco; and (ii) levels of one or more HPHCs other than nicotine that are lower than the level in combusted tobacco.

22. The aerosol according to paragraph 21, wherein the HPHC other than nicotine is selected from the group consisting of: nicotine-free dry particulate matter (NFDPM), carbon monoxide, formaldehyde, acetaldehyde, acetone, acrolein, propionaldehyde, crotonaldehyde, methyl-ethyl ketone, butyraldehyde, benzo[a]pyrene, phenol, m-cresol, o-cresol, p-cresol, catechol, resorcinol, hydroquinone, 1,3-butadiene, isoprene, acrylonitrile, benzene, toluene, pyridine, quinoline, styrene, N'-nitrosonornicotine (NNN), N'-nitrosoanatabine (NAT), N'-nitrosoanabasine (NAB), 4-(methylnitrosamino)-1-(3-pyridyl)-1-butanone (NNK), 1-aminonaphthalene, 2-aminonaphthalene, 3-aminobiphenyl, 4-aminobiphenyl, nitrogen monoxide (NO), nitrous oxide (NOx), cyanhydric acid, ammonia, arsenic, cadmium, chrome, lead, nickel, selenium and mercury or a combination of one or more thereof or a combination thereof.

23. The aerosol according to paragraph 21 or 22, wherein one or more HPHCs other than nicotine are not detectable or are not appreciably detectable in the aerosol generated by the electrically heated tobacco, said HPHCs being selected from the group consisting of: m-cresol, p-cresol, 1,3 butadiene, isoprene, acrylonitrile, benzene, 1-aminonaphthalene, 2-aminonaphthalene, 3-aminobiphenyl, 4-aminobiphenyl, cyanhydric acid and cadmium or a combination of one or more thereof or a combination thereof.

24. A method of producing an aerosol according to any of paragraphs 21 to 23, comprising the steps of: (i) electrically heating tobacco to a temperature of less than about 400 degrees Celsius; (ii) allowing the electrically heated tobacco to produce an aerosol; and (iii) optionally, isolating or collecting the aerosol.

25. An aerosol-generating article comprising: (i) a heating element that heats tobacco to create an aerosol; and (ii) tobacco that is heated by the heating element the improvement comprising that the heating element electrically heats the tobacco to a temperature of less than about 400 degrees Celsius and the aerosol generated by the aerosol-generating article contains levels of nicotine that are about the same as the levels in combusted tobacco and the level of one or more HPHCs other than nicotine in the aerosol is lower than the level in combusted tobacco.

26. The method or the use or the aerosol-generating article according to any of the preceding paragraphs, wherein the aerosol-generating article is for use with an aerosol-generating device comprising an electric heating element, the aerosol-generating article comprising: (i) tobacco; (ii) a support element located immediately downstream of the aerosol-forming substrate; (iii) an aerosol-cooling element located downstream of the support element; and (iv) an outer wrapper circumscribing the aerosol-forming substrate, the support element and the aerosol-cooling element, wherein the support element abuts the aerosol-forming substrate.

27. A method of determining if a user uses an aerosol-generating article in which tobacco contained in the aerosol-generating article is electrically heated to a temperature of less than about 400 degrees Celsius to create an aerosol, said method comprising the steps of: (a) providing a sample from the user; and (b) determining the levels of one or more of at least carbon monoxide, benzene, acrolein and 1,3-butadiene therein; wherein (i) the carboxyhemoglobin (carbon monoxide marker) level in the user is between about 1-2%, suitably about 1.5% in blood after 1 day of consuming aerosol generated from electrically heated tobacco; and/or (ii) the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or (iii) the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or (iv) the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco is indicative that said user uses the aerosol-generating article.

28. A sample isolated from a user 2 days after using an aerosol-generating article in which tobacco contained in the aerosol-generating article is electrically heated to a temperature of less than about 400 degrees Celsius to create an aerosol, wherein (i) the carboxyhemoglobin (carbon monoxide marker) level in the sample is between about 1%-2%; and/or (ii) the S-PMA (benzene marker) level in the user is to between about 0.1 to 1 micro·g/g creatinine; and/or (iii) the 3-HPMA (acrolein marker) level in the user is about 200 to 400 micro·g/g creatinine; and/or (iv) the MHBMA (1,3-butadiene marker) level in the user is between about 0.1 to 1 micro·g/g creatinine.

29. The method or the sample according to any of the preceding paragraphs, wherein the levels of carbon monoxide, benzene, acrolein and 1,3-butadiene are determined.

30. A method of monitoring a user consuming nicotine via inhalation of an aerosol comprising nicotine through an aerosol generating article that electrically heats tobacco to a temperature of less than about 400 degrees Celsius, comprising the steps of: (a) providing the user with the aerosol generating article that electrically heats tobacco to a temperature of less than about 400 degrees Celsius; (b) allowing the user to inhale the aerosol comprising nicotine through the aerosol generating article; (c) providing or obtaining one or more samples from the user, which may be the same or different types of sample and which may optionally be a plurality of samples taken at time intervals during consumption by the user; (d) measuring the levels of two or more of at least nicotine, carbon monoxide, acrolein or benzene therein, either directly or in a biomarker thereof; and (e) comparing the levels measured in step (b) with the following levels or equivalent levels if different types of samples are used: (i) a carboxyhemoglobin (carbon monoxide marker) level in the sample of between about 1%-2% in blood; and/or (ii) a S-PMA (benzene marker) level in the user of between about 0.1 to 1 micro·g/g creatinine; and/or (iii) a 3-HPMA (acrolein marker) level in the user of about 200 to 400 micro·g/g creatinine; and/or (iv) a MHBMA (1,3-butadiene marker) level in the user is between about 0.1 to 1 micro·g/g creatinine; wherein correlation between the samples and the levels in step (c) is indicative that the user is responding favourably to the consumption of nicotine through the device.

31. A method of measuring a user's response to the inhalation of nicotine comprising the steps of: (a) providing the user with an aerosol generating article that electrically heats tobacco to a temperature of less than about 400 degrees Celsius; (b) allowing the user to inhale the aerosol comprising nicotine created by the aerosol generating article; (c) providing or obtaining one or more samples from the user, which may be the same or different types of sample and which may optionally be a plurality of samples taken at time intervals during inhalation by the user; (d) measuring the levels of two or more of at least nicotine, carbon monoxide, acrolein or benzene therein, either directly or in a biomarker thereof; and (e) comparing the levels measured in step (b) with the following levels or equivalent levels if different types of samples are used: (i) a carboxyhemoglobin (carbon monoxide marker) level in the sample of between about 1%-2% in blood; and/or (ii) a S-PMA (benzene marker) level in the user of between about 0.1 to 1 micro·g/g creatinine; and/or (iii) a 3-HPMA (acrolein marker) level in the user of about 200 to 400 micro·g/g creatinine; and/or (iv) a MHBMA (1,3-butadiene marker) level in the user is between about 0.1 to 1 micro·g/g creatinine.

32. The method or the sample according to any of the preceding paragraphs, wherein the levels of at least carbon monoxide, benzene, acrolein and 1,3-butadiene are measured.

33. A method modifying or adapting an aerosol-generating article in which tobacco contained in the aerosol-generating article is electrically heated to a temperature of less than about 400 degrees Celsius to create an aerosol, said method comprising the steps of: (a) providing the aerosol-generating article; (b) making one or more modifications to one or more components parts thereof; and (c) testing the aerosol-generating article to determine if the modification(s) has a beneficial effect on the aerosol-generating article, said testing comprising the steps of: (i) determining the levels one or more HPHCs other than nicotine in the aerosol, wherein a reduction in the levels of one or more HPHCs in the aerosol is indicative that the one or more modifications has a beneficial effect on the aerosol-generating article; and/or (ii) determining the levels of one or more of at least carbon monoxide, benzene, acrolein and 1,3-butadiene therein in the user after inhaling the aerosol; wherein a reduction in one or more, suitably, all of these levels is indicative that the one or more modifications have a beneficial effect on the aerosol-generating article.

34. A method, a use, an aerosol, or an aerosol-generating article substantially as described herein with reference to the accompanying drawings.

The disclosure is further described in the Examples below, which are provided to describe the disclosure in further detail. These examples, which set forth a preferred mode presently contemplated for carrying out the disclosure, are intended to illustrate and not to limit the disclosure.

EXAMPLES

Example 1

A single-center, open-label, randomized, controlled, crossover study to explore the nicotine pharmacokinetic (PK) profile and safety of using an aerosol-generating device (as described in FIGS. 5 to 7 herein and referred to as THS cigarettes) in which tobacco contained in the aerosol-generating device is heated to a temperature of about 375 degrees Celsius (maximum) and a range of about 350 degrees Celsius to about 399 degrees Celsius or less (taking account of possible variations in temperature) to create an aerosol compared to conventional cigarettes (CC) following single and ad libitum use in smoking, but otherwise healthy users.

The objective of this study is to evaluate the rate and the amount of nicotine absorbed in a user based on the plasma nicotine PK profile following single use of THS cigarettes in comparison to smoking CC, as assessed by the area under the plasma concentration-time curve (AUC) and the maximum plasma concentration ($C_{max}$). A further objective is to evaluate the partial AUC (AUC0-t', where t' is the user-specific time of peak nicotine concentration following CC and area under the concentration-time curve from time 0 extrapolated to time of last quantifiable concentration to infinity [AUC0-∞]) of THS cigarettes compared to CC users following single use. A further objective is to evaluate the time to Cmax (tmax) and half-life (t½) of nicotine with THS cigarettes compared to CC users following single use. A further objective is to compare the peak and trough nicotine concentration between THS cigarettes and CC users following ad libitum use. A further objective is to evaluate the levels of exhaled carbon monoxide (CO) and of blood carboxyhemoglobin (COHb) for THS cigarettes compared to CC users on single use and ad libitum use.

Materials & Methods

Study Design

This is a single-center, open-label, randomized, controlled, two-period, two-sequence, crossover study to explore the nicotine PK profile and safety of THS cigarettes compared to CC following single use in smoking, but otherwise healthy users.

In total, 28 eligible smoking users are randomized on Day 0 into one of the following two sequences: Sequence 1: THS 2.1→CC (N=14) or Sequence 2: CC→THS 2.1 (N=14).

Type of blinding: open-label

Type of control: conventional CC

Number of Users (Planned and Analyzed)

Screened: 78 users

Enrolled: 33 users

Randomized: 28 users

Safety population set: 33 users

PK single use analysis set (PKS population): 28 users

PK ad libitum use analysis set (PKAL population): 28 users

Diagnosis and Main Criteria for Inclusion

Female or male, otherwise healthy Caucasian, smokers (a smoking history of at least three years of consecutive smoking prior to screening and a minimum of 10 non-mentholated CC per day with a maximum yield of 1 mg nicotine ISO/CC during the four weeks prior to screening). The user is a current smoker who does not plan to quit smoking in the next 3 months however is ready to accept interruptions of smoking for up to two consecutive days. Users can smoke different brands until admission to the clinic. From Admission to the clinic onwards, however, users are restricted to the user's preferred CC brand. Smoking status is verified with a urinary cotinine test (cotinine≥200 ng/ml). Randomization quotas are used to ensure that each gender and smoking stratum represented at least 40% of the study population Test Product As shown in FIGS. 5 to 7, the aerosol-generating article includes a tobacco heating device, a THS cigarette holder for the use of specially designed THS cigarettes, and THS accessories, including a THS charging unit, a power adaptor and power cords to allow the charge of the holder.

Reference Products

Commercially available CC provided by the users according to their preference.

Duration of Exposure

The study is performed during a 7-day confinement period (seven overnight stays).

Period 1:

Day 0: Wash-out;

Day 1: single product use (THS 2.1/CC)

Day 2: ad libitum product use (THS 2.1/CC).

Period 2:

Day 3: Wash-out;

Day 4: single product use (THS 2.1/CC);

Day 5: ad libitum product use (THS 2.1/CC).

Criteria for Evaluation

Primary Endpoints:

Nicotine PK after single use of THS cigarette and CC: $C_{max}$

Area under the concentration-time curve from time zero to time of last quantifiable concentration ($AUC_{0\text{-}last}$)

Secondary Endpoints:

Pharmacokinetic Endpoints:

Nicotine PK after single use: $AUC_{0\text{-}\infty}$, $t_{max}$, $AUC_{0\text{-}t'}$, elimination rate constant and half-life ($t_{1/2}$).

Peak and trough nicotine concentration between THS cigarettes and CC users following ad libitum use.

Biomarker Endpoints:

Levels of exhaled CO and of blood COHb between THS cigarettes and CC users following single and ad libitum use Sample Size A total of 28 smokers are randomized. This sample size is needed to estimate the ratio of geometric means for $C_{max}$ ratio between THS cigarettes and CC with a precision allowing for the 90% confidence interval not exceeding the 0.80 and 1.25 limits, with 80% power and assuming a 5% drop out rate.

Statistical Methods

The primary PK endpoints are $AUC_{0\text{-}last}$ and $C_{max}$ values for nicotine following single product use. The secondary PK endpoints are $AUC_{0\text{-}\infty}$, $AUC_{0\text{-}t'}$, $t_{1/2}$, elimination rate constant and $t_{max}$ following single product use.

An analysis of variance (ANOVA) is conducted on log-transformed (natural log) single use PK parameters. The model includes terms for sequence, user within sequence, period and exposure group as fixed-effect factors. The results of the analysis for each of $AUC_{0\text{-}last}$ and $C_{max}$ are presented in terms of adjusted geometric least square (LS) means and 90% confidence intervals (CIs) for the THS cigarettes:CC ratio.

It is assumed that there is no carry-over effect or interaction between user, exposure, and period. Normality is not tested after the log transformation. As the log transformed data are used in the analysis, the reported results are back-transformed.

The $t_{max}$ is analyzed on the original scale using the Wilcoxon Signed-Rank Test. Hodges-Lehmann estimates are presented with 90% CI for the median differences between THS and CC.

Results

Demography

Out of the 33 users enrolled, 28 are randomized, and all 28 complete the study. Thirty-three users are exposed to the aerosol generating device (during the product trial) and are therefore included in the safety population. All 28 randomized users meet the inclusion/exclusion criteria, and the sequences are balanced with regard to age, height, weight and Body Mass Index (BMI).

Primary PK Endpoints

The mean nicotine concentration curves following single use of the two products are shown in FIG. 1. The overall shape of the concentration-time curves appear similar for the two products, but with a lower exposure to nicotine following single use of THS.

Following single use, the extent of the exposure to nicotine is, on average, 23% (90% CI: 15%, 30%) lower for THS compared to CC. Similarly, the maximum nicotine concentrations are, on average, 30% (90% CI: 18% to 40%) lower following single use of THS compared to CC. For both primary endpoints, the lower limit of the 90% CI for the geometric means ratio is less than 80% and the CIs did not contain 100%. Data is shown in Table 2.

Secondary PK Endpoints

There is no difference in the $t_{max}$ (90% CI: −1, 2), with both products having a $t_{max}$ of 8 minutes. The extent of nicotine exposure for THS, as assessed by both mean $AUC_{0\text{-}\infty}$ and $AUC_{0\text{-}t'}$, is 19.083 ng·h/mL and 0.5262 ng·h/mL, respectively. These estimates result to be 19% (95% CI: 11%, 27%) and 33% (95% CI: 12%, 48%) lower as compared to CC. The average elimination half-life of nicotine is 2.741 hours for THS, 11% (95% CI: 2%, 21%) longer than CC.

Example 2

A single-center, open-label, randomized, controlled, 2-arm parallel group study to evaluate the exposure to selected smoke constituents in smoking, but otherwise healthy users switching from conventional cigarettes to THS.

The objective of this study is to evaluate the effect of using THS cigarettes on selected primary biomarkers of exposure (BoExp) in smokers switching from conventional cigarettes (CC) to THS cigarettes as compared to those continuing to smoke CC. A further objective is to evaluate the effect of using THS cigarettes in confinement on selected secondary BoExp in smokers switching from CC to THS cigarettes as compared to those continuing to smoke CC. A further objective is to evaluate the effect of using THS cigarettes in a confinement setting on CYP1A2 enzymatic activity in smokers switching from CC to THS cigarettes as compared to those continuing to smoke CC. A further objective is to evaluate the safety of using THS cigarettes during the exposure period, and to evaluate the effect of using THS cigarettes in a confinement setting on 11-DTX-B2 in smokers switching from CC to THS cigarettes as compared to those continuing to smoke CC. A further objective is compare of the results obtained for selected primary and secondary BoExp, 11-DTX-B2, and CYP2A6 in different body matrices.

Materials & Methods

Study Design

This is a randomized, controlled, open-label, 2-arm, parallel group ad libitum smoking study comparing the use of THS cigarettes and CC. Users are confined in a controlled environment for nine days: Admission (Day −2), Baseline (Day −1 and Day 0), Exposure Period (Day 1 to Day 5), Discharge (Day 6). Evaluation of the effects of using THS cigarettes were performed on Day 5. Smoking during confinement is allowed between 06:30 and 23:00.

Randomization is stratified by gender and user reported daily average CC consumption during the four weeks prior to the screening Visit (those smoking 10 to 19 CC per day and those smoking >19 CC per day).

Type of blinding: open-label

Type of control: conventional cigarettes

Number of Users (Planned and Analyzed)

Enrolled: 42 users

Randomized: 40 users

Safety Population: 42 users

Full Analysis Set (FAS): 40 users

Per Protocol (PP) Population: 39 users

Diagnosis and Main Criteria for Inclusion

Female or male, otherwise healthy Caucasian, smokers are include with a smoking history of at least three years of consecutive smoking prior to Screening and a minimum of 10 non-mentholated CC per day with a maximum yield of 1 mg nicotine ISO/CC during the four weeks prior to screening. Users can smoke different brands until admission to the clinic. From admission to the clinic onwards, however, users are restricted to the user preferred CC brand. Smoking status is verified with a urinary cotinine test (cotinine ≥200 ng/ml). Randomization quotas are used to ensure that each gender and smoking stratum represented at least 40% of the study population.

Test Product

THS as shown in FIGS. 5 to 7 is composed of the tobacco heating device, the THS cigarette holder for the use of specially designed THS cigarettes and THS accessories, including a THS charging unit, a power adaptor and power cords to allow the charge of the holder.

Reference Products

Commercially available CC is provided by the users according to their preference.

Duration of Exposure Period

Users use THS for five days following a 2-day baseline period in which they smoke their own brand of CC.

Users randomized to the THS arm are assigned a THS cigarette holder and THS accessories.

Users are supplied with THS cigarettes one cigarette at a time, upon request. From Day 1, 06:30 onwards until Day 5, 23:00 users in the THS arm are not allowed to smoke CC.

Users randomized to the CC arm continue smoking their own preferred CC brand from Day 1 06:30 onwards until Day 5 23:00 ad libitum.

Criteria for Evaluation

The primary endpoints are the exposure to four harmful and potentially harmful constituents (HPHCs) (CO, 1,3-butadiene, acrolein, and benzene) assessed by measuring their respective biomarkers over the 5-day exposure period. The four constituents are several-fold higher in smokers than in smokers abstinent from smoking, and exhibit, on average, an elimination half-life of 524 hours. Therefore, the five days of exposure should be sufficient to reach a new steady state (at least five times their elimination half-life). Carbon monoxide is measured by using carboxyhemoglobin in blood as the marker in blood which can be quantitated by spectrophotometry. Benzene is measured by using S-Phenylmercapturic acid (S-PMA) in urine as the marker which can be quantitated by liquid chromatography-tandem mass spectrometry (LC-MS/MS). Acrolein is measured by using 3-Hydroxypropyl-mercapturic acid (3-HPMA) in urine as the marker which can be quantitated by via liquid chromatography-tandem mass spectrometry (LC-MS/MS). 1,3-butadiene is measured by using monohydroxybutenyl-mercapturic acid (MHBMA) in urine as the marker which can be quantitated by liquid chromatography-tandem mass spectrometry (LC-MS/MS).

In total, 14 biomarker of HPHCs are assessed in this study (see Table 3), of which 13 are listed in the FDA 18 abbreviated list to be reported.

Carbon monoxide in exhaled breath is measured using the Micro 4 Smokerlyzer. The test is conducted in conjunction with the blood sampling for COHb, where appropriate.

Additional Endpoints

- 11-DTX-B2 is measured in urine (spot urine samples and 24 hour urine samples).
- CYP1A2 activity is measured at Day 0 and at Day 5 based on paraxanthine (PX) and caffeine (CAF) plasma molar concentrations, approximately six hours (±15 minutes) after the intake of a cup of coffee.
- CYP2A6 activity is measured in plasma on Day 0 and on Day 5, using the metabolic:molar ratio of trans-3'-hydroxycotinine and cotinine.
- Assessment of cough with a visual analogue scale (VAS), three Likert scales and one open question.
- Smoking behavior: Product use and smoking topography with the SODIM® device.

Sample Size

A total of 40 smokers (20 in THS 2.1 arm, 20 in CC arm) are randomized. This sample size is calculated to attain more than 80% power to show a reduction in the THS arm compared to the CC arm, using a two-tailed test with 5% type I error probability.

Statistical Methods

BoExp is analyzed on the log-transformed (natural log) data adjusted for creatinine. Estimates of differences between groups are back-transformed to provide relative effects (THS/CC). Values at the end of the exposure period (EoE) on Day 5 are compared between exposure groups by means of a General Linear Model (GLM) adjusted for log transformed baseline values and stratification factors used at randomisation.

Descriptive summary statistics including the number of users (no.), no. of users with missing data, no. of users with results below limit of quantification (BLOQ), mean, standard deviation (SD), geometric mean and associated 95% confidence interval (CI), minimum, first quartile, median, third quartile, maximum and coefficient of variation (CV) are produced for each of the primary BoExp by study arm and overall for absolute values, and changes and percent changes from baseline for each day.

Unless stated otherwise, all statistical tests are two-sided and conducted at the 5% level, and all quoted confidence intervals are two-sided 95% confidence intervals.

Results

Demography

Out of the 42 users enrolled, 40 are randomized, and all 40 complete the study. One user is mis-randomized (two users are assigned the same randomization number) and is removed from the per-protocol population. Forty-two users are exposed to THS (during the product trial) and are therefore included in the safety population.

All 40 randomized users meet the inclusion/exclusion criteria, and the groups are balanced with regard to age, height, weight and Body Mass Index (BMI).

Primary Biomarkers of Exposure

There are significant decreases in all four primary BoExp. Changes are seen within 24 hours of starting use of THS and the decreases are maintained throughout the study.

COHb

Figure 2A:
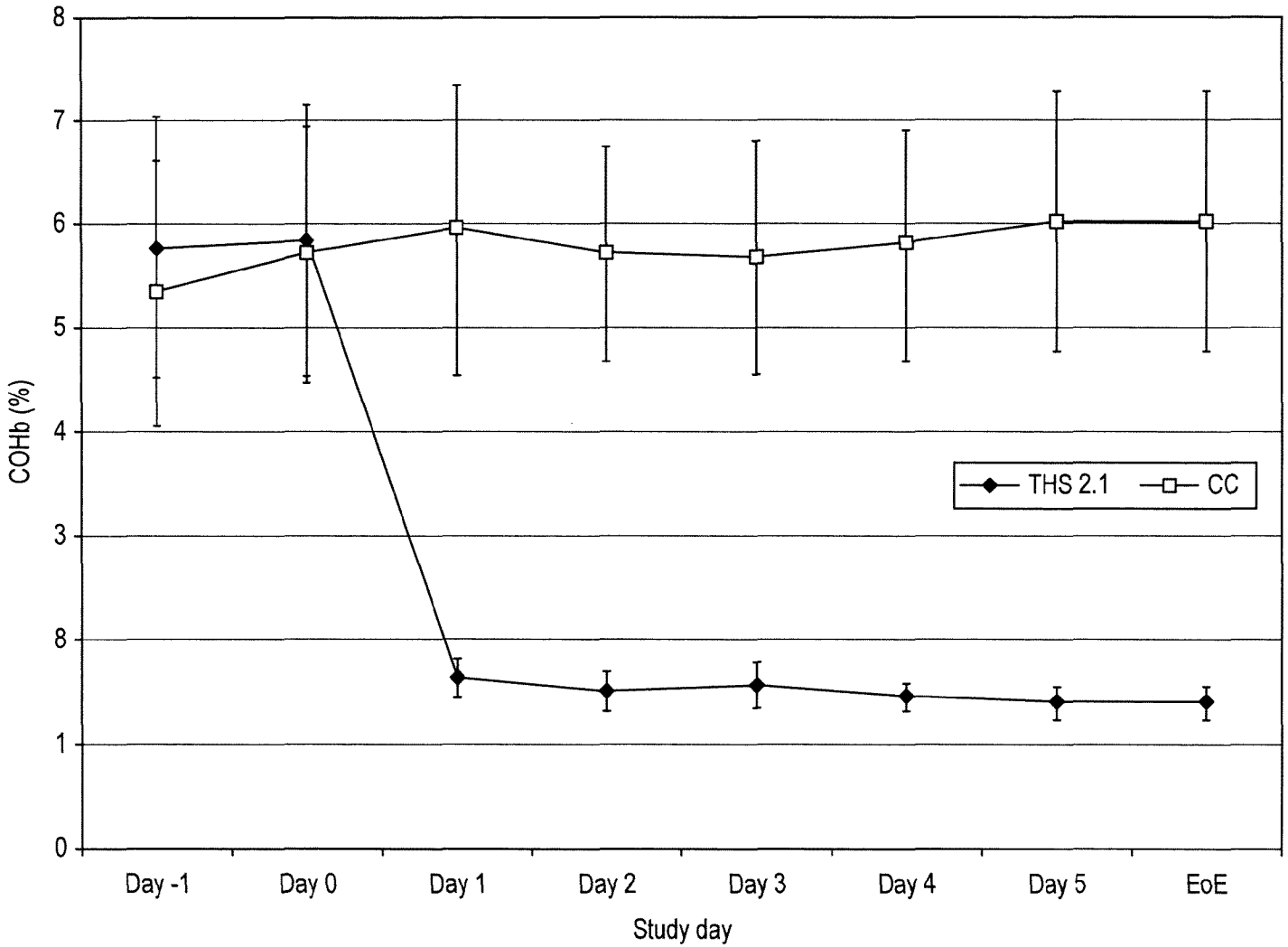
FIG. 2 illustrates changes of biomarkers of exposure adjusted for creatinine and shows the levels of carbon monoxide in exhaled breath (FIG. 2A), and the levels of 1,3-butadiene, acrolein, and benzene in urine (see FIGS. 2B, 2C, and 2D, respectively) from test users using the heated system (triangular symbol) versus the conventional cigarette in which tobacco is combusted (square symbol). Significant reductions in carbon monoxide, benzene, acrolein and 1,3-butadiene levels are seen in users using the heated system as compared to the conventional cigarette.

In the THS arm, carboxyhemoglobin drops from Baseline by slightly more than four percentage points (−4.19%±1.2%) on Day 1. On Day 5 the change relative to Baseline is a decrease of 75.2% for THS and an increase of 7.2% for CC. This change is maintained over the five days of exposure. In the CC arm, there is no notable change in carboxyhemoglobin. By Day 1, the level of COHb is below 2% for 19 out of 20 users in the THS arm, which is within the normal range for COHb for non-smokers. At Day 5 the level of COHb is below 2% for all 20 users. user The results are shown in FIG. 2A.

MHBMA

Figure 2B:
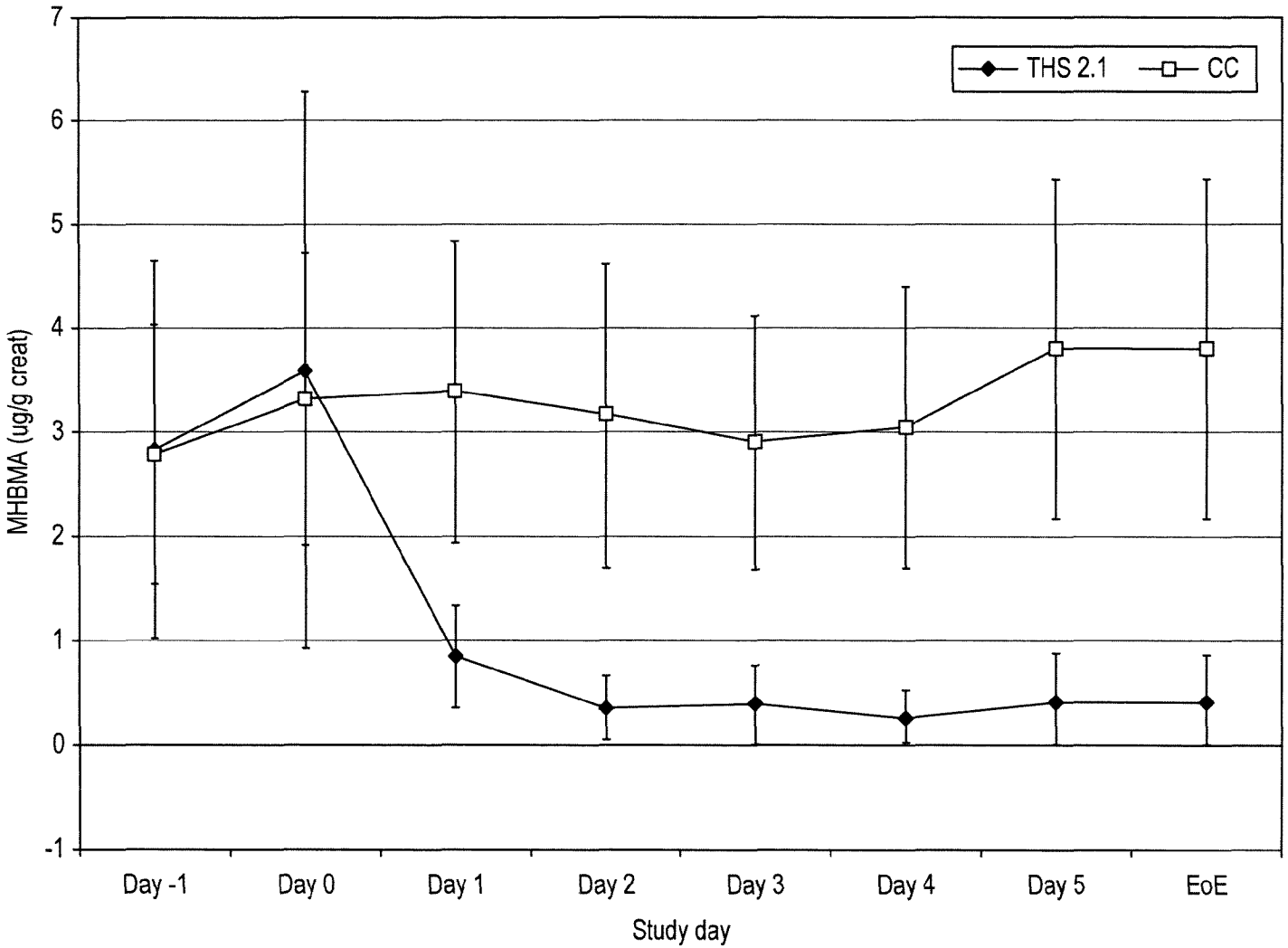

At the end of exposure period (EoE), the MHBMA urinary concentration adjusted for creatinine is more than 75% decreased from Baseline at Day 5 for THS and is increased 19.5% from Baseline at Day 5 for CC. The change is statistically significant. Changes in MHBMA are seen within 24-hours of starting use of THS, and maintained throughout the exposure. The results are shown in FIG. 2B.

3-HPMA

Figure 2C:
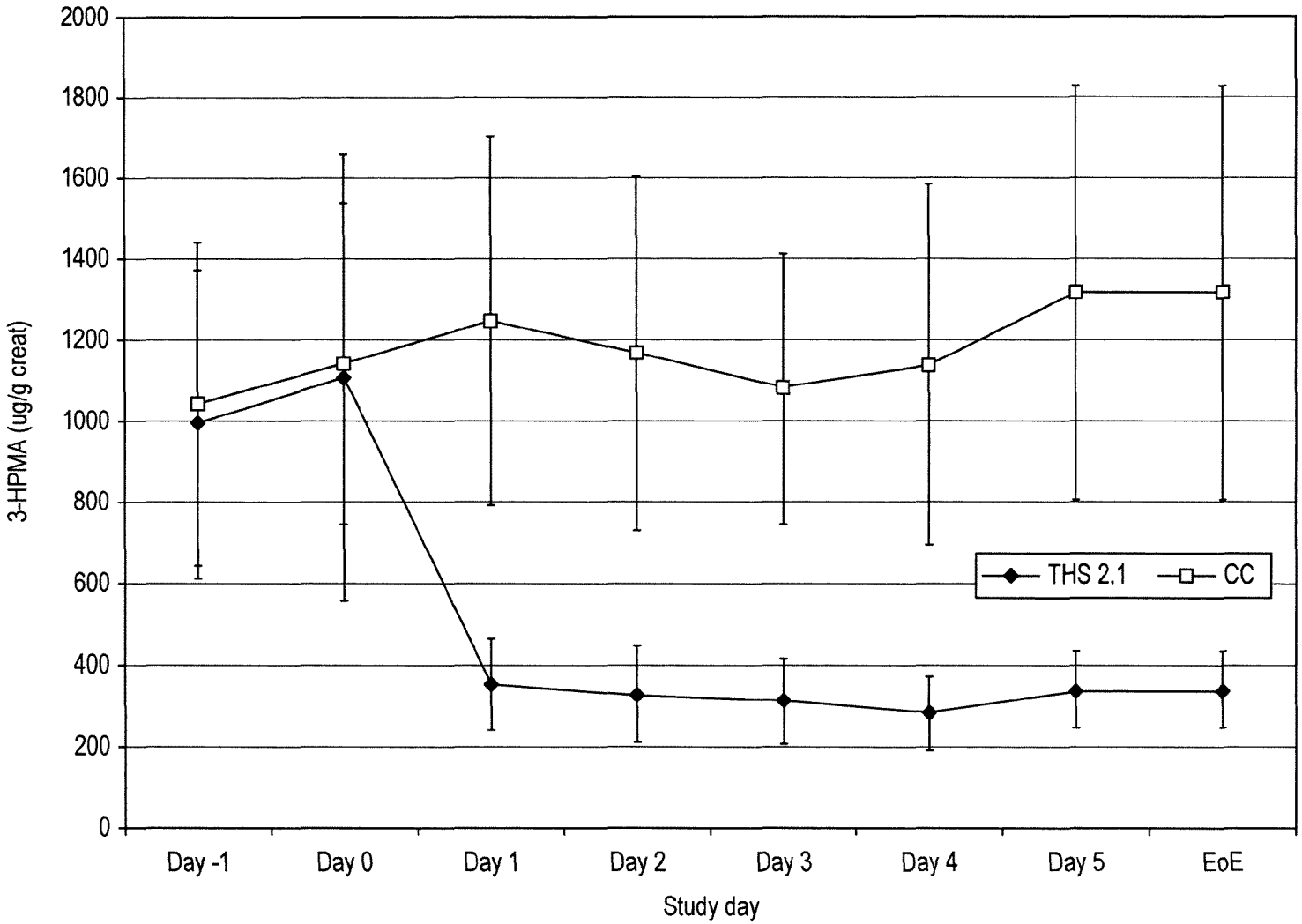

At the End of Exposure (EoE), the 3-HPMA urinary concentration adjusted for creatinine is more than −57.9% decreased from Baseline at Day 5 for THS 2.1 and is increased 11.4% from Baseline at Day 5 for CC. The change is statistically significant. Changes in 3-HPMA are seen within 24-hours of starting use of THS, and remained reduced through the exposure period. The results are shown in FIG. 2C.

S-PMA

Figure 2D:
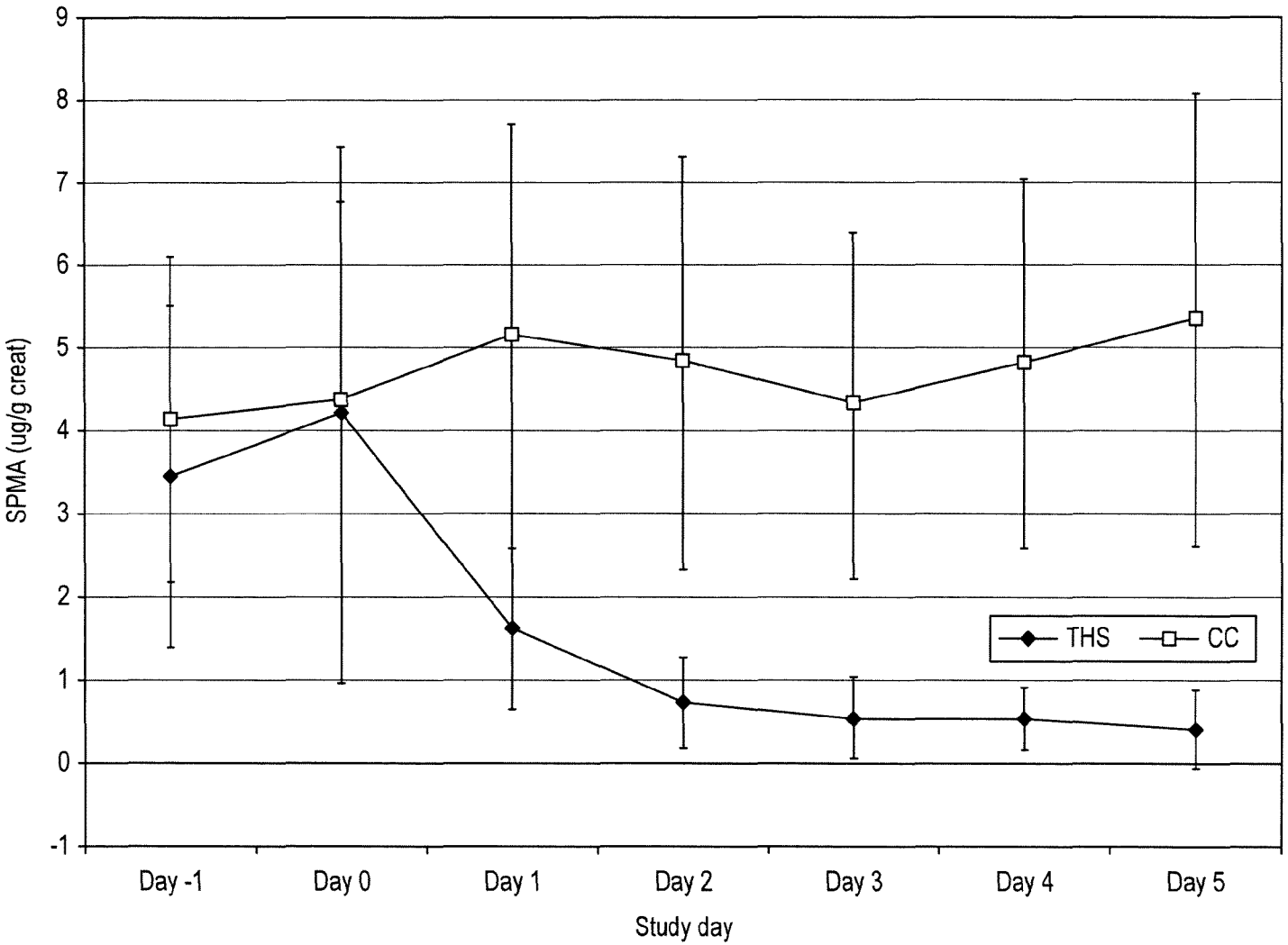

At the End of Exposure (EoE), the MHBMA urinary concentration adjusted for creatinine is more than −88% decreased from Baseline at Day 5 for THS and is increased 26.4% from Baseline at Day 5 for CC. The change is statistically significant. Changes in S-PMA are seen within 24-hours of starting use of THS, and remained low for the duration of the study. The results are shown in FIG. 2D.

The results are summarised in Table 5.

CYP1A2 Activity

Figure 3:
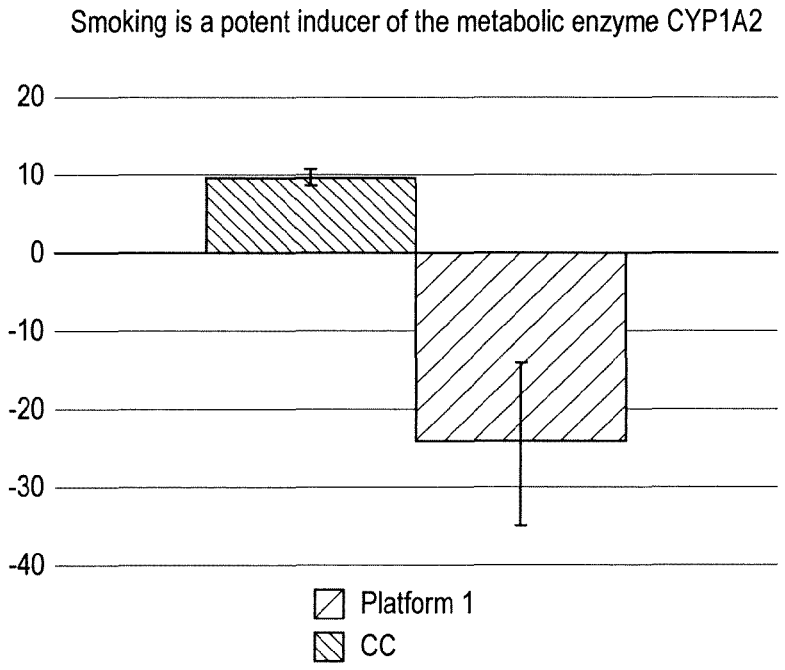
FIG. 3 illustrates the levels of the metabolic enzyme CYP1A2 in test users using the heated system (right hand bar) versus the conventional cigarette in which tobacco is combusted (left hand bar). Levels of CYP1A2 are significantly lower in users using the heated system and are reduced to levels that are comparable with smoking abstinence (30%).

Levels of CYP1A2 can be measured using methods known in the art, for example, see *Clinical Pharmacology & Therapeutics* (2011) 90, 117-125. CYP1A2 activity, decreases approximately 25% in the THS arm and remains the same in the CC arm. The results are shown in FIG. 3.

Example 3

Figure 4B:
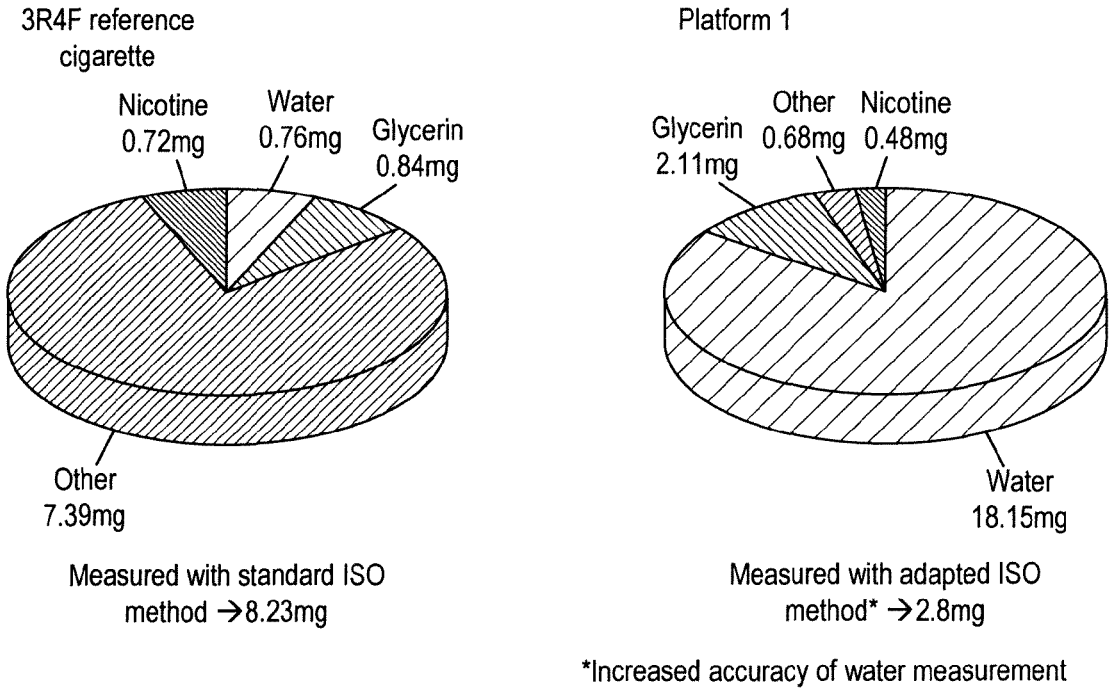
FIG. 4B illustrates the aerosol composition of aerosols produced via combustion of tobacco (reference cigarette) versus heating of tobacco (platform 1). As can be seen, the composition of the two aerosols is very different.

FIGS. 4A and 4B illustrate the chemical analysis of aerosol (smoke) produced via combustion of tobacco (MM-2008 median) versus heating of tobacco according to the present disclosure using menthol flavoured tobacco (platform 1 menthol) and regular tobacco (platform 1 regular). As can be seen in this Figure the levels of many HPHCs are reduced in aerosol produced by the heating of tobacco as compared to aerosol produced by combusting tobacco. The HPHCs are measured in aerosol (smoke) using methods that are well known in the art.

Any publication cited or described herein provides relevant information disclosed prior to the filing date of the present application. Statements herein are not to be construed as an admission that the inventors are not entitled to antedate such disclosures. All publications mentioned in the above specification are herein incorporated by reference. Various modifications and variations of the disclosure will be apparent to those skilled in the art without departing from the scope and spirit of the disclosure. Although the disclosure has been described in connection with specific preferred embodiments, it should be understood that the disclosure as claimed should not be unduly limited to such specific embodiments. Indeed, various modifications of the described modes for carrying out the disclosure which are obvious to those skilled the art and related fields are intended to be within the scope of the following claims.

TABLE 1

Examples of smoke constituent biomarkers of exposure

| Smoke constituent [*smoke phase*] | Biomarker [Matrix] | Biomarker $t_{1/2\beta}$ | Organ Class toxicity |
|---|---|---|---|
| 1,3-Butadiene [*gas*] | Monohydroxybutenyl-mercapturic acid (MHBMA) [Urine[(a)]] | 4 to 16 h | CA, RT, RDT |
| 1-Aminonaphthalene [*particulate*] | 1-Aminonaphthalene (1-NA) [Urine[(a)]] | Not described | CA |
| 2-Aminonaphthalene [*particulate*] | 2-Aminonaphthalene (2-NA) [Urine[(a)]] | 9 h | CA |
| 4-Aminobiphenyl [*particulate*] | 4-Aminobiphenyl (4-ABP) [Urine[(a)]] | 26 h | CA |

TABLE 1-continued

Examples of smoke constituent biomarkers of exposure

| Smoke constituent [smoke phase] | Biomarker [Matrix] | Biomarker $t_{1/2\beta}$ | Organ Class toxicity |
|---|---|---|---|
| Acrolein [gas] | 3-Hydroxypropyl-mercapturic acid (3-HPMA) [Urine(a)] | 10 h | RT, CT |
| Acrylonitrile [gas] | 2-Cyanoethylmercapturic acid (CEMA) [Urine(a)] | 17 h | CA, RT |
| Benzene [gas] | S-Phenyl-mercapturic acid (S-PMA) [Urine(a)] | 9 to 15 h | CA, CT, RDT |
| Benzo[a]pyrene [particulate] | 3-Hydroxybenzopyrene [Urine(a)] | 3 to 4 h | CA |
| Carbon monoxide [gas] | Carboxyhemoglobin (COHb) [Blood(b)] | 1 to 6 h | RDT, CT |
| Crotonaldehyde [gas] | 3-Hydroxy-1-methylpropyl-mercapturic acid (3-HMPMA) [Urine(a)] | 2 days | CA |
| Ethylene Oxide [gas] | 2-Hydroxyethyl-mercapturic acid (HEMA) [Urine(a)] | 5 h | CA, RT, RDT |
| Nicotine [particulate] | Nicotine (NIC-P) [Plasma(a)] | 1 to 2 h | RDT, AD |
| | Cotinine (COT-P) | 16 to 18 h | |
| | 3-OH Cotinine (3OHCOTP) [Plasma(a)] | — | |
| | Nicotine equivalents (NEq) [Urine(a)] | 16 h (estimated) | |
| NNK [particulate] | Total 4-(methylnitrosamino)-1-(3-pyridyl)-1-butanol (NNAL) [Urine(a)] | 10 to 18 days | CA |
| NNN [particulate] | Total N-nitrosonornicotine (NNN) [Urine(a)] | 15 h | CA |
| Pyrene [particulate] | Total 1-hydroxypyrene (1-OHP) [Urine(a)] | 6 to 20 h | Nontoxic (surrogate for exposure to polycyclic aromatic hydrocarbons) |
| o-Toluidine [gas] | o-Toluidine (o-TOL) [Urine(a)] | 10 to 16 h | CA |
| Toluene [gas] | S-benzyl-mercapturic acid (S-BMA) [urine(a)] | 9 h | RT, RDT |

Analytical methods: (a) liquid chromatography-tandem mass spectrometry (LC-MS/MS) (b) Spectrophotometry Organ Class toxicity (Federal Register 2012 Vol 77; no. 64)): AD: addictive; CA: carcinogen; CT: cardiovascular toxicant; RDT: reproductive and developmental toxicant; RT: respiratory toxicant

TABLE 2

| PK parameter (unit) | Product exposure | Number of users | Geometric means | Geometric means ratio (THS 2.1/CC) (%) | 90% CIs (%) Lower | 90% CIs (%) Upper | CV (%) |
|---|---|---|---|---|---|---|---|
| $AUC_{0\text{-}last}$ (ng · h/mL) | THS 2.1 | 28 | 17.659 | 77.41 | 70.46 | 85.04 | 20.85 |
| | CC | 28 | 22.813 | | | | |
| $C_{max}$ (ng/mL) | THS2.1 | 28 | 8.369 | 70.25 | 60.01 | 82.23 | 35.60 |
| | CC | 28 | 11.914 | | | | |

TABLE 3

| Exposure marker | Smoke constituent[smoke phase] | Matrix |
|---|---|---|
| Monohydroxybutenyl mercapturic acid (MHBMA) | 1,3-butadiene[gas] | Urine |
| 3-hydroxypropylmercapturic acid (3-HPMA) | acrolein[gas] | Urine |
| S-phenylmercapturic acid (S-PMA) | benzene[gas] | Urine |

TABLE 3-continued

| Exposure marker | Smoke constituent[smoke phase] | Matrix |
|---|---|---|
| Carboxyhemoglobin (COHb) | CO[gas] | Blood |
| Carbon monoxide (CO) | CO[gas] | Exhaled breath |
| 4-(methylnitrosamino)-1-(3-pyridyl)-1-butanol (total NNAL) | 4 (methylnitrosamino)-1-(3-pyridyl)-1butadone (NNK)[particulate] | Urine |
| Total 1-hydroxypyrene (1-OHP) | Pyrene[particulate] | Urine |
| Total N-nitrosonornicotine (NNN) | N-nitrosonornicotine[particulate] | Urine |
| 4-aminobiphenyl (4-ABP) | 4-aminobiphenyl[particulate] | Urine |
| 2-aminonaphthalene (2-NA) | 2-aminonaphtalene[particulate] | Urine |
| o-toluidine (o-tol) | o-toluidine[gas] | Urine |
| Nicotine equivalents (NEQ) free nicotine, nicotine-glucuronide, free cotinine, cotinine-glucuronide, free trans-3'-hydroxycotinine, trans-3'-hydroxycotinine-glucuronide | Nicotine[particulate] | Urine |
| Nicotine | Nicotine[particulate] | Plasma |
| Cotinine | Nicotine[particulate] | Plasma |
| 2-cyanoethylmercapturic acid (CEMA) | Acrylonitrile[gas] | Urine |

TABLE 4

| | | THS Regular | | | THS Menthol | | | 3R4F | | | % of 3R4F | |
|---|---|---|---|---|---|---|---|---|---|---|---|---|
| HPHC | Unit | Mean | ±SD | n | Mean | ±SD | n | Mean | ±SD | n | Regular | Menthol |
| Nicotine | mg/mg nic. | 1.00 | 0.07 | 25 | 1.00 | 0.10 | 29 | 1.00 | 0.05 | 299 | 100 | 100 |
| Carbon monoxide | mg/mg nic. | 0.39 | 0.04 | 25 | 0.35 | 0.12 | 29 | 14.84 | 0.71 | 292 | 2.65 | 2.35 |
| Formaldehyde | μg/mg nic. | 2.72 | 0.43 | 20 | 4.55 | 0.60 | 20 | 27.93 | 4.19 | 54 | 9.72 | 16.29 |
| Acetaldehyde | μg/mg nic. | 130.48 | 26.3 | 20 | 169.63 | 12.3 | 20 | 809.74 | 81.2 | 54 | 16.11 | 20.95 |
| Acrolein | μg/mg nic. | 5.35 | 1.21 | 20 | 8.22 | 1.07 | 20 | 78.80 | 7.84 | 54 | 6.78 | 10.43 |
| Crotonaldehyde | μg/mg nic. | 2.03 | 0.53 | 20 | 2.89 | 0.48 | 20 | 38.27 | 5.04 | 54 | 5.30 | 7.55 |
| Benzo[a]pyrene | ng/mg nic. | 0.93 | 0.03 | 4 | 1.02 | 0.03 | 3 | 7.27 | 0.83 | 33 | 12.74 | 14.05 |
| 1,3-butadiene | μg/mg nic. | 0.22 | 0.02 | 20 | 0.36* | NA | 0 | 29.46 | 6.02 | 23 | 0.74 | 1.24 |
| Isoprene | μg/mg nic. | 1.66 | 0.14 | 20 | 1.98 | 0.20 | 20 | 428.21 | 66.07 | 22 | 0.39 | 0.46 |
| Acrylonitrile | μg/mg nic. | 0.11 | 0.03 | 20 | 0.13 | 0.02 | 17 | 13.53 | 1.20 | 24 | 0.83 | 0.97 |
| Benzene | μg/mg nic. | 0.45 | 0.03 | 20 | 0.53 | 0.04 | 20 | 45.89 | 4.97 | 23 | 0.98 | 1.15 |
| Toluene | μg/mg nic. | 1.55 | 0.18 | 20 | 1.96 | 0.19 | 20 | 84.40 | 8.26 | 24 | 1.84 | 2.33 |
| N-nitrosonornicotine | μg/mg nic. | 4.70 | 0.31 | 4 | 5.19 | 0.73 | 3 | 140.34 | 11.66 | 26 | 3.35 | 3.70 |
| NNK | ng/mg nic. | 4.04 | 0.27 | 4 | 4.47 | 0.63 | 3 | 110.93 | 11.32 | 26 | 3.65 | 4.03 |
| 1-aminonaphthalene | ng/mg nic. | 0.07 | 0.01 | 4 | 0.10 | 0.02 | 4 | 10.94 | 1.27 | 22 | 0.67 | 0.87 |
| 2-aminonaphthalene | ng/mg nic. | 0.03 | 0.01 | 4 | 0.03 | 0.00 | 2 | 7.91 | 0.89 | 24 | 0.39 | 0.33 |
| 4-aminobiphenyl | ng/mg nic. | 0.01* | NA | 0 | 0.04* | NA | 0 | 1.75 | 0.25 | 24 | 0.59 | 2.20 |
| Ammonia | μg/mg nic. | 10.25 | 0.45 | 20 | 11.11 | 0.66 | 20 | 18.12 | 1.62 | 33 | 56.55 | 61.29 |

TABLE 5

| Primary Biomarkers of Exposure on Day 5 - Change from Baseline (%) | | | | | | |
|---|---|---|---|---|---|---|
| | THS 2.1 | | | CC | | |
| Parameter | Mean | SD | Median | Mean | SD | Median |
| CARBOXYHE-MOGLOBIN | −75.2 | 6.0 | −76.9 | 7.5 | 22.3 | 1.5 |
| MHBMA (ADJ CREAT) | −77.8 | 40.3 | −91.1 | 19.5 | | |
| 3-HPMA (ADJ CREAT) | −57.9 | 20.3 | −58.4 | 11.4 | 52.1 | 4.2 |
| S-PMA (ADJ CREAT) | −88.0 | 9.7 | −89.2 | 26.4 | 38.9 | 15.7 |

The invention claimed is:

1. A method of inhaling an aerosol comprising nicotine through an aerosol generating device comprising the steps of:

(a) providing an aerosol-generating device in which tobacco contained therein is electrically heated by an internal heating element to a temperature of between 325 and 390 degrees Celsius to create an aerosol without combusting the tobacco, wherein the internal heating element is in the form of a pin or blade; and (b) allowing a user to inhale the aerosol derived from the electrically heated tobacco, wherein the aerosol passes over and is cooled by an aerosol-cooling element before being inhaled by the user, and the aerosol-cooling element (i) has a total surface area of 300 to 1000 square millimeters per millimeter length and/or (ii) comprises a plurality of longitudinally extending channels;

wherein the aerosol contains levels of nicotine that are at least about 70% of the levels in combusted tobacco of reference cigarette 3R4F; and wherein the aerosol contains levels of one or more harmful or potentially harmful constituents (HPHCs) other than nicotine that are lower than the levels in combusted tobacco of reference cigarette 3R4F on a per mg of nicotine basis.

2. The method according to claim 1, wherein one or more HPHCs other than nicotine are not detectable or are not appreciably detectable in the aerosol generated by the electrically heated tobacco, said HPHCs being selected from the group consisting of: m-cresol, p-cresol, 1,3 butadiene, isoprene, acrylonitrile, benzene, 1-aminonaphthalene, 2-aminonaphthalene, 3-aminobiphenyl, 4-aminobiphenyl, cyanhydric acid and cadmium or a combination of one or more thereof or a combination thereof.

3. The method according to claim 1, wherein 4-aminobiphenyl, 2-aminonaphthalene and 1-aminonaphthalene are present in the aerosol at up to or less than about 0.1 ng/mg nicotine; wherein carbon monooxide, 1,3-butadiene, benzene, benzoprene and acrylonitrile are present in the aerosol at between about 0.4 and 0.11 ng/mg nicotine; wherein isoprene, toluene, formaldehyde and crotonaldehyde are present in the aerosol at between about 1.5 and 3 ng/mg nicotine; wherein N-nitrosonornicotine and NNK are present in the aerosol at between about 3.1 and 5 ng/mg nicotine; wherein acrolein is present in the aerosol at between about 4 and 7 ng/mg nicotine; wherein ammonia is present in the aerosol at between about 9 and 11 ng/mg nicotine; and wherein acetaldehyde is present in the aerosol at between about 100 and 160 ng/mg nicotine.

4. The method according to claim 1, wherein the levels of any one of carbon monoxide, benzene, acrolein and 1,3-butadiene or biomarkers thereof in the user of the aerosol-generating device are lower than the levels in the user when generated from combusted tobacco, suitably, wherein the carboxyhemoglobin (carbon monoxide marker) level in the user is between about 1-2%, suitably about 1.5% in blood after 1 day of consuming aerosol generated from electrically heated tobacco; and/or the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco.

5. The method according to claim 1, wherein the profile of nicotine delivery via inhalation of the aerosol generated by electrically heated tobacco is substantially the same as that obtained via inhalation of an aerosol generated from combusted tobacco, suitably, wherein the concentration of nicotine in the blood plasma increases to a maximum concentration within about 9 minutes of inhaling the aerosol from electrically heated tobacco; and/or wherein the $t_{max}$ is between about 7 and 9 minutes; and/or wherein mean $AUC_{0-\infty}$ and $AUC_{0-t'}$, is between about 18 and 20 ng·h/mL and between about 0.5 and 0.6 ng·h/mL, respectively.

6. The method according to claim 1, wherein the heating element that electrically heats the tobacco is inserted into the tobacco and wherein a continuous supply of energy is supplied to the heating element, said continuous supply of energy being monitored during use of the device.

7. The method according to claim 2, wherein 4-aminobiphenyl, 2-aminonaphthalene and 1-aminonaphthalene are present in the aerosol at up to or less than about 0.1 ng/mg nicotine; wherein carbon monooxide, 1,3-butadiene, benzene, benzo[a]prene and acrylonitrile are present in the aerosol at between about 0.4 and 0.11 ng/mg nicotine; wherein isoprene, toluene, formaldehyde and crotonaldehyde are present in the aerosol at between about 1.5 and 3 ng/mg nicotine; wherein N-nitrosonornicotine and NNK are present in the aerosol at between about 3.1 and 5 ng/mg nicotine; wherein acrolein is present in the aerosol at between about 4 and 7 ng/mg nicotine; wherein ammonia is present in the aerosol at between about 9 and 11 ng/mg nicotine; and wherein acetaldehyde is present in the aerosol at between about 100 and 160 ng/mg nicotine.

8. The method according to claim 7, wherein the levels of any one of carbon monoxide, benzene, acrolein and 1,3-butadiene or biomarkers thereof in the user of the aerosol-generating device are lower than the levels in the user when generated from combusted tobacco, suitably, wherein the carboxyhemoglobin (carbon monoxide marker) level in the user is between about 1-2%, suitably about 1.5% in blood after 1 day of consuming aerosol generated from electrically heated tobacco; and/or the S-PMA (benzene marker) level in the user is between about 0.1 to 1 micro·g/g creatinine, suitably about 0.5 micro·g/g creatinine in urine after 2 days of consuming aerosol generated from electrically heated tobacco; and/or the 3-HPMA (acrolein marker) level in the user is between about 200 to 400 micro·g/g creatinine, suitably, about 300 micro·g/g creatinine in urine after 2 days of consuming aerosol generated from electrically heated tobacco; and/or the MHBMA (1,3-butadiene marker) level in the user is about 0.1 to 1 micro·g/g creatinine, suitably 0.5 micro·g/g creatinine in urine after 2 days of consuming aerosol generated from electrically heated tobacco.

9. The method according to claim 8, wherein the profile of nicotine delivery via inhalation of the aerosol generated by electrically heated tobacco is substantially the same as that obtained via inhalation of an aerosol generated from combusted tobacco, suitably, wherein the concentration of nicotine in the blood plasma increases to a maximum concentration within about 9 minutes of inhaling the aerosol from electrically heated tobacco; and/or wherein the $t_{max}$ is between about 7 and 9 minutes; and/or wherein mean $AUC_{0-\infty}$ and $AUC_{0-t'}$, is between about 18 and 20 ng·h/mL and between about 0.5 and 0.6 ng·h/mL, respectively.

10. The method according to claim 9, wherein the heating element that electrically heats the tobacco is inserted into the tobacco and wherein a continuous supply of energy is supplied to the heating element, said continuous supply of energy being monitored during use of the device.

* * * * *